US007891017B2

(12) United States Patent
Tsukamoto et al.

(10) Patent No.: US 7,891,017 B2
(45) Date of Patent: Feb. 22, 2011

(54) BALL CATCHING TOOL FOR BASEBALL OR SOFTBALL

(75) Inventors: Michiharu Tsukamoto, Osaka (JP); Daisuke Kogawa, Osaka (JP); Norifumi Ito, Osaka (JP); Kei Kato, Osaka (JP)

(73) Assignee: Mizuno Corporation, Osaka (JP)

( * ) Notice: Subject to any disclaimer, the term of this patent is extended or adjusted under 35 U.S.C. 154(b) by 1424 days.

(21) Appl. No.: 11/344,597

(22) Filed: Jan. 31, 2006

(65) Prior Publication Data

US 2006/0200886 A1 Sep. 14, 2006

(30) Foreign Application Priority Data

Feb. 1, 2005 (JP) ..... 2005-025156
Jan. 17, 2006 (JP) ..... 2006-008992

(51) Int. Cl.
*A63B 71/14* (2006.01)

(52) U.S. Cl. ..... 2/19; 2/161.1; 2/161.6

(58) Field of Classification Search ..... 2/19, 2/16, 159, 160, 161.1, 161.6
See application file for complete search history.

(56) References Cited

U.S. PATENT DOCUMENTS 1,496,824 A * 6/1924 Nixon, Jr. ..... 2/19
1,633,926 A * 6/1927 Craig ..... 2/19
4,339,830 A * 7/1982 Sasaki ..... 2/19
5,572,739 A * 11/1996 Kolada et al. ..... 2/19
2008/0060104 A1* 3/2008 Lin et al. ..... 2/19
2009/0077705 A1* 3/2009 Gilligan et al. ..... 2/19
2009/0300814 A1* 12/2009 Kume et al. ..... 2/19

FOREIGN PATENT DOCUMENTS

| | | |
|---|---|---|
| JP | 55-107180 | 7/1980 |
| JP | 56-90274 | 7/1981 |
| JP | 56-171079 | 12/1981 |
| JP | 57-29274 | 2/1982 |
| JP | 57-29275 | 2/1982 |

OTHER PUBLICATIONS

Office Action issued by Japanese Patent Office; Patent Application No. 2006-008992; dated Oct. 28, 2008; pp. 1-2.

* cited by examiner

*Primary Examiner*—Gary L Welch
*Assistant Examiner*—Alissa J Tompkins
(74) *Attorney, Agent, or Firm*—Troutman Sanders LLP; James E. Schutz; Robert R. Elliott, Jr.

(57) ABSTRACT

A ball catching tool for baseball or softball includes a thumb-stall receiving the thumb, an index-finger-stall receiving the index finger, a middle-finger-stall receiving the middle finger, a ring-finger-stall receiving the ring finger and a little-finger-stall receiving the little finger; wherein a ball catching assisting portion of at least 6.15 mm and at most 26.6 mm in height is provided on a ball catching side surface of the thumb-stall or its root portion.

20 Claims, 52 Drawing Sheets

BALL CATCHING TOOL FOR BASEBALL OR SOFTBALL

This nonprovisional application is based on Japanese Patent Applications Nos. 2005-025156 and 2006-008992 filed with the Japan Patent Office on Feb. 1, 2005 and Jan. 17, 2006, respectively, the entire contents of which are hereby incorporated by reference.

BACKGROUND OF THE INVENTION

1. Field of the Invention

The present invention relates to a baseball or softball catching tool (hereinafter simply referred to as a "ball catching tool") and, more specifically, to a catching tool having a protruded portion on a surface thereof, to prevent unexpected slipping of the ball.

2. Description of the Background Art

Baseball or softball gloves as examples of conventional ball catching tool are described in Japanese Utility Model Laying-Open Nos. 57-29274, 57-29275, 56-90274 and 56-171079.

Japanese Utility Model Laying-Open No. 57-29274 describes a glove with a plurality of slip preventing means in the form of protrusions surrounding the central portion of a ball catching surface of the glove. The surface skin of the glove is mold-pressed to form bumps, and inclusions are inserted in the bumps, whereby the slip preventing means is formed. As the slip preventing means is formed by mold pressing of the surface skin, the height of the slip preventing means is limited. Further, as the surface of the slip preventing means is the surface skin, degree of freedom in selecting the height of the slip preventing means is small.

Japanese Utility Model Laying-Open No. 57-29275 describes a glove with slip preventing means in the form of a plurality of projections surrounding the central portion of the ball catching surface of the glove. The projections are provided by cutting the surface skin in meandering manner and pulling the cut end portions outward. Therefore, the height of the projection is defined by the thickness of the surface skin.

Japanese Utility Model Laying-Open No. 56-90274 describes a glove having multiple pores opened in the surface skin at the ball catching portion, a thin padding inserted between the surface and back skins, with the padding having small projections formed on the front side at portions corresponding to the pores formed in the surface skin, so that each small projection is fit in each pore and slightly protrudes from the surface. Japanese Utility Model Laying-Open No. 56-171079 describes a glove having an embossed pattern of small dots formed by hot-mold pressing at the surface skin of leather at a palm portion and finger portions of the ball catching tool. The embossed pattern of small dots is formed by mold pressing, and therefore, its height is limited.

Among ball catching failures, a so-called fumble occurs due to insufficient closing of the ball catching tool by the player, after the ball touches the ball catching tool and before the ball bounces off from the ball catching tool. Therefore, the protruded portions formed on the surface skin that are not very high, such as those of the conventional ball catching tools described above, have only an insufficient function of supplementing the distance necessary for closing the ball catching tool for the player to catch the ball, and the function of assisting ball catching have not been successfully exploited.

SUMMARY OF THE INVENTION

The present invention was made to solve the above-described problem, and its object is to provide a ball catching tool that can reduce ball catching failures generally referred to as fumbles, by providing protruded portions of a prescribed height on a surface of the surface skin.

According to an aspect, the present invention provides a ball catching tool, including a surface skin formed by sewing together a ball catching surface skin and a dorsal skin; a pocket portion at a central portion of the ball receiving surface skin; a thumb-stall receiving the thumb of a user; a finger-stall receiving fingers of the user other than the thumb; an edge portion positioned on a side of an opening for the user to insert his/her hand; and a ball catching assisting portion arranged on at least one of the thumb-stall or its root portion and the finger-stall or its root portion; wherein the ball catching assisting portion includes a first ridge portion extending along a width direction of the thumb-stall or the finger-stall on which the ball catching assisting portion is provided, and a second ridge portion extending in a direction crossing the direction of extension of the first ridge portion.

Preferably, the second ridge portion extends from a side of the pocket portion to a tip end side of the thumb-stall or the finger-stall on which the ball catching assisting portion is provided, and the ball catching assisting portion has an inclined surface on a side of the edge portion inclined such that height at the side of the edge portion is lower than at a side of the pocket portion.

Preferably, the ball catching assisting portion includes an upper surface and a peripheral surface connected to the upper surface; and the upper surface and the peripheral surface are arranged protruded from the ball catching surface skin, and a lower surface connected to the peripheral surface is fixed on the ball catching surface skin.

Preferably, the ball catching tool further includes a bulged portion formed on the surface skin, wherein the bulged portion is formed on at least one root portion of the thumb-stall and the finger-stall except for the thumb-stall and the finger-stall on which the ball catching assisting portion is arranged, of the thumb-stall and the finger-stall.

Preferably, the ball catching assisting portion is arranged on the thumb-stall or on its root portion; and the bulged portion is formed at least on one of a middle-finger-stall receiving the middle finger of the user or its root portion, a ring-finger-stall receiving the ring finger of the user or its root portion, and a little-finger-stall receiving the little finger of the user or its root portion.

According to another aspect, the present invention provides a ball catching tool including: a thumb-stall receiving the thumb of a user; an index-finger-stall receiving the index finger of the user; a middle-finger-stall receiving the middle finger of the user; a ring-finger-stall receiving the ring finger of the user; and a little-finger-stall receiving the little finger of the user; wherein a ball catching assisting portion of at least 6.15 mm and at most 26.6 mm in height is formed on a ball catching side surface of the thumb-stall or at its root portion.

According to a further aspect, the present invention provides a ball catching tool including: a thumb-stall receiving the thumb of a user; an index-finger-stall receiving the index finger of the user; a middle-finger-stall receiving the middle finger of the user; a ring-finger-stall receiving the ring finger of the user; and a little-finger-stall receiving the little finger of the user; wherein a ball catching assisting portion of at least 6.15 mm and at most 26.6 mm in height is formed on a ball catching side surface of at least one of the middle-finger-stall or at its root portion, the ring-finger-stall or at its root portion, and the little-finger-stall or its root portion.

According to a still further aspect, the present invention provides a ball catching tool including: a thumb-stall receiving the thumb of a user; an index-finger-stall receiving the index finger of the user; a middle-finger-stall receiving the middle finger of the user; a ring-finger-stall receiving the ring finger of the user; and a little-finger-stall receiving the little finger of the user; wherein a first ball catching assisting portion is provided on a ball catching side surface of the thumb-stall or its root portion, a second ball catching assisting portion is provided on a ball catching side surface of at least one of the middle-finger-stall or at its root portion, the ring-finger-stall or at its root portion, and the little-finger-stall or its root portion; and sum of heights of the first ball catching assisting portion and the second ball catching assisting portion is at least 6.15 mm and at most 26.6 mm.

Preferably, the ball catching tool further includes a pocket portion at a central portion of a ball catching surface skin, and an edge portion positioned on a side of an opening for the user to insert his/her hand; wherein a ball catching assisting portion has an inclined surface formed with its height increasing from the side of the edge portion to the side of the pocket portion.

Preferably, a ball catching assisting portion includes a first ridge portion extending along the pocket portion at the central portion of the ball catching surface skin, and a second ridge portion extending in a direction crossing the direction of extension of the first ridge portion.

Preferably, the second ridge portion extends from a side of the pocket portion to a side of a tip end of the thumb-stall or the finger-stalls on which the ball catching assisting portion is provided.

Preferably, the ball catching assisting portion includes an upper surface and a peripheral surface connected to the upper surface; and the upper surface and the peripheral surface are arranged protruded from the ball catching surface skin, and a lower surface of the ball catching assisting portion is fixed on the ball catching surface skin.

Preferably, the ball catching assisting portion is formed of a material having friction coefficient higher than a material forming a ball receiving surface of the ball catching tool for baseball or softball.

Preferably, the ball catching assisting portion is divided into a plurality of divided ball catching assisting portions.

Preferably, a tip end assisting portion protruded from a surface of a ball receiving surface is provided at a tip end portion of at least one of the thumb-stall, the index-finger-stall, the middle-finger-stall, the ring-finger-stall and the little-finger-stall.

Preferably, the ball catching tool includes a surface skin formed by sewing together a ball catching surface skin and a dorsal skin, and a pocket portion at a central portion of the ball receiving surface skin, wherein a flat surface is formed on an upper surface of the ball catching assisting portion on the side of the pocket portion.

Preferably, the present invention provides a ball catching tool for baseball or softball, including: a surface skin formed by sewing together a ball catching surface skin and a dorsal skin; a pocket portion at a central portion of the ball receiving surface skin; a thumb-stall receiving the thumb of a user; a finger-stall receiving fingers of the user other than the thumb; and a ball catching assisting portion arranged on at least one of the thumb-stall or its root portion and the finger-stall or its root portion; wherein a part of a peripheral portion of the ball catching tool for baseball or softball is formed of an outer edge portion of the thumb-stall and an outer edge of the finger-stall; and the ball catching assisting portion includes an inclined surface formed with its height increasing from the outer edge portion of at least one of the thumb-stall and the finger-stall, on which the ball catching assisting portion is provided, to a side of the pocket portion, and a ridge portion along the pocket portion.

According to a still further aspect, the present invention provides a ball catching tool, including: a thumb-stall receiving the thumb of a user; a finger-stall receiving the index finger, middle finger, ring finger and little finger of the user; a ball catching assisting portion for the thumb arranged on a ball receiving side surface of the thumb-stall or its root portion; and a ball catching assisting portion for the finger-stall arranged on a ball receiving side surface of the finger-stall or its root portion; wherein sum of heights of the ball catching assisting portion for the thumb and the ball catching assisting portion for the finger-stall is at least 6.15 mm and at most 26.6 mm.

According to a yet another aspect, the present invention provides a ball catching tool, including: a thumb-stall receiving the thumb of a user; a finger-stall receiving the index finger, middle finger, ring finger and little finger of the user; and a ball catching assisting portion arranged on a ball catching side surface of the thumb-stall or its root portion; wherein height of the ball catching assisting portion is at least 6.15 mm and at most 26.6 mm.

According to a still further aspect, the present invention provides a ball catching tool, including: a thumb-stall receiving the thumb of a user; a finger-stall receiving the index finger, middle finger, ring finger and little finger of the user; and a ball catching assisting portion arranged on a ball catching side surface of the finger-stall or its root portion; wherein height of the ball catching assisting portion is at least 6.15 mm and at most 26.6 mm.

According to a still further aspect, the present invention provides a ball catching tool, including: a surface skin formed by sewing together a ball catching surface skin and a dorsal skin; a pocket portion at a central portion of the ball receiving surface skin; a thumb-stall receiving the thumb of a user; a finger-stall receiving fingers of the user other than the thumb; an edge portion positioned on a side of an opening for the user to insert his/her hand; a first ball catching assisting portion provided on the thumb-stall or its root portion; and a second ball catching assisting portion provided on at least one of the middle-finger-stall or at its root portion and the ring-finger-stall or at its root portion; wherein the first ball catching assisting portion is larger in width in widthwise direction of the thumb-stall than in longitudinal direction of the thumb-stall, and the second ball catching assisting portion is larger in width in longitudinal direction of the middle-finger-stall or the ring-finger-stall than in widthwise direction of the middle-finger-stall or the ring-finger-stall on which the second ball catching assisting portion is provided.

According to a still further aspect, the present invention provides a ball catching tool, including: a surface skin formed by sewing together a ball catching surface skin and a dorsal skin; a pocket portion at a central portion of the ball receiving surface skin; a thumb-stall receiving the thumb of a user; a middle-finger-stall receiving the middle finger of the user; a ring-finger-stall receiving the ring finger of the user; and a little-finger-stall receiving the little finger of the user; and a ball catching assisting portion arranged on at least one of the thumb-stall or its root portion, the middle-finger-stall or its root portion, the ring-finger-stall or its root portion, and the little-finger-stall or its root portion; wherein at least one the ball catching assisting portion is larger in width in widthwise direction than in longitudinal direction of the thumb-stall, the middle-finger-stall, the ring-finger-stall or the little-finger-stall on which the ball catching assisting portion is provided.

According to a still further aspect, the present invention provides a ball catching tool, including: a surface skin formed by sewing together a ball catching surface skin and a dorsal skin; a pocket portion at a central portion of the ball receiving surface skin; a thumb-stall receiving the thumb of a user; a middle-finger-stall receiving the middle finger of the user; a ring-finger-stall receiving the ring finger of the user; a little-finger-stall receiving the little finger of the user; and a ball catching assisting portion arranged on at least one of the thumb-stall or its root portion, the middle-finger-stall or its root portion, the ring-finger-stall or its root portion, and the little-finger-stall or its root portion; wherein the ball catching assisting portion has at least one of a ridge portion extending along longitudinal direction and a ridge portion extending along widthwise direction, of the thumb-stall, the middle-finger-stall, the ring-finger-stall or the little-finger-stall on which the ball catching assisting portion is provided.

As the protruded portions of a prescribed height are formed on a surface of the surface skin, ball catching failures generally referred to as fumbles can be reduced by the present invention.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 10 is a detailed perspective view of a ball catching assisting portion for a middle finger.

FIG. 11 is a detailed perspective view of a ball catching assisting portion for a ring finger.

FIG. 12 is a detailed perspective view of a ball catching assisting portion for a little finger.

FIG. 13 is a front view of a baseball or softball catching tool in accordance with Modification 6 of the baseball or softball catching tool shown in FIG. 1.

FIG. 14 is a cross-section taken along the line XIV-XIV of FIG. 1.

FIG. 15 is a cross-sectional side view showing a first modification of the ball catching assisting portion.

FIG. 16 is a cross-sectional side view showing a second modification of the ball catching assisting portion.

FIG. 17 is a cross-sectional side view showing a third modification of the ball catching assisting portion.

FIG. 18 represents one method of manufacturing the ball catching assisting portion, showing a first step of manufacturing.

FIG. 19 represents one method of manufacturing the ball catching assisting portion, showing a second step of manufacturing.

FIG. 20 represents another method of manufacturing the ball catching assisting portion, showing a first step of manufacturing.

FIG. 21 represents another method of manufacturing the ball catching assisting portion, showing a second step of manufacturing.

FIG. 22 represents still another method of manufacturing the ball catching assisting portion, showing a first step of manufacturing.

FIG. 23 represents still another method of manufacturing the ball catching assisting portion, showing a second step of manufacturing.

FIG. 24 represents still another method of manufacturing the ball catching assisting portion, showing a third step of manufacturing.

FIG. 25 represents still another method of manufacturing the ball catching assisting portion, showing a fourth step of manufacturing.

FIG. 26 is a front view of a baseball or softball catching tool in accordance with Modification 7 of the baseball or softball catching tool shown in FIG. 1.

FIG. 27 is a front view of a baseball or softball catching tool in accordance with Modification 8 of the baseball or softball catching tool shown in FIG. 1.

FIG. 28 is a front view of a baseball or softball catching tool in accordance with Modification 9 of the baseball or softball catching tool shown in FIG. 1.

FIG. 29 is a front view of a ball catching tool in accordance with Embodiment 2.

FIG. 30 is a front view of a ball catching tool in accordance with Embodiment 3.

FIG. 31 is a front view showing a modification of the ball catching tool in accordance with Embodiment 3.

FIG. 32 is a front view of a mitt in accordance with Embodiment 4.

FIG. 33 is a front view showing Modification 1 of the mitt shown in FIG. 32.

FIG. 34 is a front view showing Modification 2 of the mitt shown in FIG. 32.

FIG. 35 is a front view showing Modification 3 of the mitt shown in FIG. 32.

FIG. 36 is a front view of a mitt in accordance with Embodiment 5.

FIG. 37 is a front view showing Modification 1 of the mitt shown in FIG. 36.

FIG. 38 is a front view showing Modification 2 of the mitt shown in FIG. 36.

FIG. 39 is a front view showing Modification 3 of the mitt shown in FIG. 36.

FIG. 40 is a plan view of the ball catching assisting portion for a thumb.

FIG. 41 is a plan view of the ball catching assisting portion for a middle finger.

FIG. 42 is a plan view of the ball catching assisting portion for a little finger.

FIG. 43 is a plan view of the ball catching assisting portion for a thumb shown in FIG. 13.

FIG. 44 is a plan view of the ball catching assisting portion for a middle finger shown in FIG. 13.

FIG. 45 is a plan view of the ball catching assisting portion for a little finger shown in FIG. 13.

FIG. 46 is a plan view of a ball catching tool including ball catching assisting portions with their top portions nearest to the pocket portion rounded, among various ball catching assisting portions.

FIG. 47 is a plan view of a ball catching assisting portion for a thumb with its top portion rounded.

FIG. 48 is a plan view of a ball catching assisting portion for a middle finger with its top portion rounded.

FIG. 49 is a plan view of a ball catching assisting portion for a little finger with its top portion rounded.

FIG. 50 is a front view of a ball catching tool including ball catching assisting portions having rectangular shape when viewed from above, with top portions arranged nearest to the pocket portion rounded.

FIG. 51 is a plan view of the ball catching assisting portion for the thumb shown in FIG. 50.

FIG. 52 is a plan view of the ball catching assisting portion for the middle finger shown in FIG. 50.

FIG. 53 is a plan view of the ball catching assisting portion for the little finger shown in FIG. 50.

FIG. 54 is a front view of a ball catching tool including ball catching assisting portions having inclined upper surfaces.

FIG. 55 is a cross-section of the ball catching assisting portion for the middle finger taken along the line LV-LV of FIG. 54.

FIG. 56 is a cross-section showing a modification of the ball catching assisting portion for the middle finger shown in FIG. 55.

FIG. 57 is a cross-section showing a further modification of the ball catching assisting portion for the middle finger.

FIG. 58 is a front view of the ball catching tool showing a modification of the ball catching tool shown in FIG. 54.

FIG. 59 is a front view of the ball catching tool showing a modification of the ball catching tool shown in FIG. 58.

FIG. 60 is a cross-section taken along the line LX-LX of FIG. 59.

FIG. 61 is a front view of a ball catching tool including ball catching assisting portions formed in approximately semi-conical shape.

FIG. 62 is a cross-section taken along the line LXII-LXII of FIG. 61.

FIG. 63 a cross-section showing a modification of the ball catching assisting portion for the middle finger shown in FIG. 61.

FIG. 64 is a front view of the ball catching tool including catching assisting portions with opposite end portions formed to bulge semi-circularly outward.

FIG. 65 is a front view showing a modification of the ball catching tool shown in FIG. 13.

FIG. 66 is a front view of the ball catching tool including catching assisting portions with opposite end portions of upper surfaces formed to bulge semi-circularly outward.

FIG. 67 is a cross-section taken along the line LXVII-LXVII of FIG. 66.

FIG. 68 is a cross-section taken along the line LXVIII-LXVIII of FIG. 66.

FIG. 69 is a cross-section showing a modification of the ball catching assisting portion for the middle finger shown in FIG. 67.

FIG. 70 is a cross section of the middle-finger-stall of the ball catching assisting portion for the middle finger shown in FIG. 69 taken along the longitudinal direction.

FIG. 71 is a cross-section showing another modification of the ball catching assisting portion for the middle finger shown in FIG. 67.

FIG. 72 is a cross-section of the middle-finger-stall shown in FIG. 71, taken along the direction from the root side to the tip end side (longitudinal direction of the middle-finger-stall).

FIG. 73 is an illustration for clearer understanding of the ridge.

FIG. 74 is an illustration for clearer understanding of the ridge.

FIG. 75 is an enlarged cross-section showing a part of the ball catching assisting portion for the thumb.

FIG. 76 is a front view showing a modification of the ball catching tool shown in FIG. 1.

DESCRIPTION OF THE PREFERRED EMBODIMENTS

Embodiment of the present invention will be described with reference to FIGS. 1 to 76.

Embodiment 1

Figure 1:
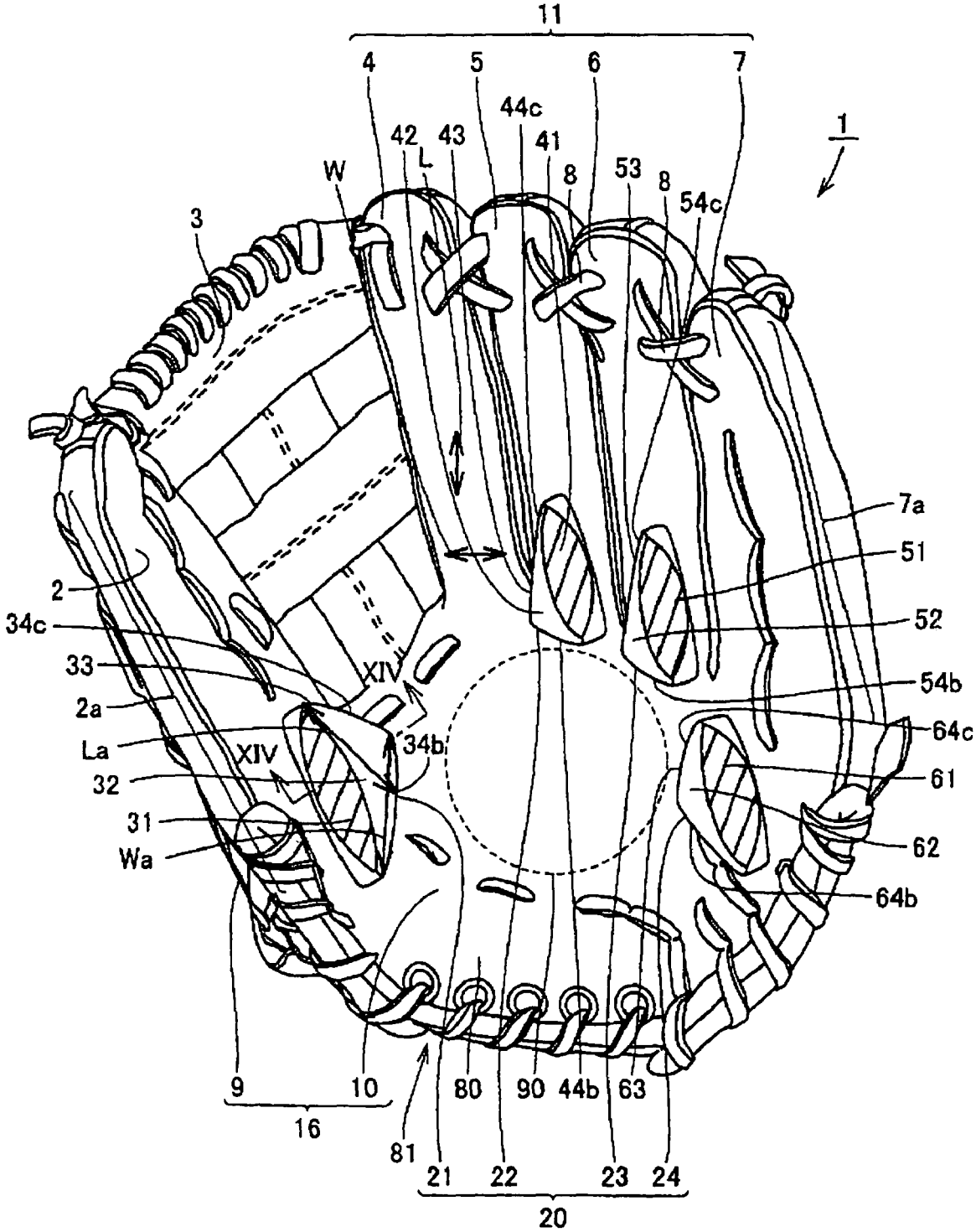
FIG. 1 is a front view of a baseball or softball catching tool in accordance with an embodiment of the present invention.

FIG. 1 is a front view of a ball catching tool 1 in accordance with Embodiment 1. As shown in FIG. 1, ball catching tool 1 includes a thumb-stall 2 receiving the thumb of a user, a web portion 3, and finger-stalls 11 receiving fingers of the user other than the thumb. The finger-stalls 11 include an index-finger-stall 4 receiving the index finger of the user, a middle-finger-stall 5 receiving the middle finger of the user, a ring-finger-stall 6 receiving the ring finger of the user, and a little-finger-stall 7 receiving the little finger of the user. At the central portion of ball catching tool 1, a pocket portion 90 and ball catching assisting portion 20 are provided, for receiving a hardball for baseball, rubber ball or softball (hereinafter simply referred to as a ball, to refer to any of the rubber ball, hardball and softball).

Generally, a hardball refers to a ball including a small core of cork, rubber or similar material, strings wound therearound and two pieces of enclosing white horse leather or cowhide sewn firmly together. A hardball generally has the weight of 5 to 5 and ¼ ounces (141.7 g to 148.8 g), and the circumferential length of 9 to 9 and ¼ inches (22.9 cm to 23.5 cm). A rubber ball generally has an outer circumferential surface formed of rubber, and includes a hollow ball or a ball filled with cork or the like. Further, the rubber ball generally includes a general-use rubber ball (diameter (unit: millimeter): 71.5~72.5, weight (unit: gram) 134.2~137.8), restitution (unit: centimeter) 85.0~105.0), a rubber ball for junior-high school students (diameter: 69.5~70.5, weight: 133.2~136.8, restitution: 80.0~100.0), a rubber ball for school children (diameter 67.5~68.5, weight 126.2~129.8, restitution 65.0~85.0), a rubber ball for school children in the lower grades (diameter: 64.0~65.0, weight: 105.0~10.0, restitution: 65.0~85.0), and a semi-hardball with a filler filled therein (diameter: 71.5~72.5, weight: 141.2~144.8, restitution 50.0~70.0). The coefficient of restitution is calculated from the distance of rebound when a ball free-fallen from the height of 15 cm to marble bounces back. A softball generally has the weight of 177.5 g~198.8 g (6.5 ounces to 7 ounces) and the circumferential length of about 30.2 cm ~30.8 cm (12 inches).

Web portion 3 is provided between thumb-stall 2 and index-finger-stall 4, and surface layer portions of thumb-stall 2, web portion 3, index-finger-stall 4, middle-finger-stall 5, ring-finger-stall 6 and little-finger-stall 7 are formed of surface skin 16. Further, ball catching tool 1 includes an opening portion 81 to which the user's hand is inserted. At an opening side of opening portion 81 of ball catching tool 1, an edge portion 80 is formed. Edge portion 80 is composed of a rim of opening portion 81, a side surface 2*a* of thumb-stall 2 and a side surface 7*a* of little-finger stall 7. A peripheral portion of thumb-stall 2 includes a tip end portion, a side surface 2*a* exposed outward, and a side surface adjacent to web portion 3. A peripheral portion of little-finger stall 7 includes the side surface 7*a* exposed outward, and a side surface adjacent to ring-finger-stall 6.

Surface skin 16 includes a dorsal skin 9 and a ball catching surface skin 10. Dorsal skin 9 is fabricated by sewing together a plurality of leather parts to form five stalls, and ball catching surface skin 10 has a rough shape of five fingers. Dorsal skin 9 and ball catching surface skin 10 are formed of a material such as natural leather, artificial leather or similar material. Peripheries of ball catching surface skin 10 and dorsal skin 9 are sewn together each with the grain side facing inward, except for the hand-inserting portion, and then, the sewn body is turned over so that the grain side comes out. This provides surface skin 16. Inside the surface skin 16, a lining is provided, which includes a backside skin and a palmar skin. The backside skin is formed by sewing together a plurality of leather parts to form five stalls, and the palmar skin is cut to have a rough shape of five fingers smaller than that of ball catching surface skin 10. Both the backside and palmar skins are formed of natural leather, artificial leather or a similar material.

Ball catching assisting portion 20 includes a ball catching assisting portion 21 for the thumb (first ball catching assisting portion) provided at a root portion of thumb-stall 2, a ball catching assisting portion 22 for the middle finger (second ball catching assisting portion) provided at a root portion of middle-finger-stall 5, a ball catching assisting portion 23 for the ring finger (second ball catching assisting portion) provided at a root portion of ring-finger-stall 6, and a ball catching assisting portion 24 (second ball catching assisting portion) provided at a root portion of little-finger-stall 7. Ball catching assisting portions 20 are all provided on a surface of the ball catching side that touches the ball, of ball catching surface skin 10.

The sum of the height of ball catching assisting portion 21 for the thumb and the height of ball catching assisting portion 22 for the middle finger is determined to be at least 6.15 mm and at most 26.6 mm; the sum of the height of ball catching assisting portion 21 for the thumb and the height of ball catching assisting portion 23 for the ring finger is also determined to be at least 6.15 mm and at most 26.6 mm; and the sum of the height of ball catching assisting portion 21 for the thumb and the height of ball catching assisting portion 24 for the little finger is also determined to be at least 6.15 mm and at most 26.6 mm. Further, ball catching assisting portion 21 for the thumb, ball catching assisting portion 22 for the middle finger, ball catching assisting portion 23 for the ring finger and ball catching assisting portion 24 for the little finger are each formed to be higher than 0 mm and lower that 26.6 mm.

Though ball catching assisting portion 21 for the thumb, ball catching assisting portion 22 for the middle finger, ball catching assisting portion 23 for the ring finger and ball catching assisting portion 24 are arranged on the surface on the ball catching side at the root portions of thumb-stall 2, middle-finger-stall 5, ring-finger-stall 6 and little-finger-stall 7, respectively, positions are not limited, and these may be provided at the surfaces on the belly portions of thumb-stall 2, middle-finger-stall 5, ring-finger-stall 6 and little-finger-stall 7. Preferably, ball catching assisting portion 22 for the middle finger, ball catching assisting portion 23 for the ring finger and ball catching assisting portion 24 for the little finger are arranged near the fingertips of the wearer, specifically, at positions up to about 20 mm from the top joint toward the tip of respective fingers. Further, preferably, ball catching assisting portion 21 for the thumb is arranged at a position near the fingertip of the wearer, specifically, at a position 5 mm to about 20 mm to the tip from the second joint.

Figure 2:
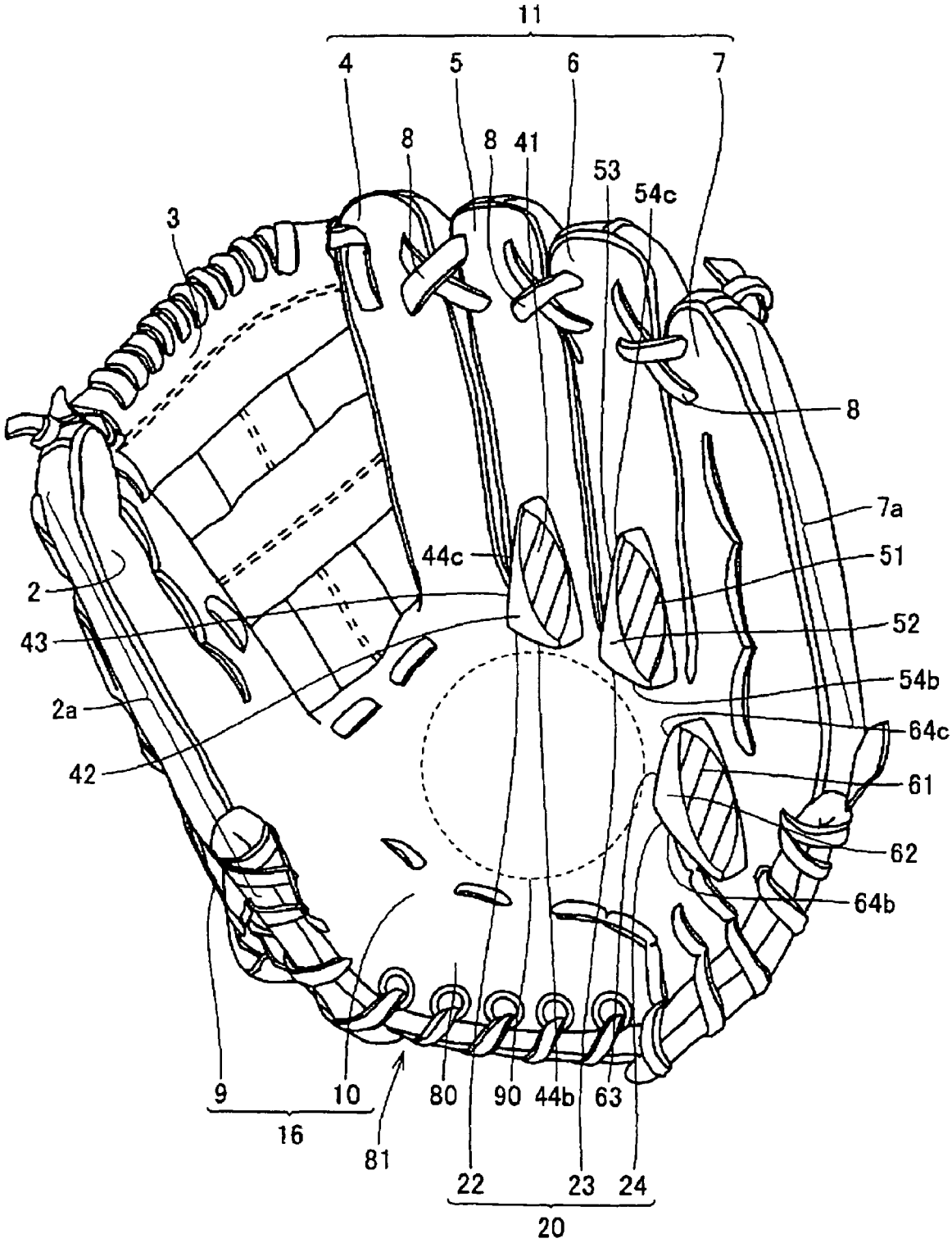
FIG. 2 is a front view of a baseball or softball catching tool in accordance with Modification 1 of the baseball or softball catching tool shown in FIG. 1.

Though ball catching assisting portion 20 includes ball catching assisting portion 21 for the thumb, ball catching assisting portion 22 for the middle finger, ball catching assisting portion 23 for the ring finger and ball catching assisting portion 24 for the little finger in the present embodiment, this is not limiting. Specifically, ball catching assisting portion 20 may include ball catching assisting portion 22 for the middle finger, ball catching assisting portion 23 for the ring finger and ball catching assisting portion 24 for the little finger, as shown in FIG. 2. When ball catching assisting portion 20 is adapted to include ball catching assisting portion 22 for the middle finger, ball catching assisting portion 23 for the ring finger and ball catching assisting portion 24 for the little finger, the height of each of ball catching assisting portion 22 for the middle finger, ball catching assisting portion 23 for the ring finger and ball catching assisting portion 24 for the little finger is set to be at least 6.15 mm and at most 26.6 mm.

Tables 1 to 8 below show signs used in the present specification and their definitions.

TABLE 1

| Sign | Definition |
|---|---|
| H | Total sum of heights of ball catching assisting portions for the thumb and for other fingers |
| Hmax | Maximum sum of height of ball catching assisting portion for the thumb and height of ball catching assisting portion for middle, ring, or little finger |
| Hmin | Minimum sum of height of ball catching assisting portion for the thumb and height of ball catching assisting portion for middle, ring, or little finger |
| Hmmax | Maximum sum of height of ball catching assisting portion for the thumb and height of ball catching assisting portion for middle finger |
| Hrmax | Maximum sum of height of ball catching assisting portion for the thumb and height of ball catching assisting portion for ring finger |
| Hlmax | Maximum sum of height of ball catching assisting portion for the thumb and height of ball catching assisting portion for little finger |
| Hmmin | Minimum sum of height of ball catching assisting portion for the thumb and height of ball catching assisting portion for middle finger |
| Hrmin | Minimum sum of height of ball catching assisting portion for the thumb and height of ball catching assisting portion for ring finger |
| Hlmin | Minimum sum of height of ball catching assisting portion for the thumb and height of ball catching assisting portion for little finger |

TABLE 2

| Sign | Definition |
|---|---|
| Hm | Necessary height of ball catching tool for middle finger calculated from closing speed difference between experienced player and beginner |
| Hr | Necessary height of ball catching assisting portion for ring finger calculated from closing speed difference between experienced player and beginner |
| Hl | Necessary height of ball catching assisting portion for little finger calculated from closing speed difference between experienced player and beginner |
| Htr | Height of ball catching assisting portion for experienced player to catch rubber ball with the same feeling as experienced player catching hardball (=D − Dtr = D − D/E) |
| Htrm | Sum of heights of ball catching assisting portions for thumb and middle finger, for experienced player to catch rubber ball by ball catching assisting portions for the thumb and middle finger with the same feeling as experienced player catching hardball (=Dm − Dm/E) |
| Htrr | Sum of heights of ball catching assisting portions for thumb and ring finger, for experienced player to catch rubber ball by ball catching assisting portions for the thumb and ring finger with the same feeling as experienced player catching hardball (=Dr − Dr/E) |
| Htrl | Sum of heights of ball catching assisting portions for thumb and little finger, for experienced player to catch rubber ball by ball catching assisting portions for the thumb and little finger with the same feeling as experienced player catching hardball (=Dl − Dl/E) |
| Htr' | Height of ball catching assisting portion for a beginner to catch rubber ball with the same feeling as experienced player catching hardball |
| Htrm' | Sum of heights of ball catching assisting portions for middle finger and thumb, for a beginner to catch rubber ball by ball catching assisting portions for middle finger and thumb with the same feeling as experienced player catching hardball |
| Htrr' | Sum of heights of ball catching assisting portions for ring finger and thumb, for a beginner to catch rubber ball by ball catching assisting portions for ring finger and thumb with the same feeling as experienced player catching hardball |
| Htrl' | Sum of heights of ball catching assisting portions for the thumb and little finger, for a beginner to catch rubber ball by ball catching assisting portions for the thumb and little finger with the same feeling as experienced player catching hardball |
| Hltr' | Height of ball catching assisting portion for a beginner of baseball to catch hardball with the same feeling as experienced baseball player catching hardball |

TABLE 3

| Sign | Definition |
|---|---|
| D | Distance of finger movement necessary for actually catching a ball |
| Dm | Distance of finger movement necessary for catching a ball by pinching the ball between thumb and middle finger (Distance middle) |
| Dr | Distance of finger movement necessary for catching a ball by pinching the ball between thumb and ring finger (Distance ring) |
| Dl | Distance of finger movement necessary for catching a ball by pinching the ball between thumb and little finger (Distance little) |
| Dtr | Distance of finger movement when experienced baseball player moves fingers in time period Tr (=D/E) |
| d | Distance of ball movement from ball catching surface skin when ball is caught by ball catching tool |
| dmin | Distance of ball movement from ball catching surface skin when ball is caught at a position where the ball can be shifted smooth (30 mm) |
| dmax | Distance of ball movement from ball catching surface skin when ball is caught at the tip of ball catching tool (120 mm) |
| Dltr | Distance of finger movement of a beginner in time period T2s in which experienced player catches hardball |

TABLE 4

| Sign | Definition |
|---|---|
| T | Time for closing ball catching tool |
| Temax | Time for closing ball catching tool when a beginner catches a ball at the tip (dmax) of ball catching tool, i.e., longest time of ball catching when a beginner catches a hardball of 40 km/h |
| Temin | Time for closing ball catching tool when a beginner catches a ball near the root (dmin) of ball catching tool, i.e., shortest time of ball catching when a beginner catches a hardball of 40 km/h |

TABLE 4-continued

| Sign | Definition |
|---|---|
| Tsmax | Time for closing ball catching tool when an experienced player catches a ball at the tip (dmax) of ball catching tool, i.e., longest time of ball catching when an experienced player catches a hardball of 40 km/h |
| Tsmin | Time for closing ball catching tool when an experienced player catches a ball near the root (dmin) of ball catching tool, i.e., shortest time of ball catching when an experienced player catches a hardball of 40 km/h |
| Tmin | Minimum value among (actually measured) ball catching time periods when a hardball of 40 km/h was caught |
| Tmax | Maximum value among (actually measured) ball catching time periods when a hardball of 40 km/h was caught |
| Tave | Average value among (actually measured) ball catching time periods when a hardball of 40 km/h was caught |

TABLE 5

| Sign | Definition |
|---|---|
| t1 | Time when player begins to apply force. |
| t2 | Time when a ball touches ball catching tool |
| t3 | Time when maximum force is attained during ball catching |
| T1 | Time for entire ball catching action from when the player begins to apply force until ball is fully caught (=time of ball catching) |
| T2 | Time from when hardball touches ball catching tool until ball is fully caught. |

TABLE 5-continued

| Sign | Definition |
|---|---|
| T1s | Time for entire ball catching action from when experienced player begins to apply force until ball is fully caught. |
| T2s | Time from when hardball touches ball catching tool until ball is fully caught by experienced player. |
| T1e | Time for entire ball catching action from when a beginner begins to apply force until ball is fully caught. |
| T2e | Time from when hardball touches ball catching tool until ball is fully caught by a beginner. |
| Tr | Time of ball catching, for catching a rubber ball (=Th/E) |
| Th | Time of ball catching, for catching a hardball |

TABLE 6

| Sign | Definition |
|---|---|
| Vb | Velocity of hardball bouncing back from ball catching tool (Velocity of Ball) (calculated for a beginner catching the ball at the tip of ball catching tool) = dmax/Temax |
| Vf | Velocity of moving a finger at the time of ball catching (Velocity of finger) |
| Vfs | Velocity of moving a finger at the time of ball catching by experienced player |
| Vfe | Velocity of moving a finger at the time of ball catching by beginner |
| Vr | Velocity of rubber ball bouncing back from ball catching tool (=Vh × E) |
| Vh | Velocity of hardball bouncing back from ball catching tool |
| Vn | Velocity of ball entrance at restitution test |

TABLE 7

| Sign | Definition |
|---|---|
| Xs | Distance of finger movement when experienced baseball player catches a ball (X serious). |
| α | Distance of finger movement when a beginner of baseball catches a ball |

TABLE 8

| Sign | Definition |
|---|---|
| Er | Restitution coefficient of rubber ball |
| Eh | Restitution coefficient of hardball |
| E | Ratio of restitution coefficients of rubber ball and hardball (=Er/Eh > 1.00) |

Figure 3:
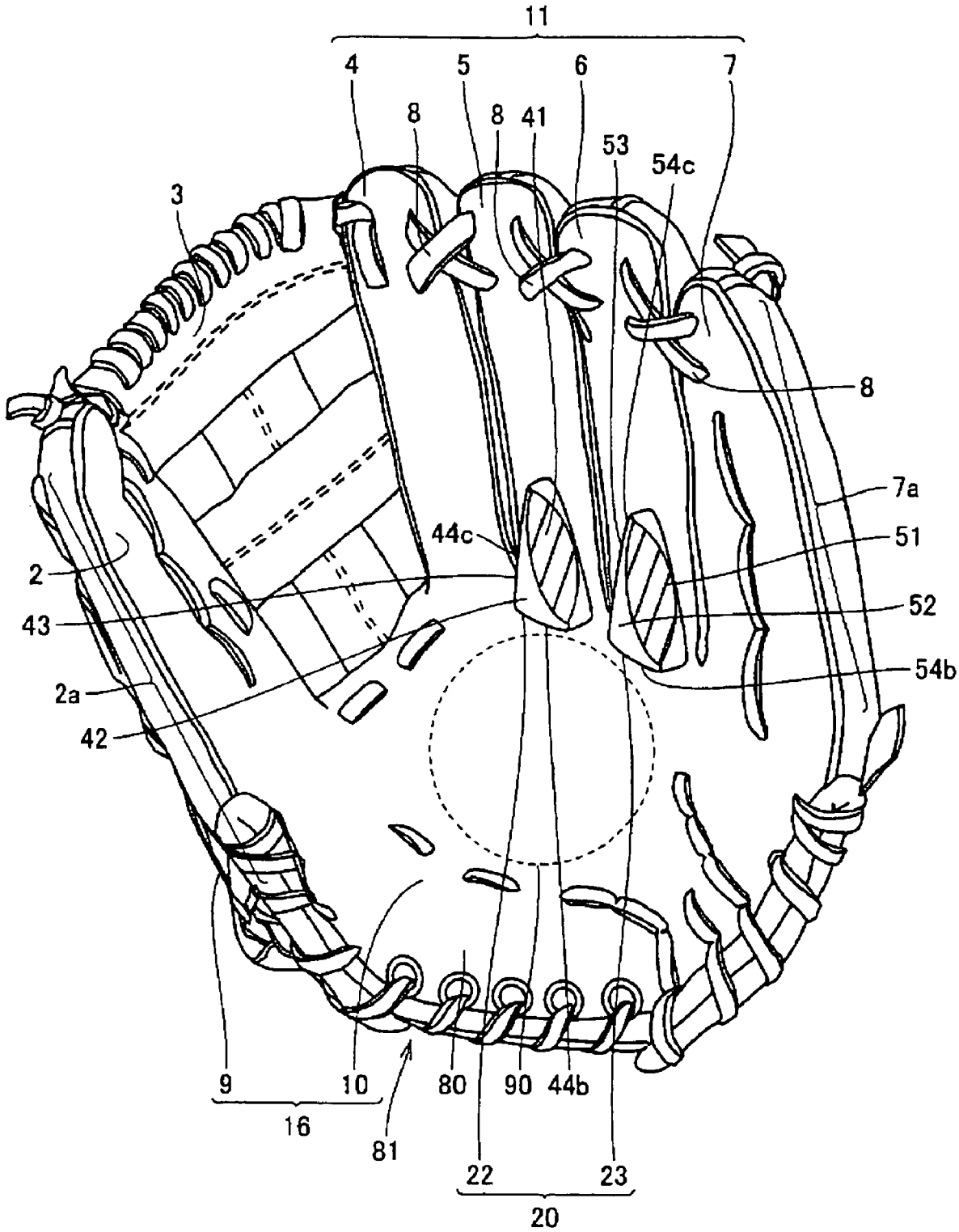
FIG. 3 is a front view of a baseball or softball catching tool in accordance with Modification 2 of the baseball or softball catching tool shown in FIG. 1.
Figure 4:
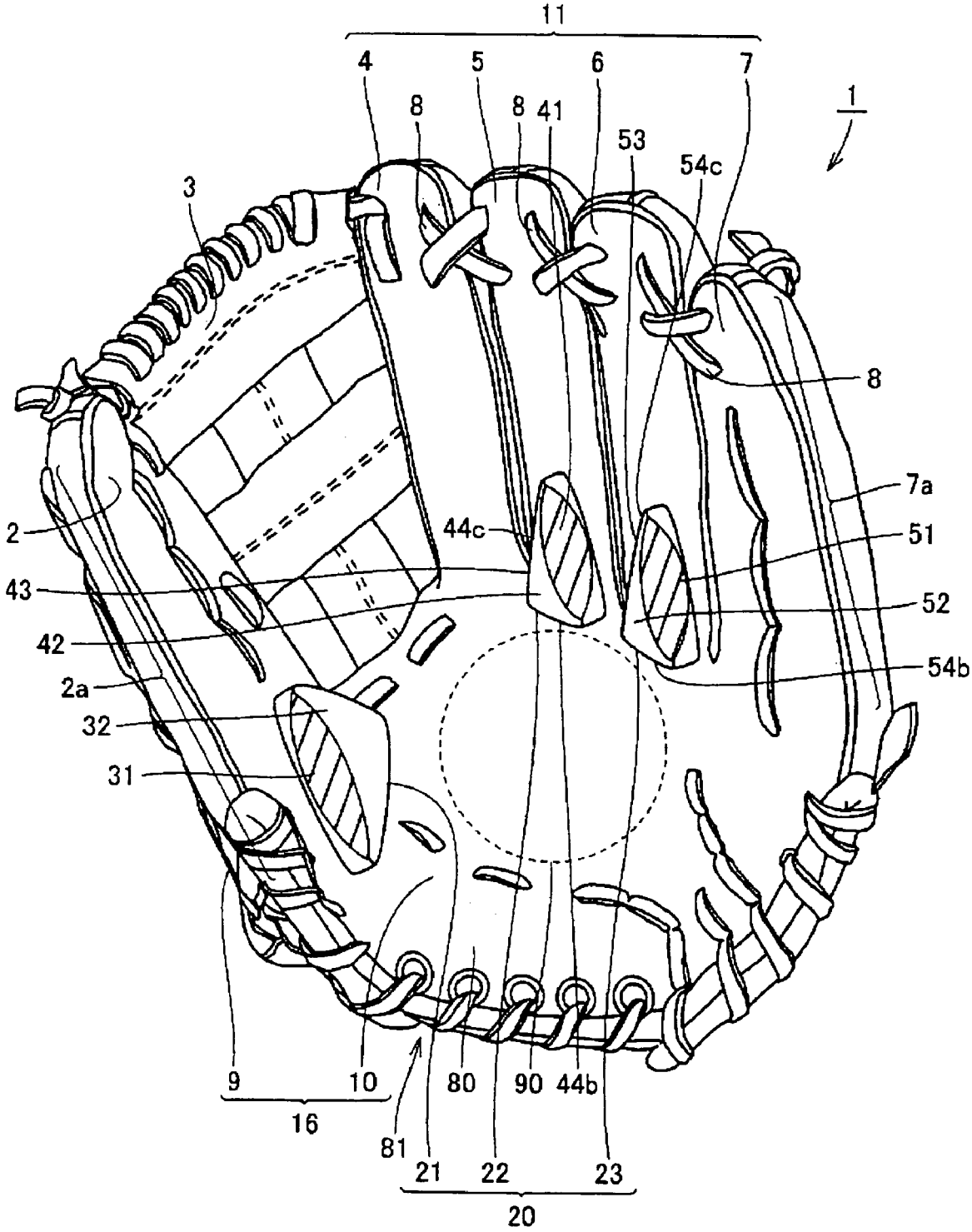
FIG. 4 is a front view of a baseball or softball catching tool in accordance with Modification 3 of the baseball or softball catching tool shown in FIG. 1.
Figure 5:
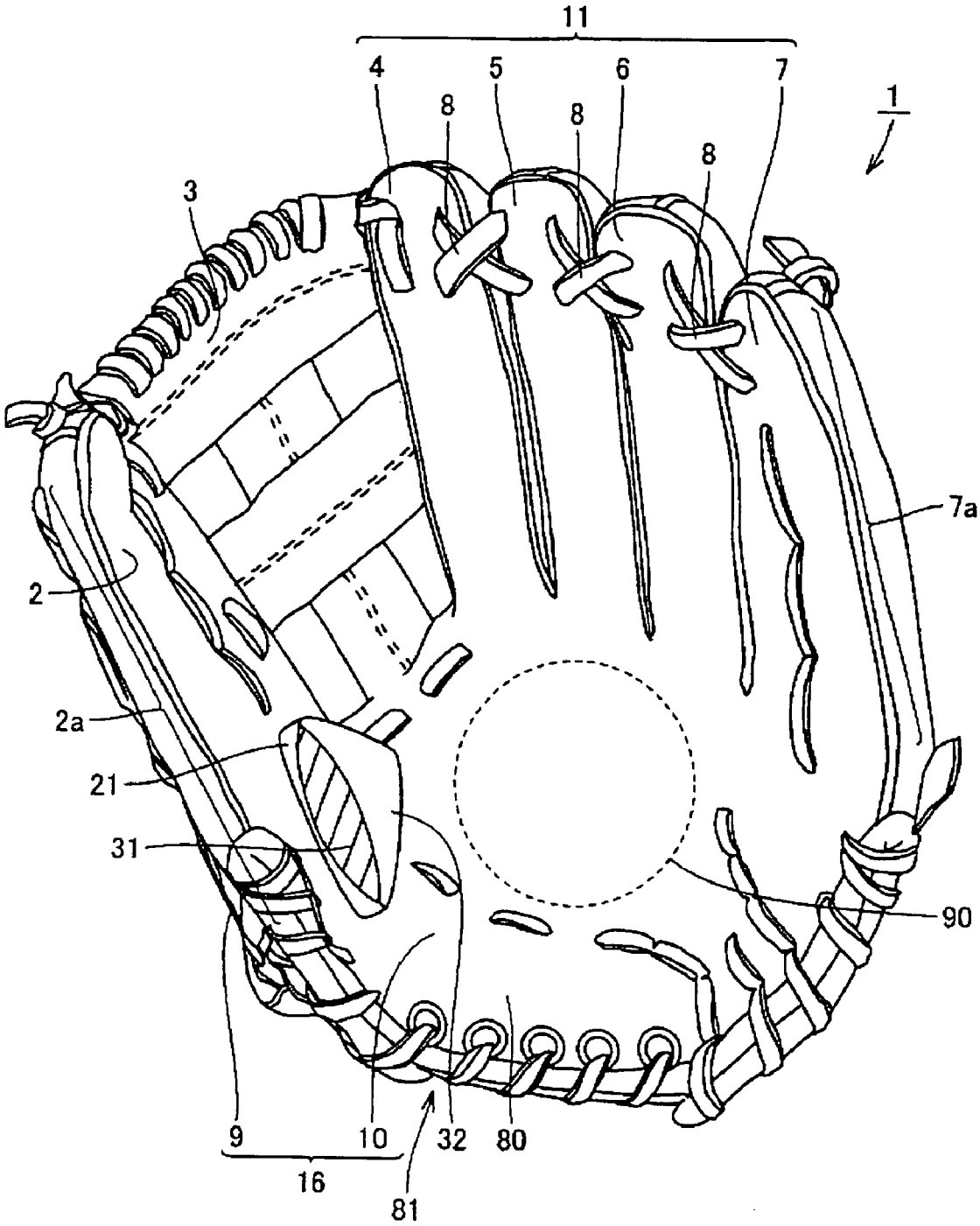
FIG. 5 is a front view of a baseball or softball catching tool in accordance with Modification 4 of the baseball or softball catching tool shown in FIG. 1.
Figure 6:
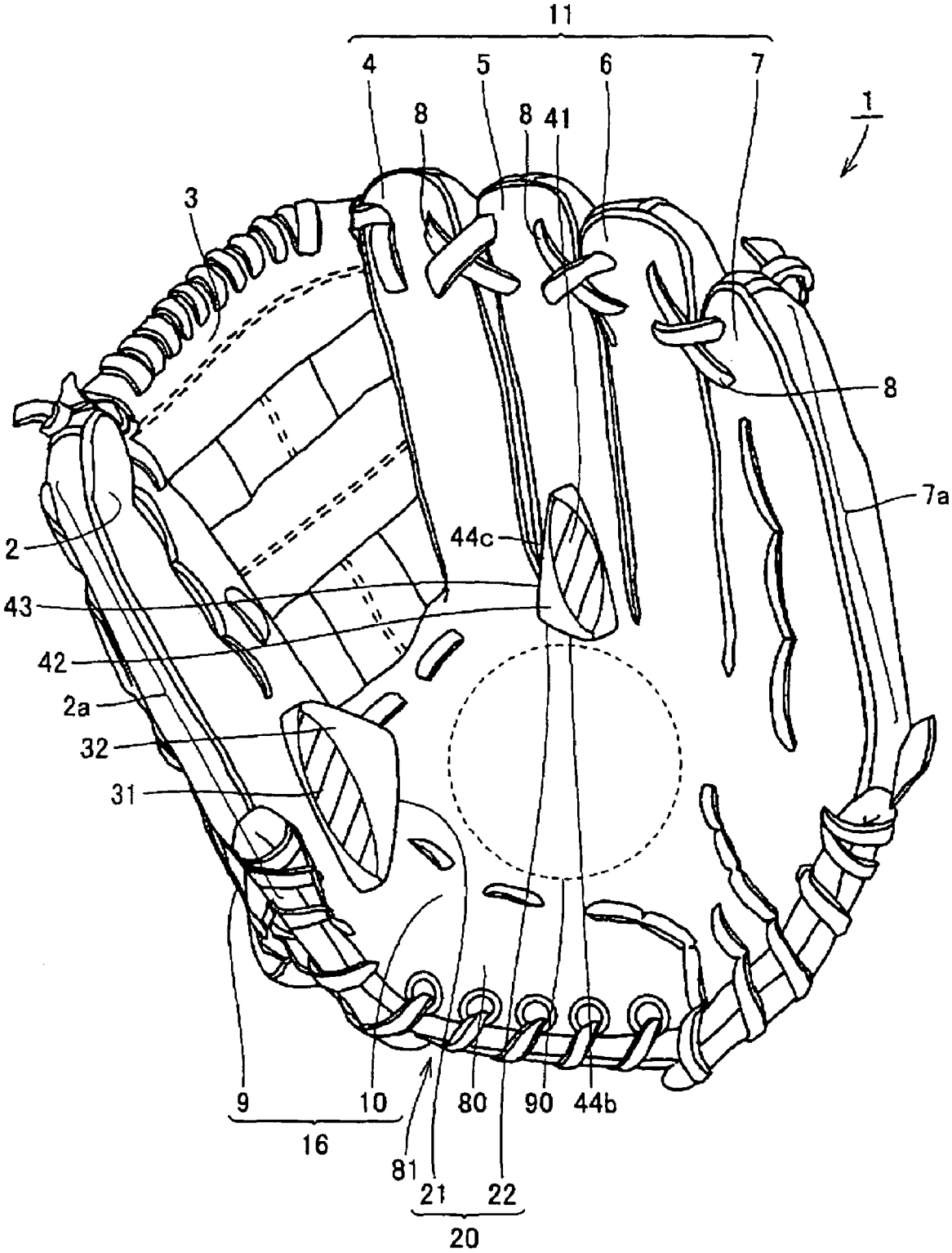
FIG. 6 is a front view of a baseball or softball catching tool in accordance with Modification 5 of the baseball or softball catching tool shown in FIG. 1.

Further, as shown in FIG. 3, ball catching assisting portion 20 may be adapted to include ball catching assisting portions 22 and 23 for the middle finger and the ring finger. When the ball catching assisting portion 20 is adapted to include ball catching assisting portions 22 and 23 for the middle finger and the ring finger, the height of each of the ball catching assisting portions 22 and 23 for the middle finger and the ring finger is set to be at least 6.15 mm and at most 26.6 mm. Alternatively, as shown in FIG. 4, ball catching assisting portion 20 may be adapted to include ball catching assisting portions 21, 22 and 23 for the thumb, the middle finger and the ring finger. When ball catching assisting portion 20 is adapted to include ball catching assisting portions 21, 22 and 23 for the thumb, the middle finger and the ring finger, the sum of heights of ball catching assisting portions 21 and 22 for the thumb and the middle finger is set to be at least 6.15 mm and at most 26.6 mm, and the sum of heights of ball catching assisting portions 21 and 23 for the thumb and the ring finger is set to be at least 6.15 mm and at most 26.6 mm. Alternatively, as shown in FIG. 5, ball catching assisting portion 20 may be adapted to include ball catching assisting portion 21 for the thumb only. When ball catching assisting portion 20 is adapted to include ball catching assisting portion 21 for the thumb only, the height of ball catching assisting portion 21 for the thumb is set to be at least 6.15 mm and at most 26.6 mm. Further, as shown in FIG. 6, ball catching assisting portion 20 may be adapted to include ball catching assisting portions 21 and 22 for the thumb and the middle finger. When ball catching assisting portion 20 is adapted to include ball catching assisting portions 21 and 22 for the thumb and the middle finger, the sum of heights of ball catching assisting portions 21 and 22 for the thumb and the middle finger is set to be at least 6.15 mm and at most 26.6 mm.

Referring to FIG. 1, the maximum value Hmmax of the sum of height of ball catching assisting portion 21 for the thumb and height of ball catching assisting portion 22 for the middle finger is set to be 26. 6 mm. Further, the maximum value Hrmax of the sum of height of ball catching assisting portion 21 for the thumb and height of ball catching assisting 23 portion for the ring finger is also set to be 26.6 mm, and the maximum value Hmax of the sum of height of ball catching assisting portion 21 for the thumb and height of ball catching assisting portion 24 for the little finger is also set to at most 26.6 mm. These maximum values Hmax are calculated from the distance of movement of each of the fingers at the time of ball catching, and the maximum value Hmax is obtained using Table 9 below. Table 9 below specifies distance of movement of each of the fingers (in the unit of mm), when catching a ball by a general ball catching tool, in different patterns, that is, by closing the thumb and the middle finger, closing the thumb and the ring finger, and by closing the thumb and the little finger.

TABLE 9

| | Distance of finger movement |
|---|---|
| Thumb - middle finger (Dm) | 20.5 (mm) |
| Thumb - ring finger (Dr) | 26.6 (mm) |
| Thumb - little finger (Dl) | 19.7 (mm) |

Figure 9:
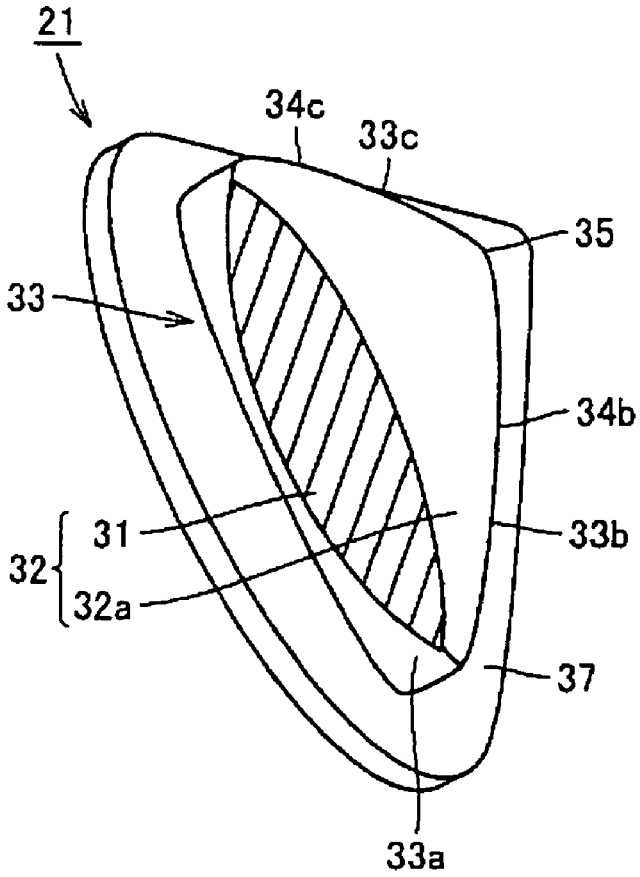
FIG. 9 is a perspective view showing, in detail, a ball catching assisting portion for a thumb.
Figure 1:
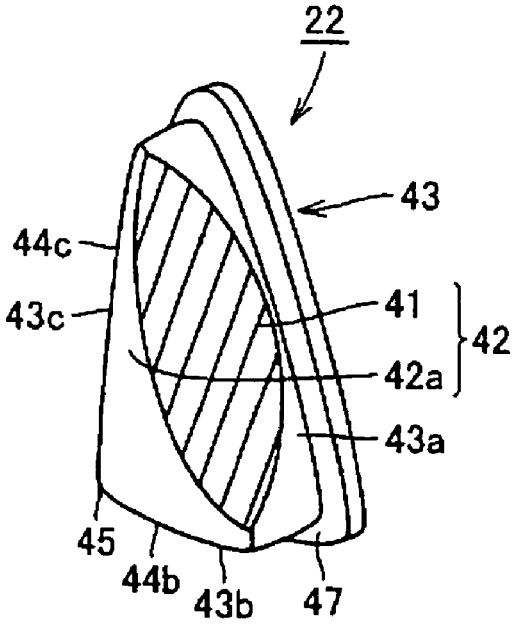
Figure 1:
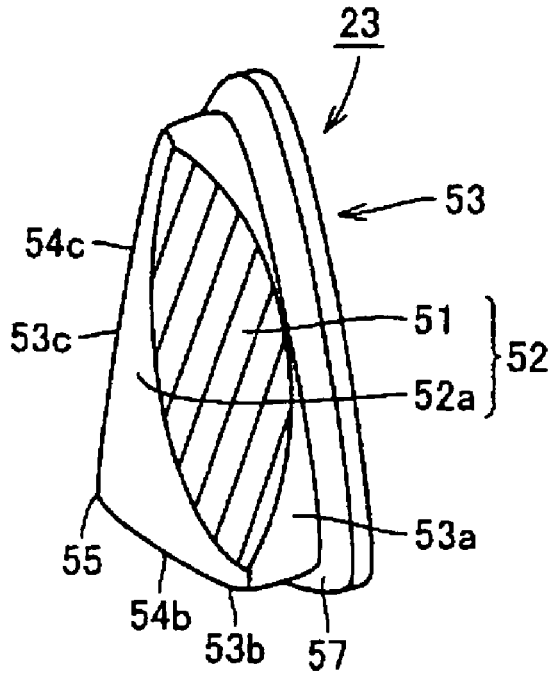
Figure 1:
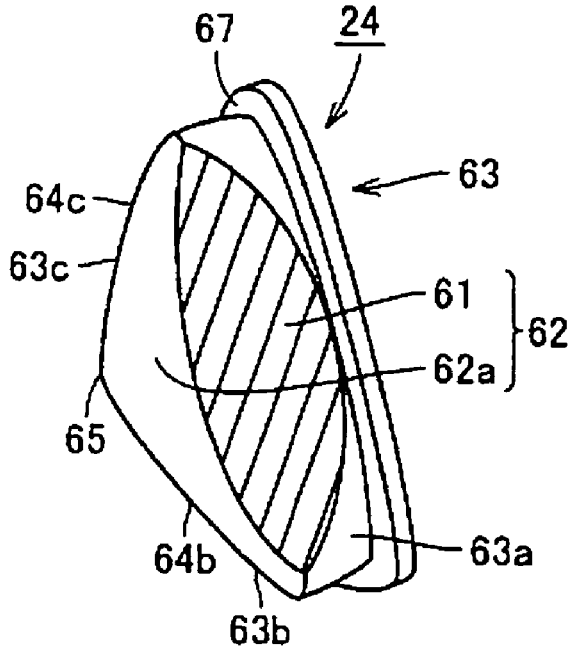
Figure 1:
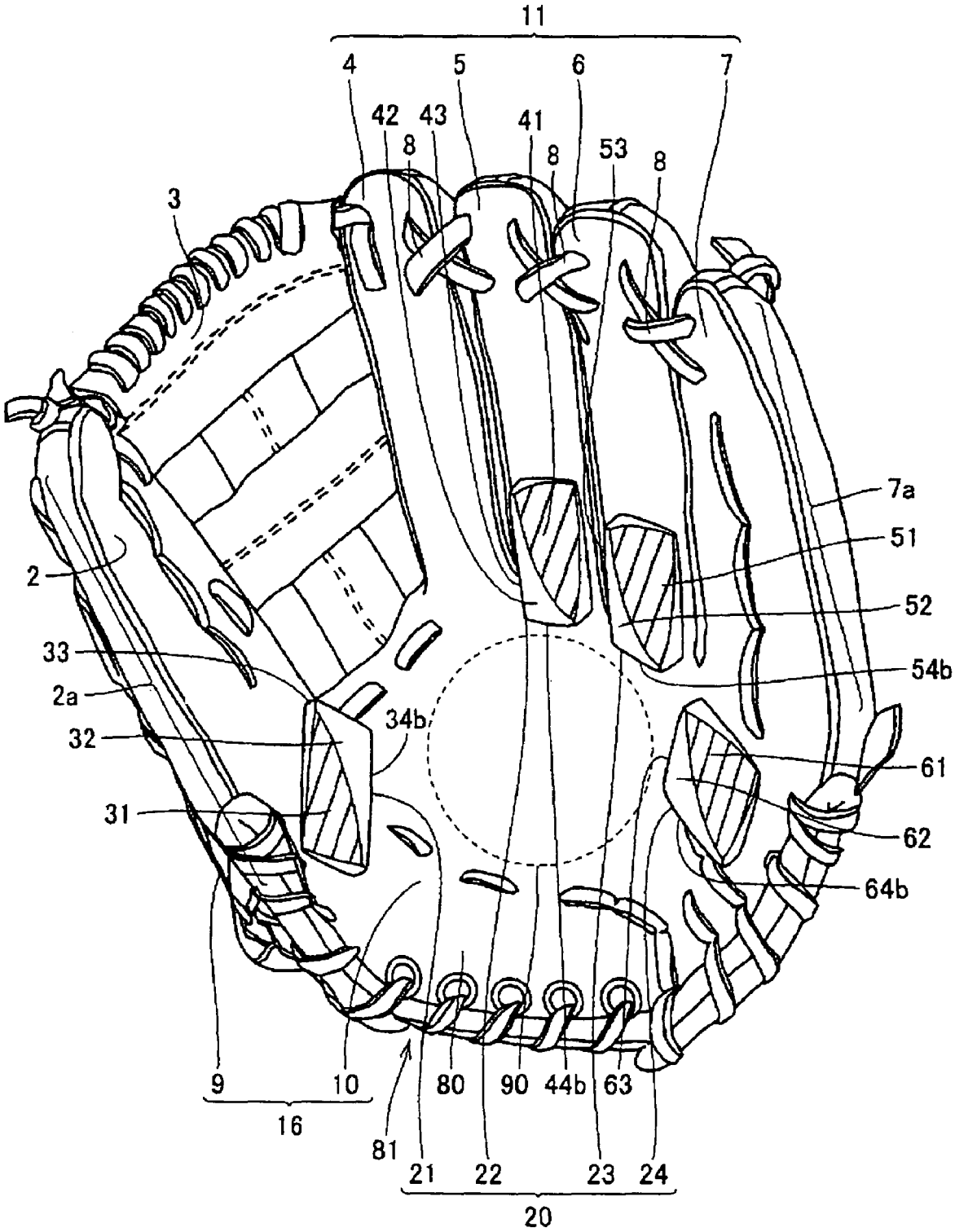
Figure 1:
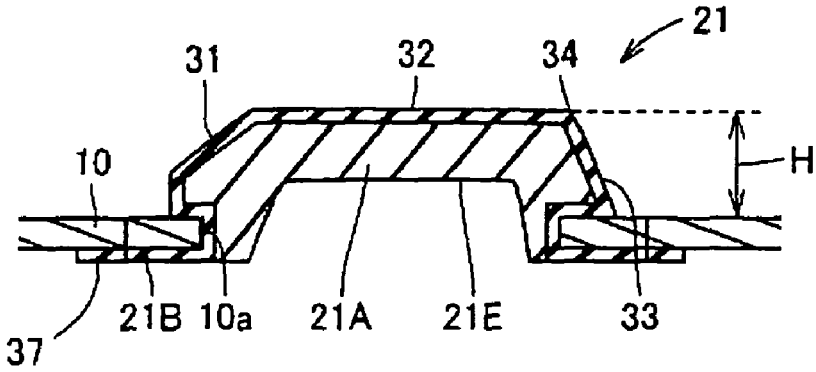
Figure 1:
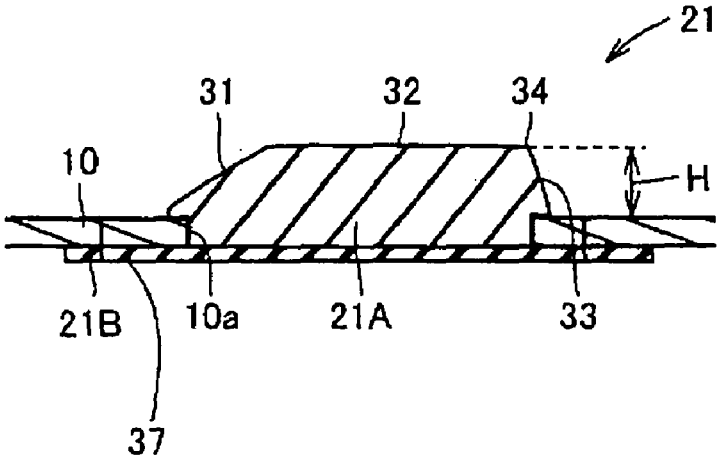
Figure 1:
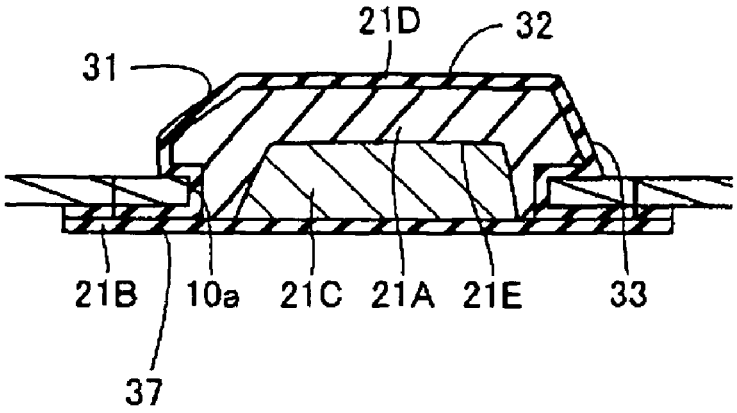
Figure 1:
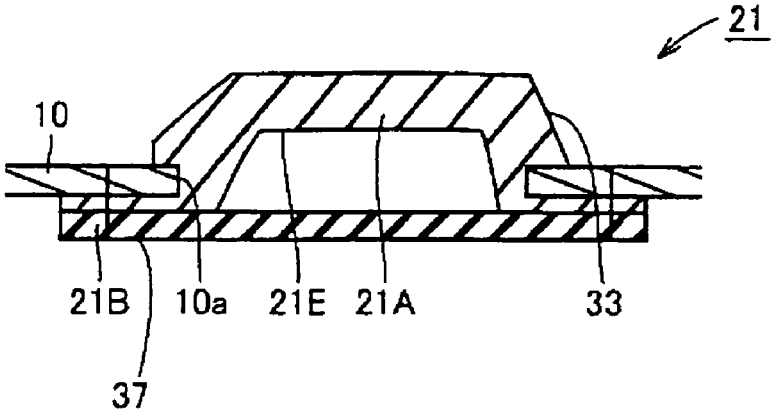
Figure 1:
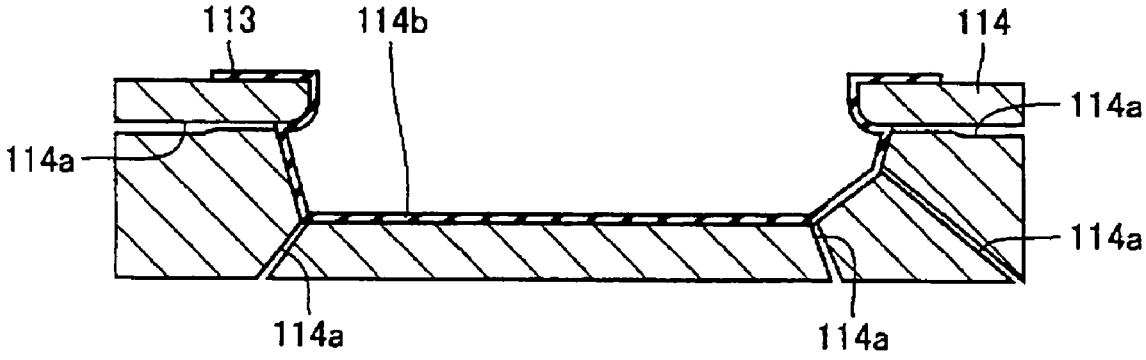
Figure 1:
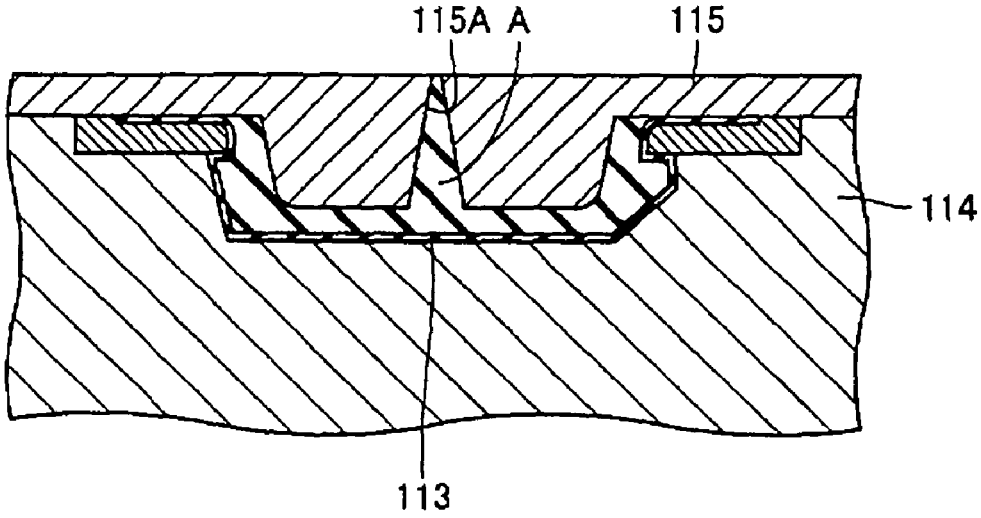
Figure 2:
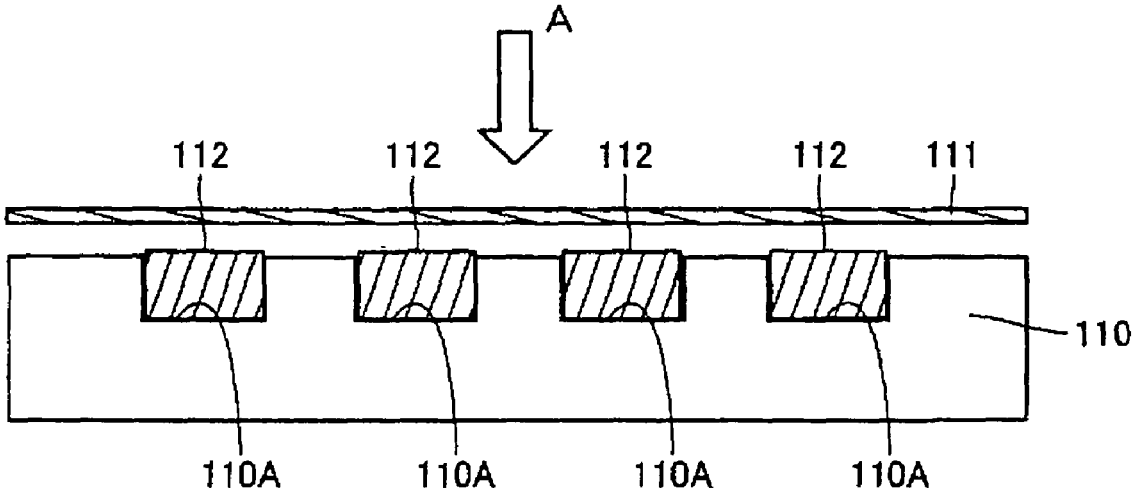
Figure 2:
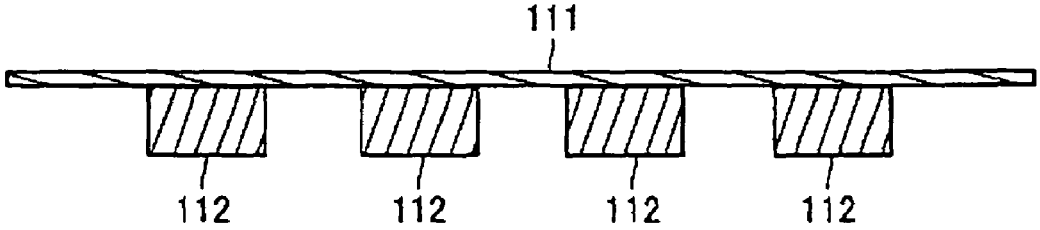
Figure 2:
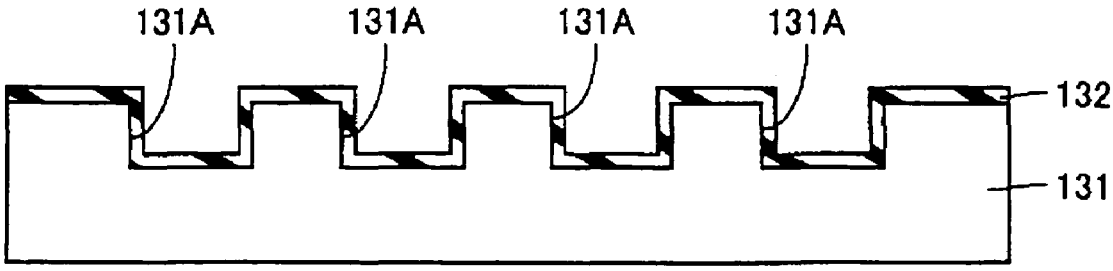
Figure 2:
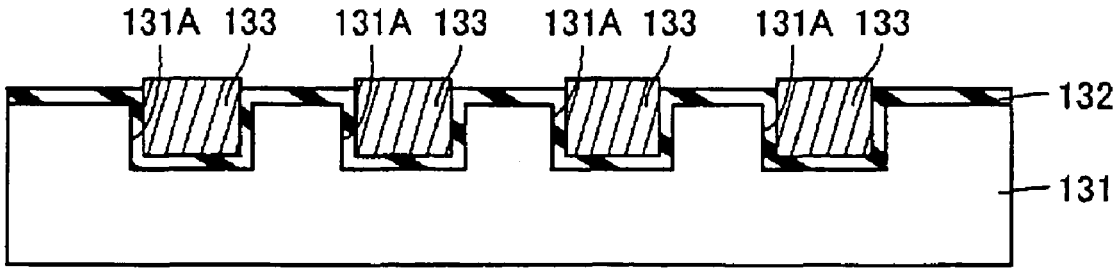
Figure 2:
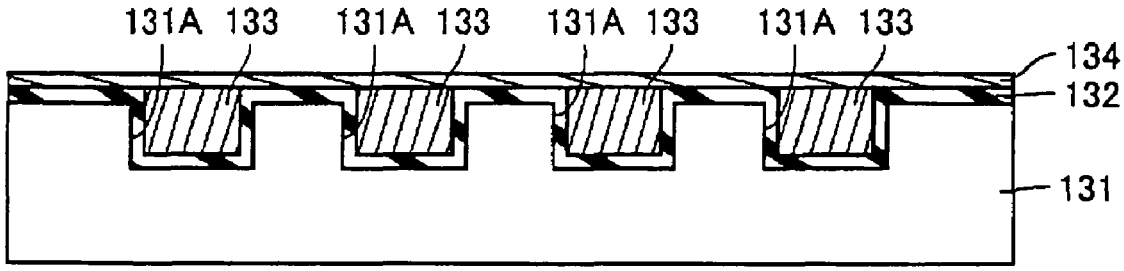
Figure 2:
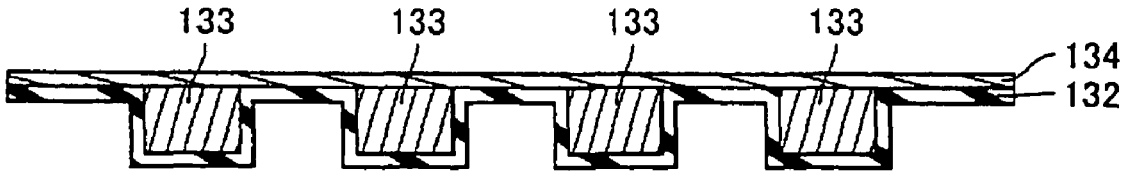
Figure 2:
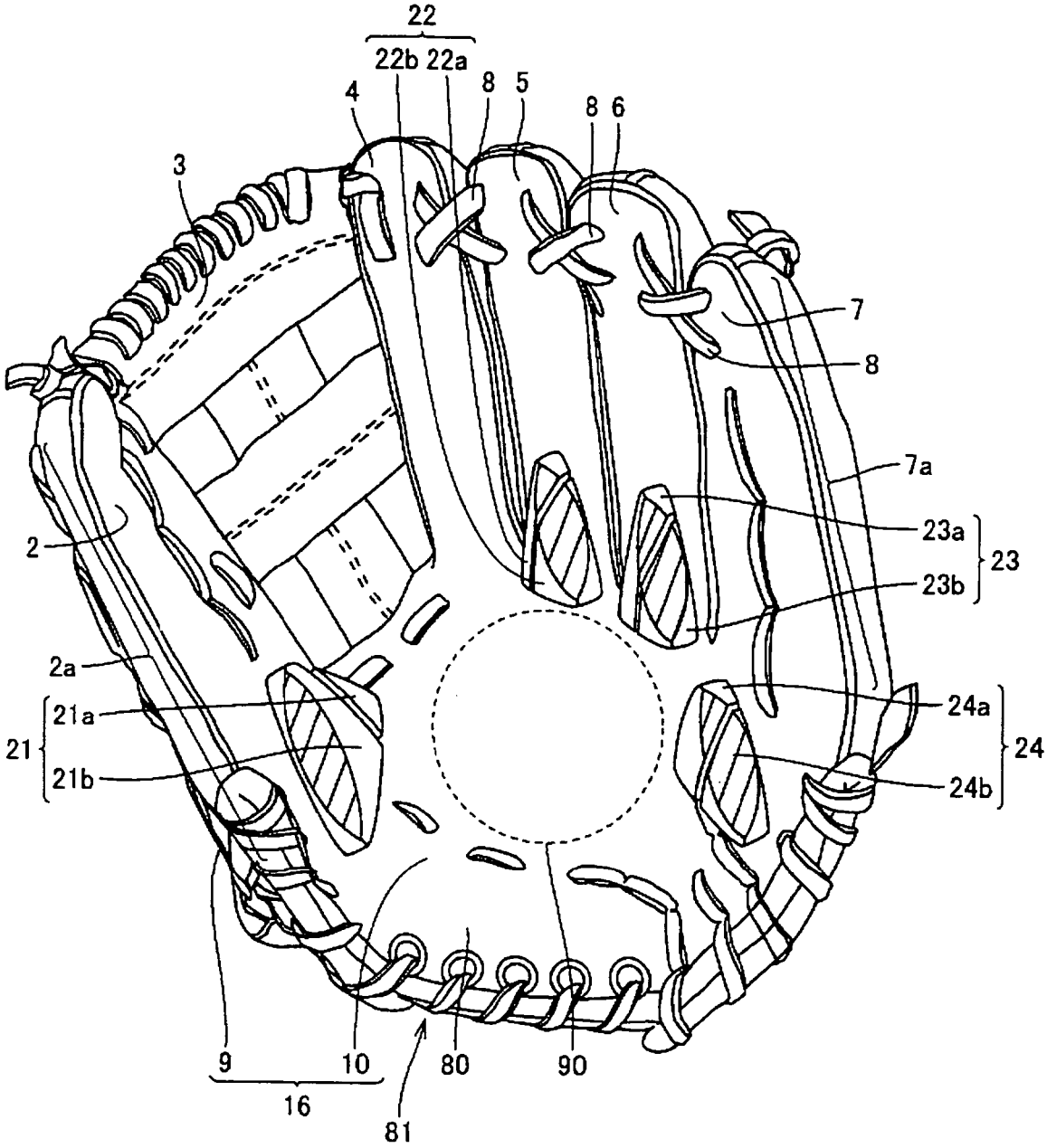
Figure 2:
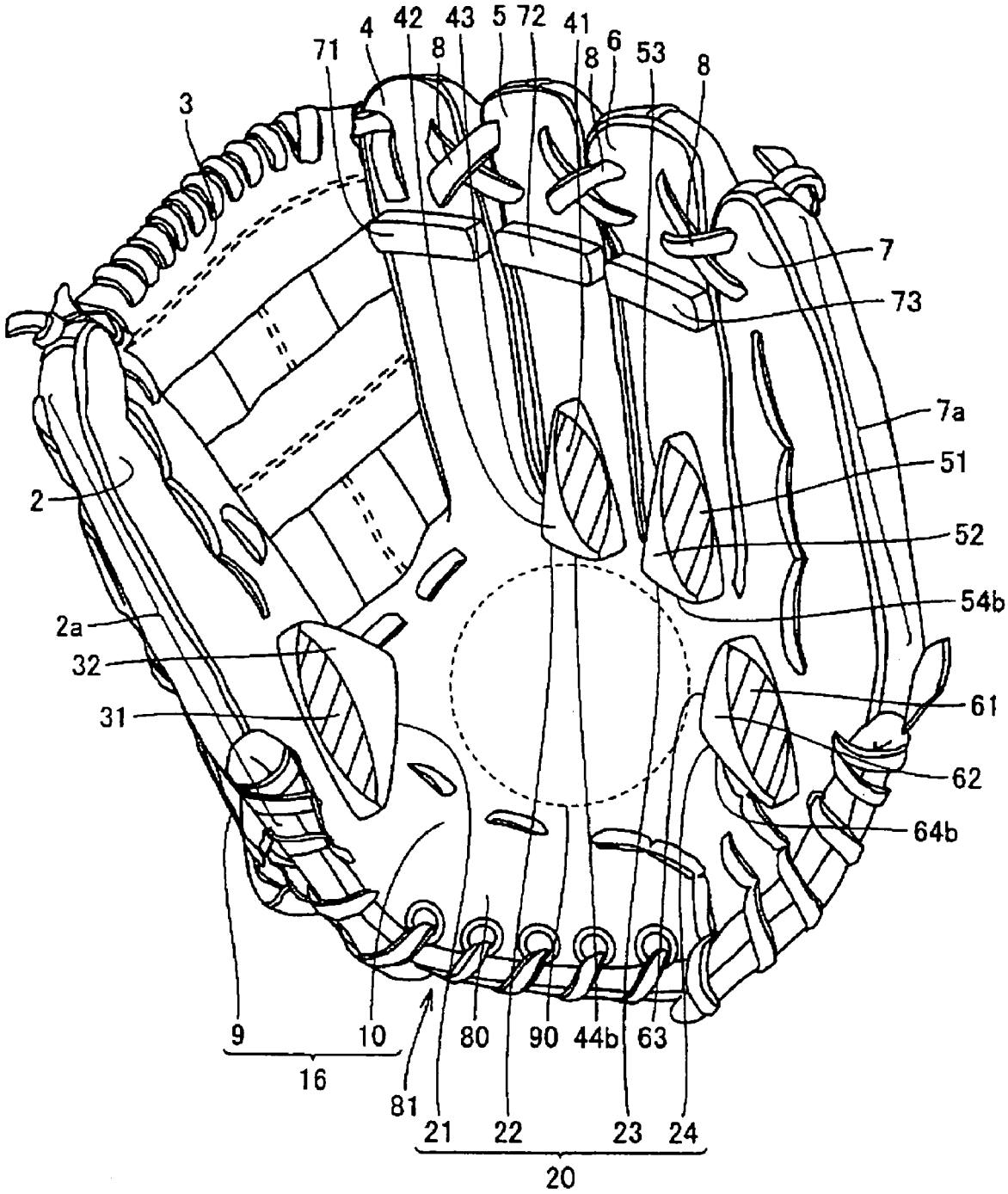
Figure 2:
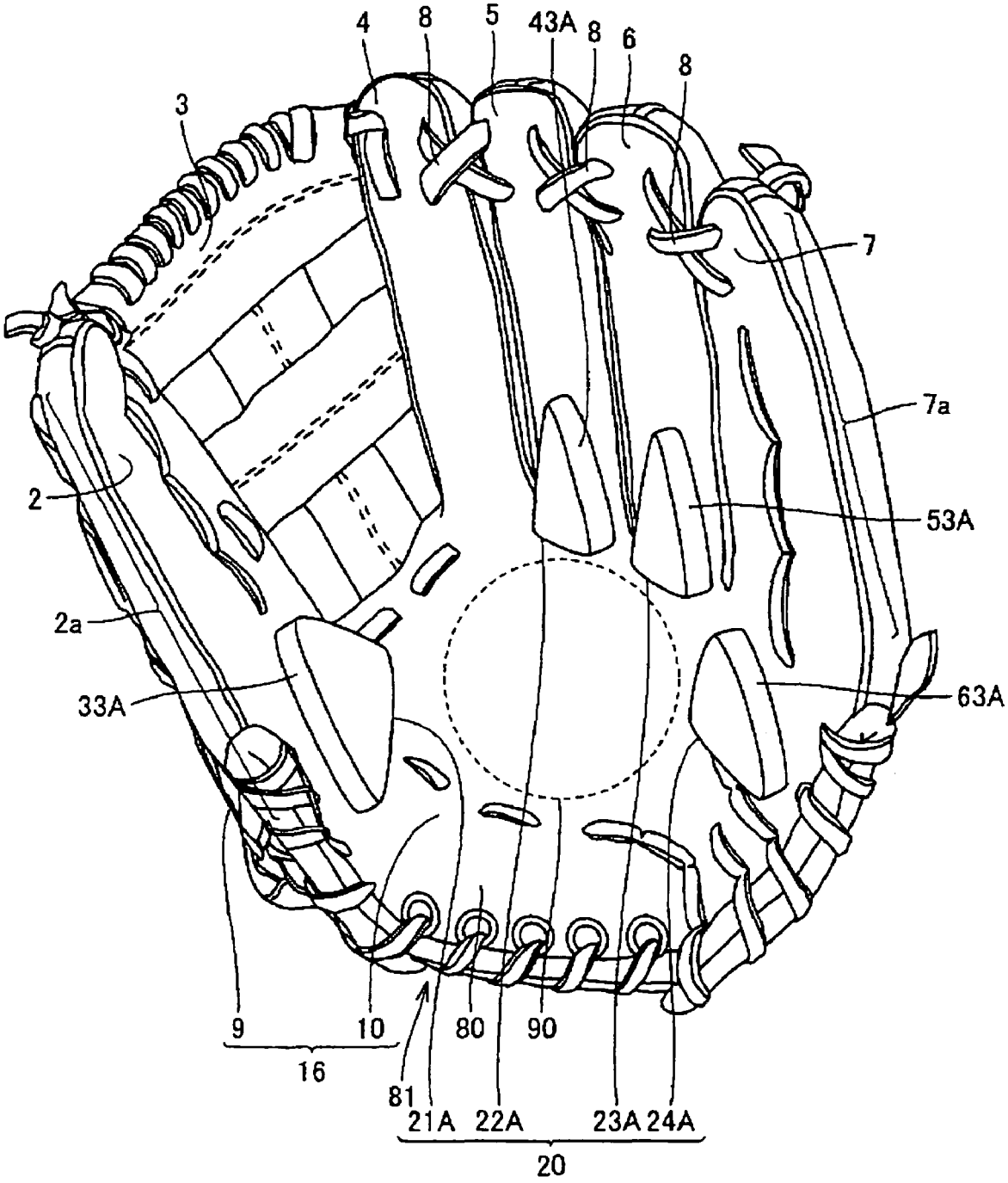
Figure 2:
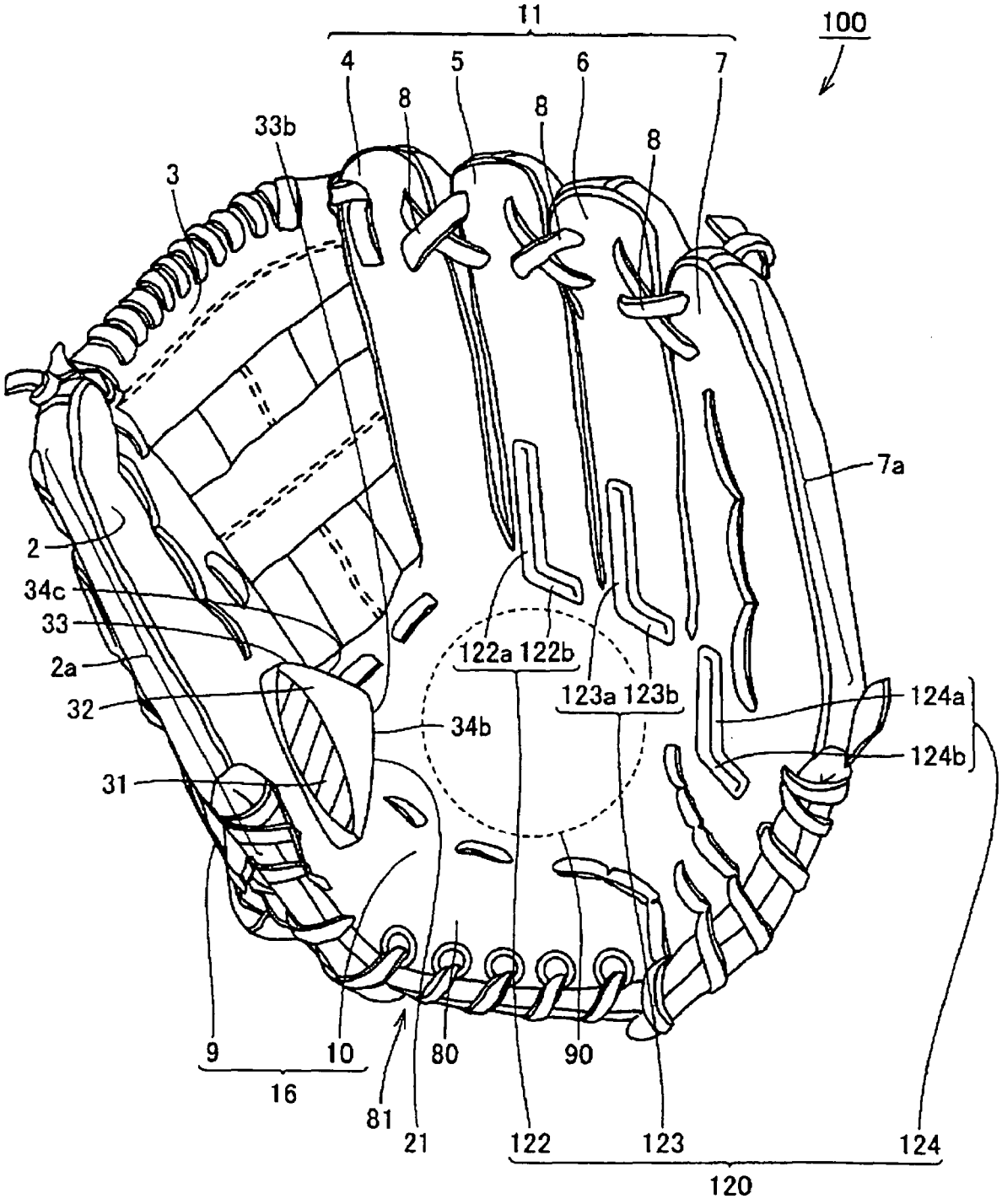
Figure 3:
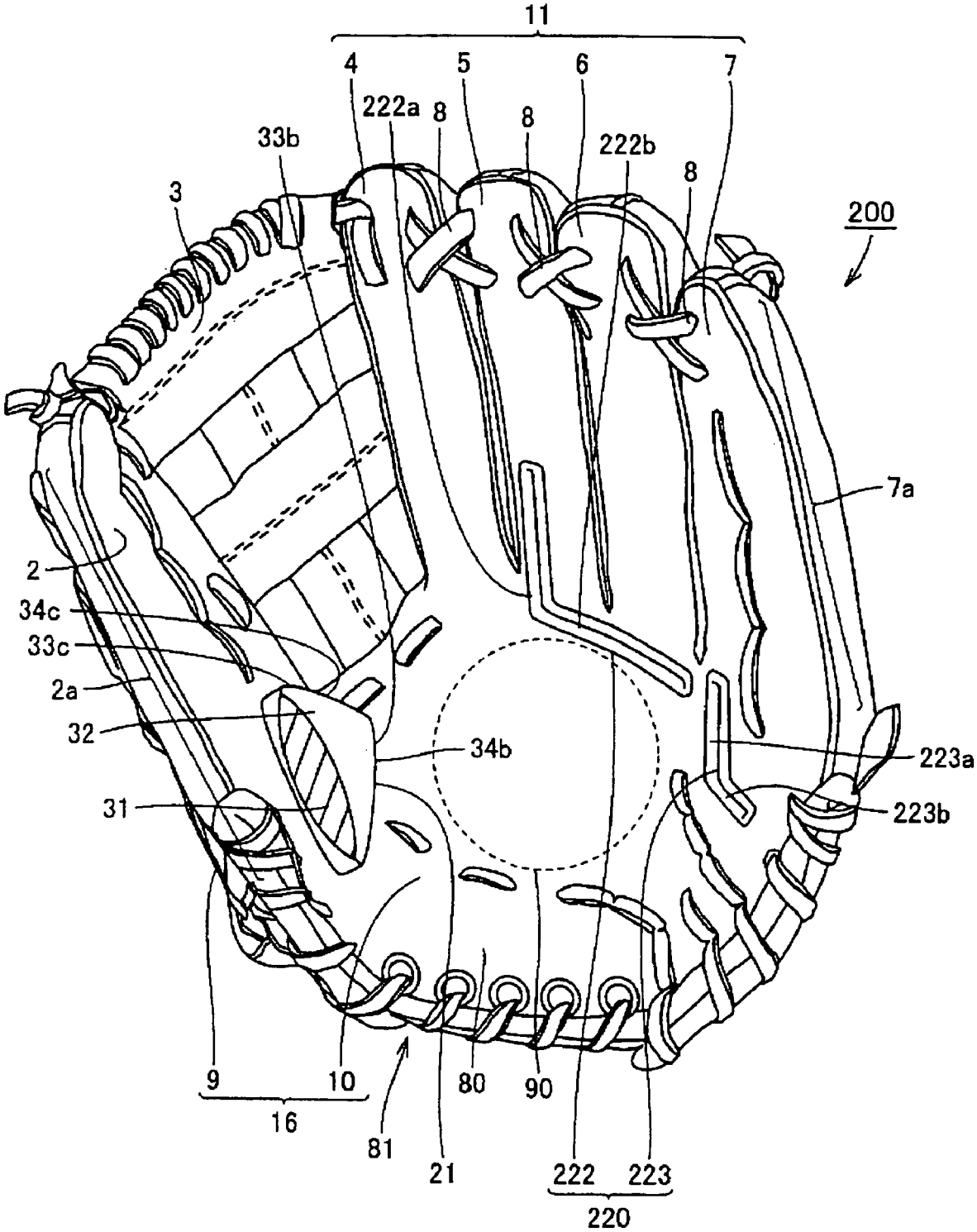
Figure 3:
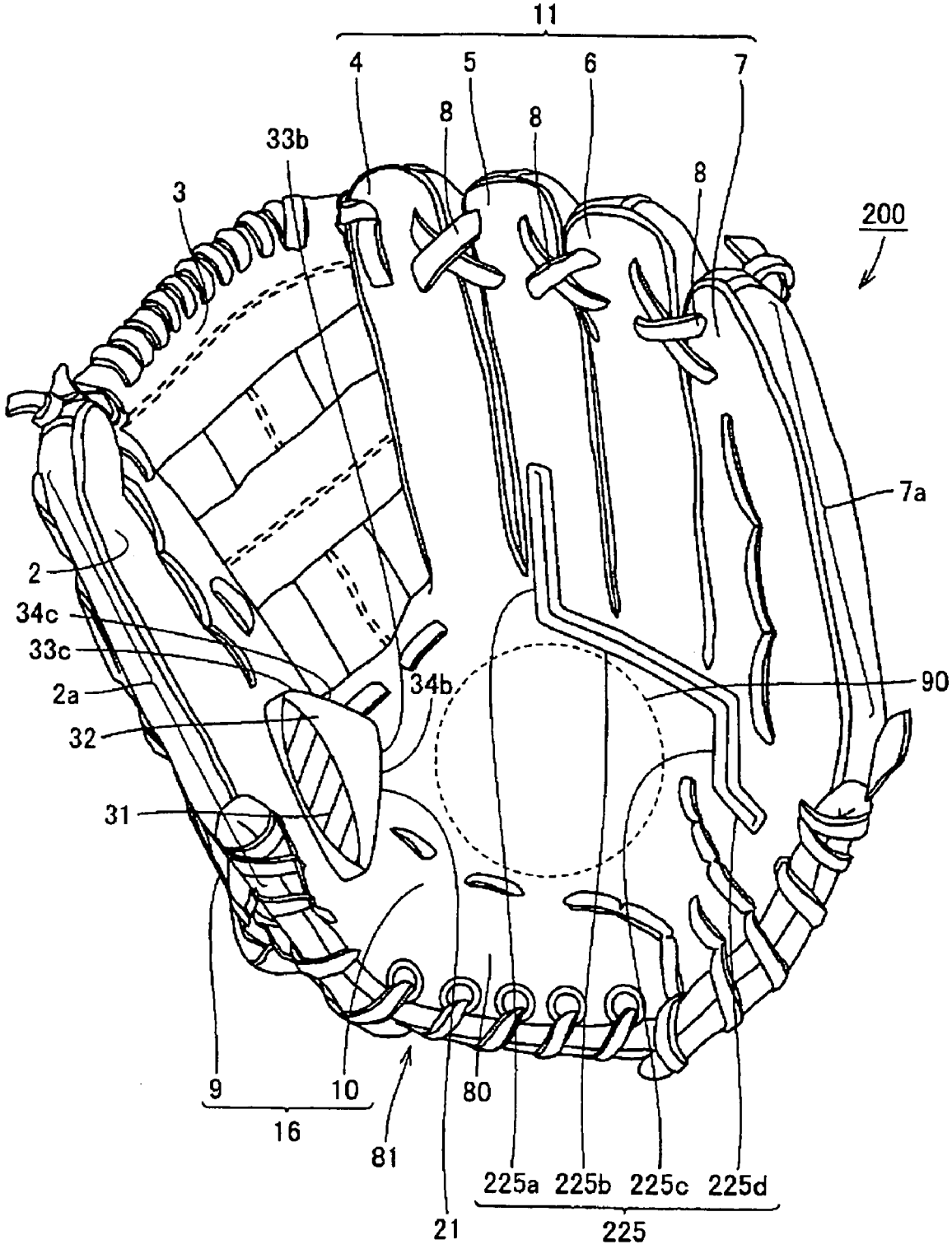
Figure 3:
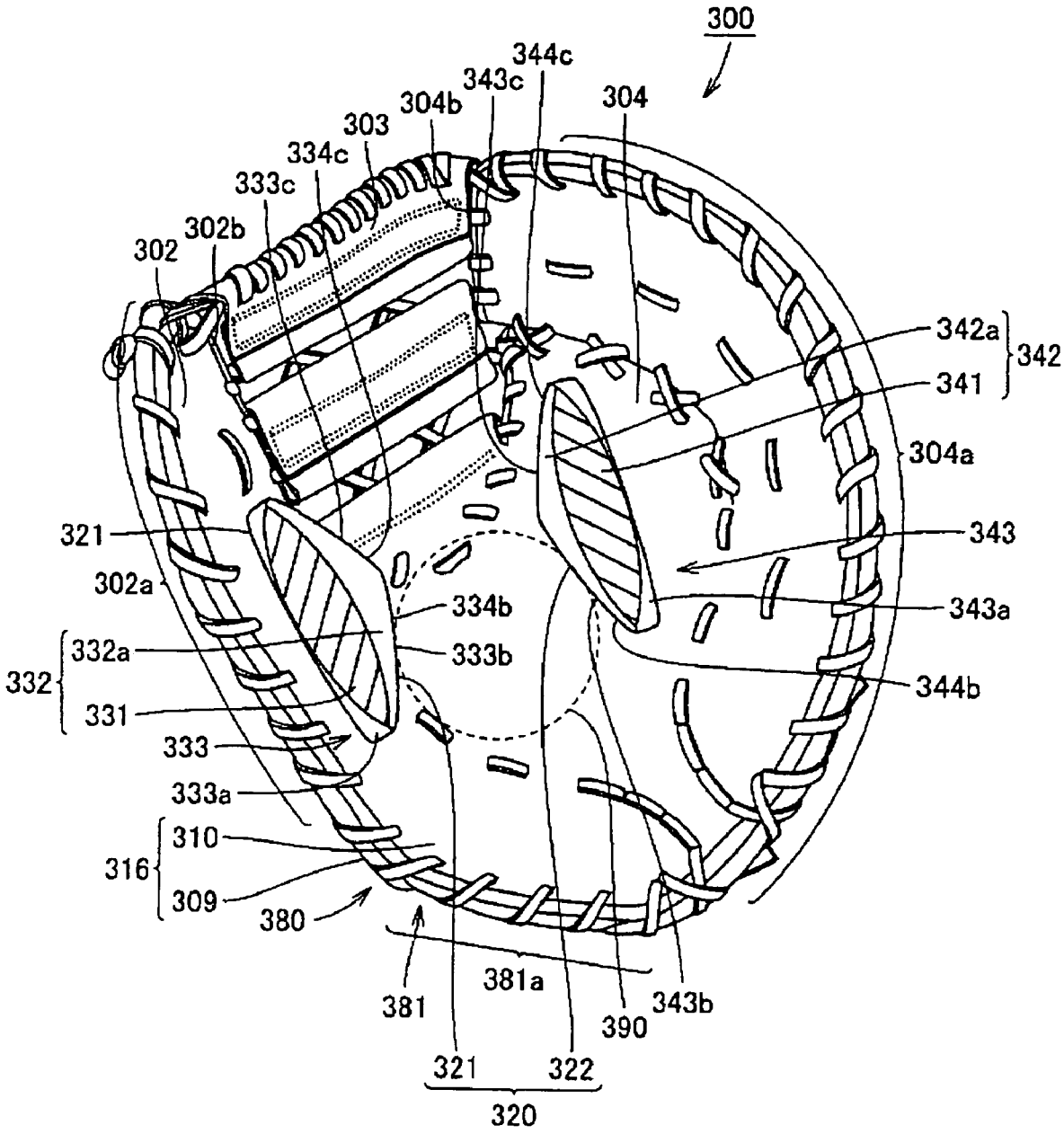
Figure 3:
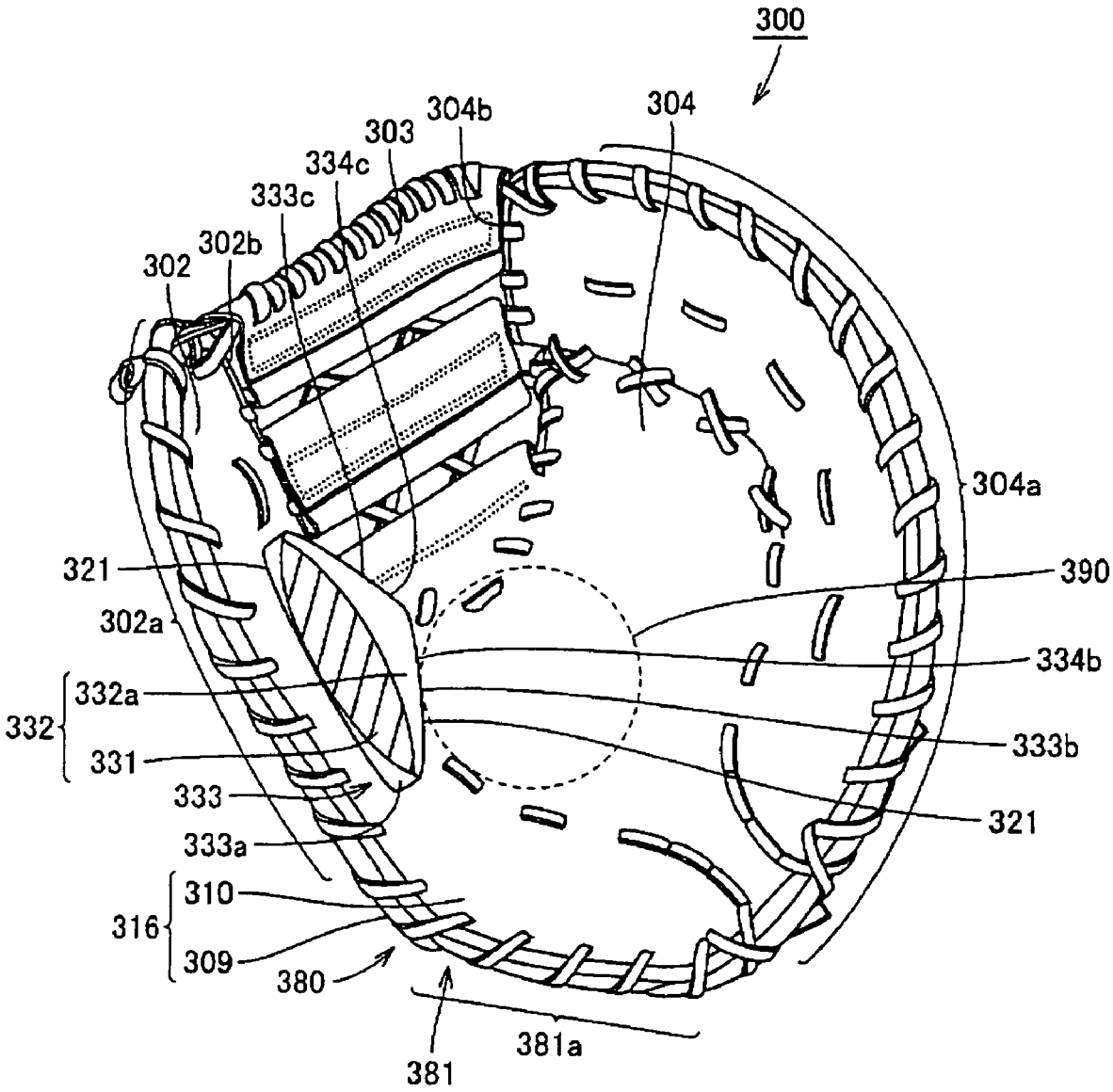
Figure 3:
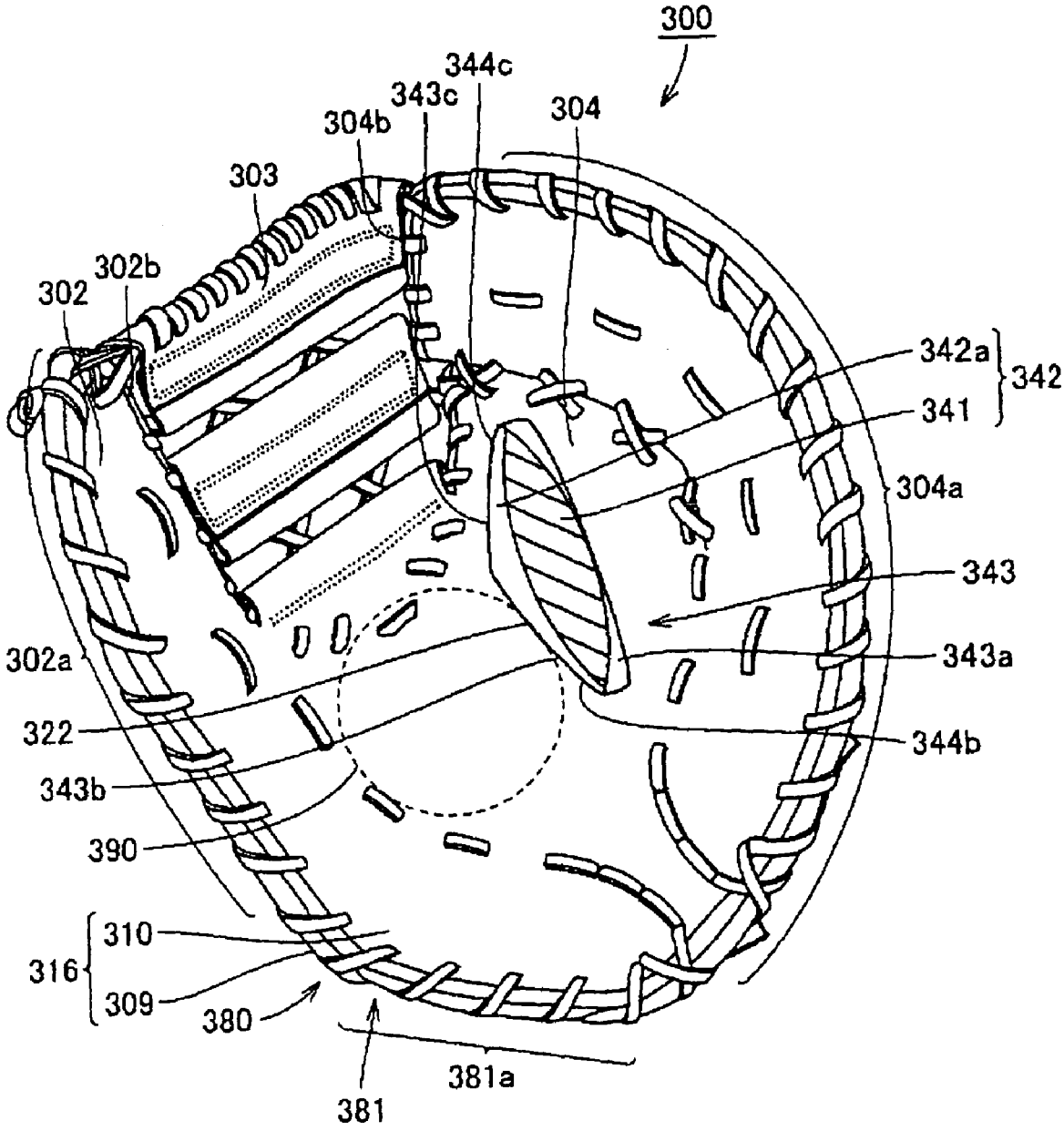
Figure 3:
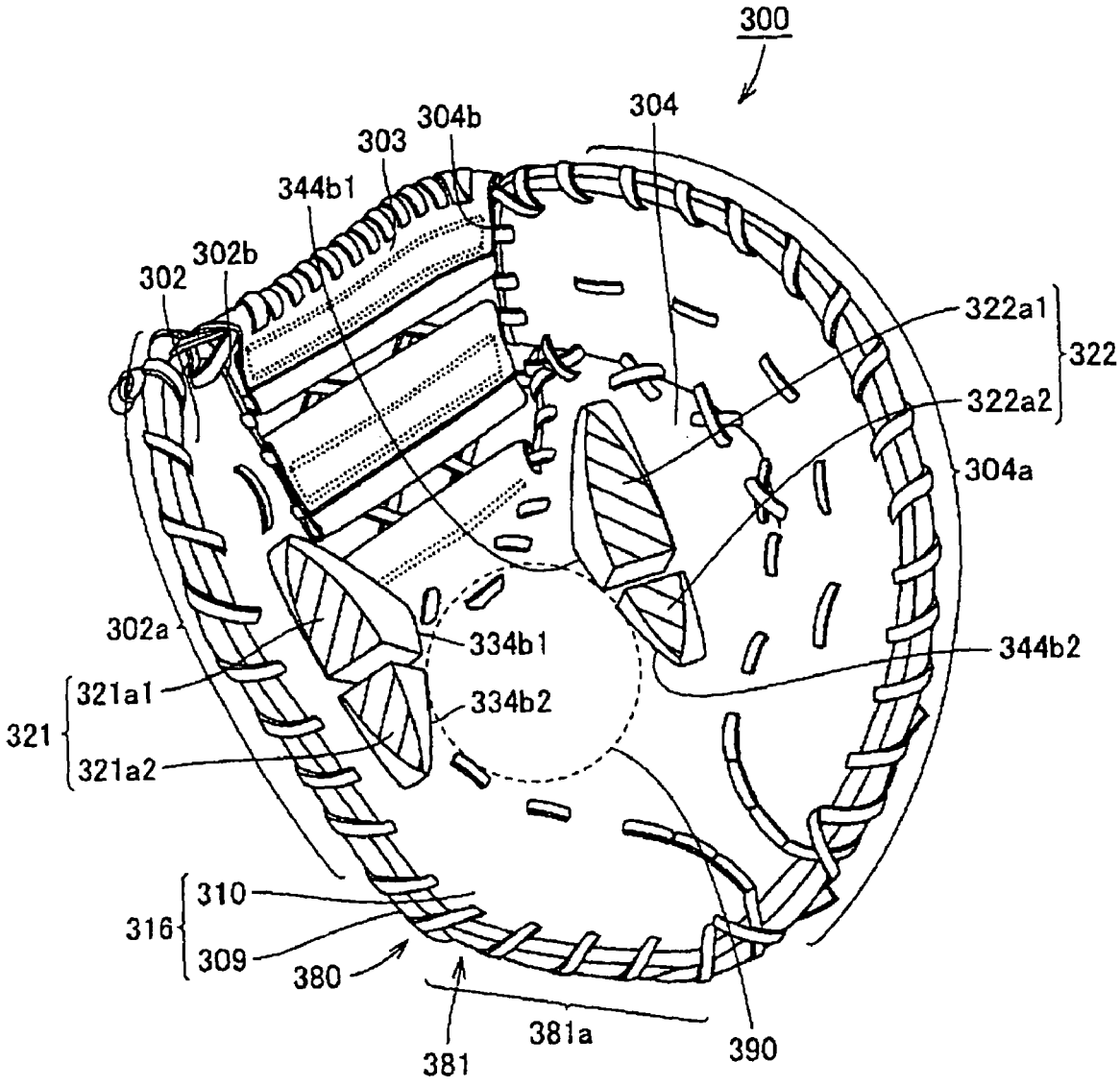
Figure 3:
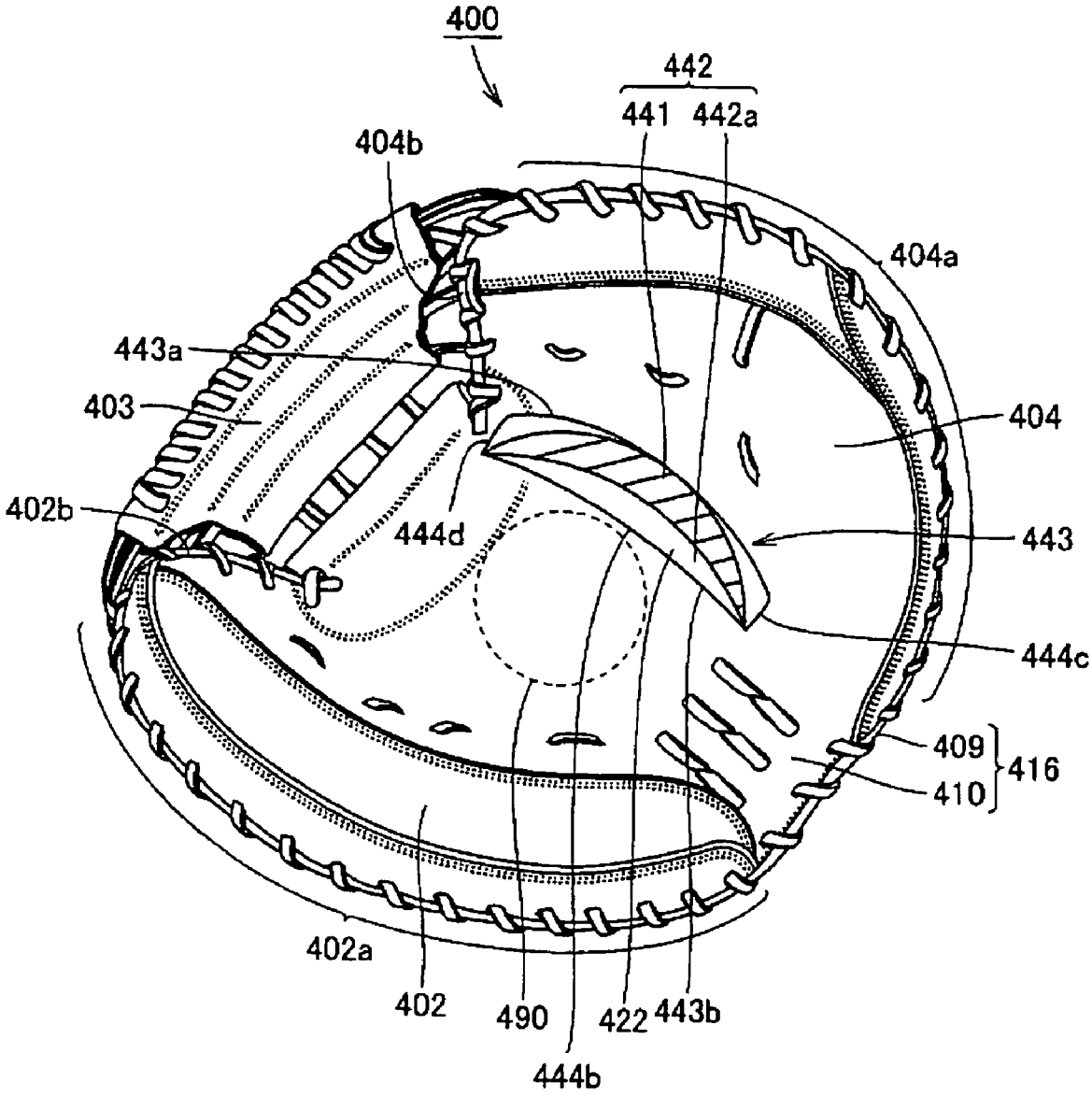
Figure 3:
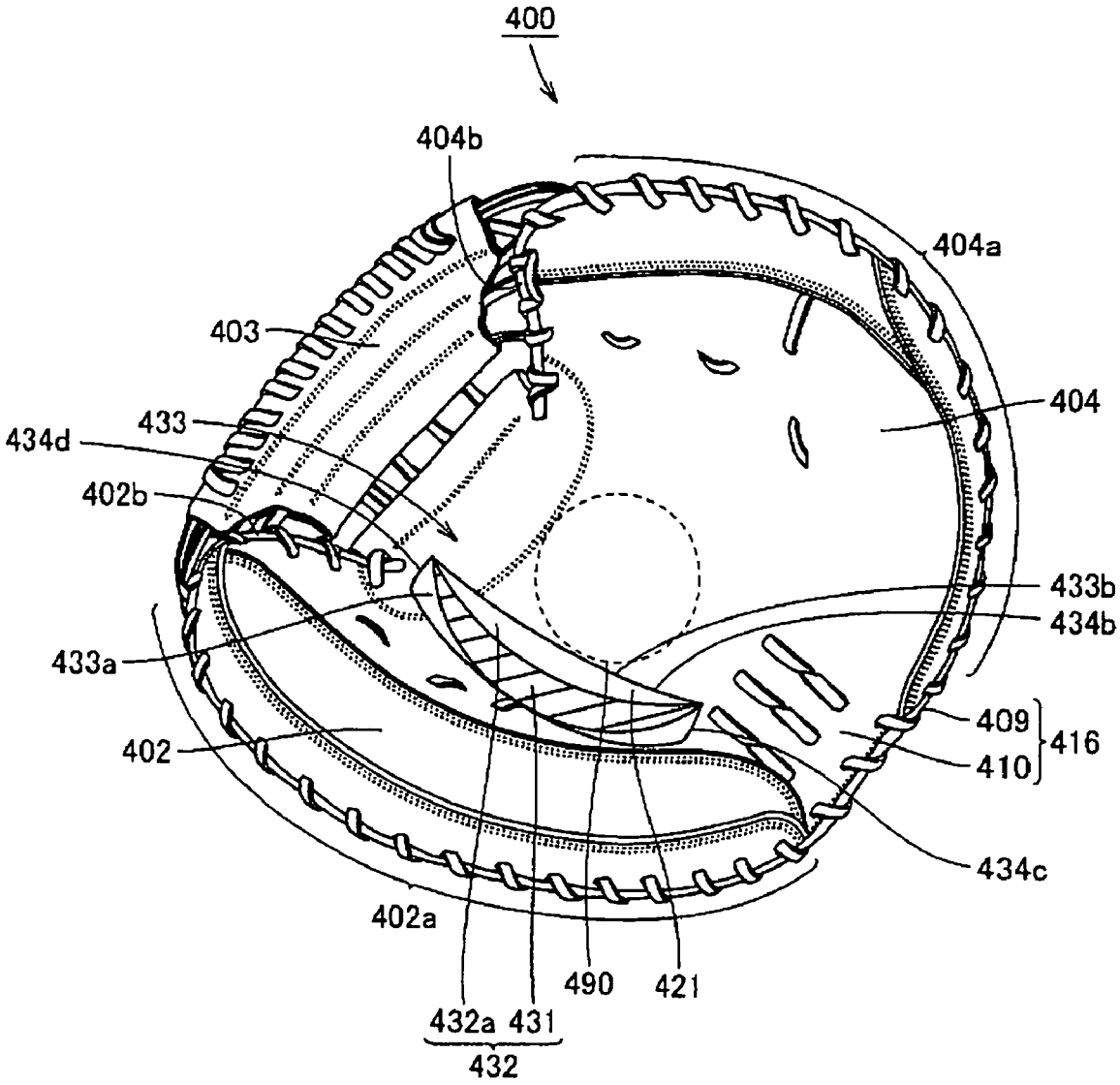
Figure 3:
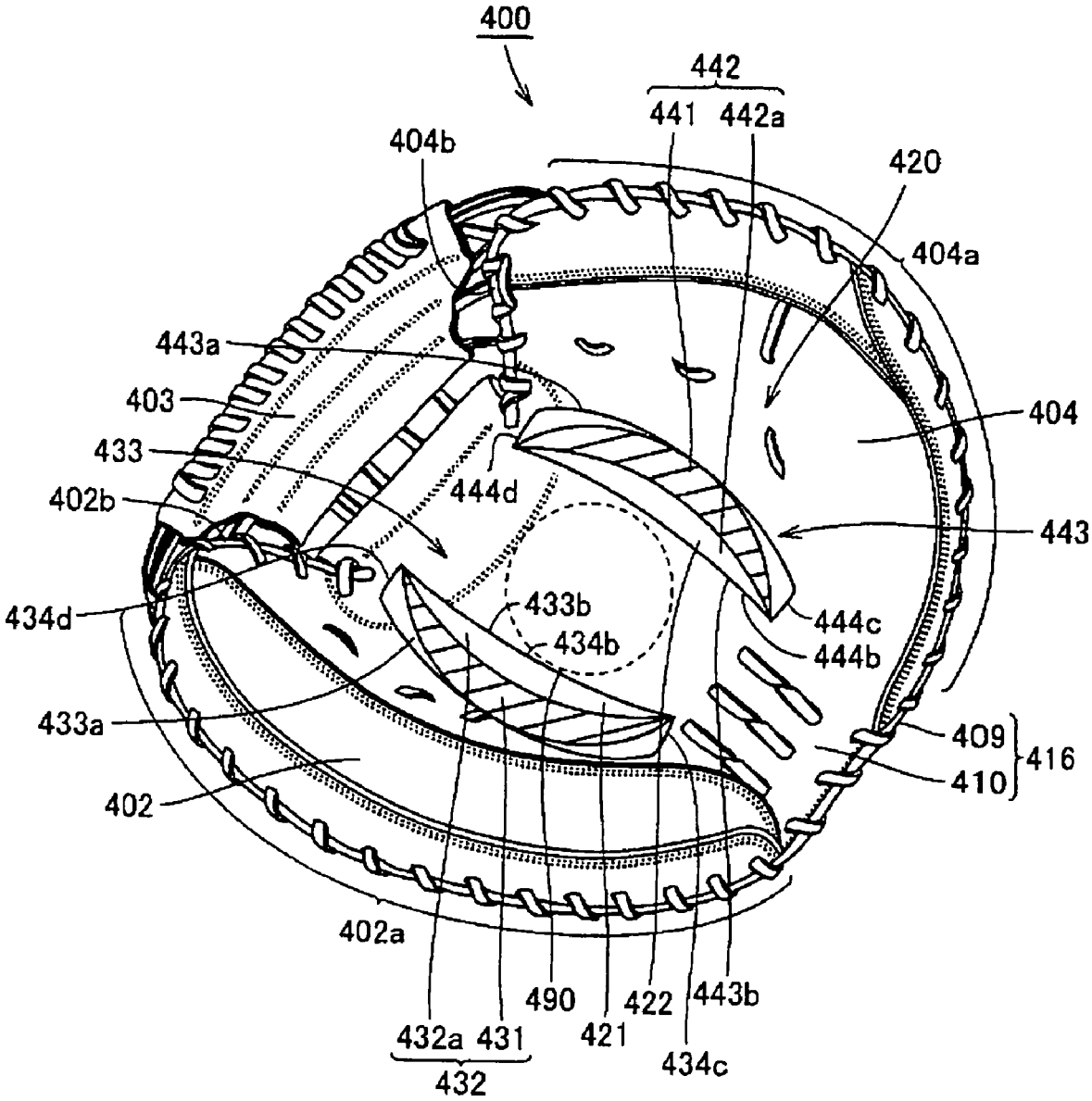
Figure 3:
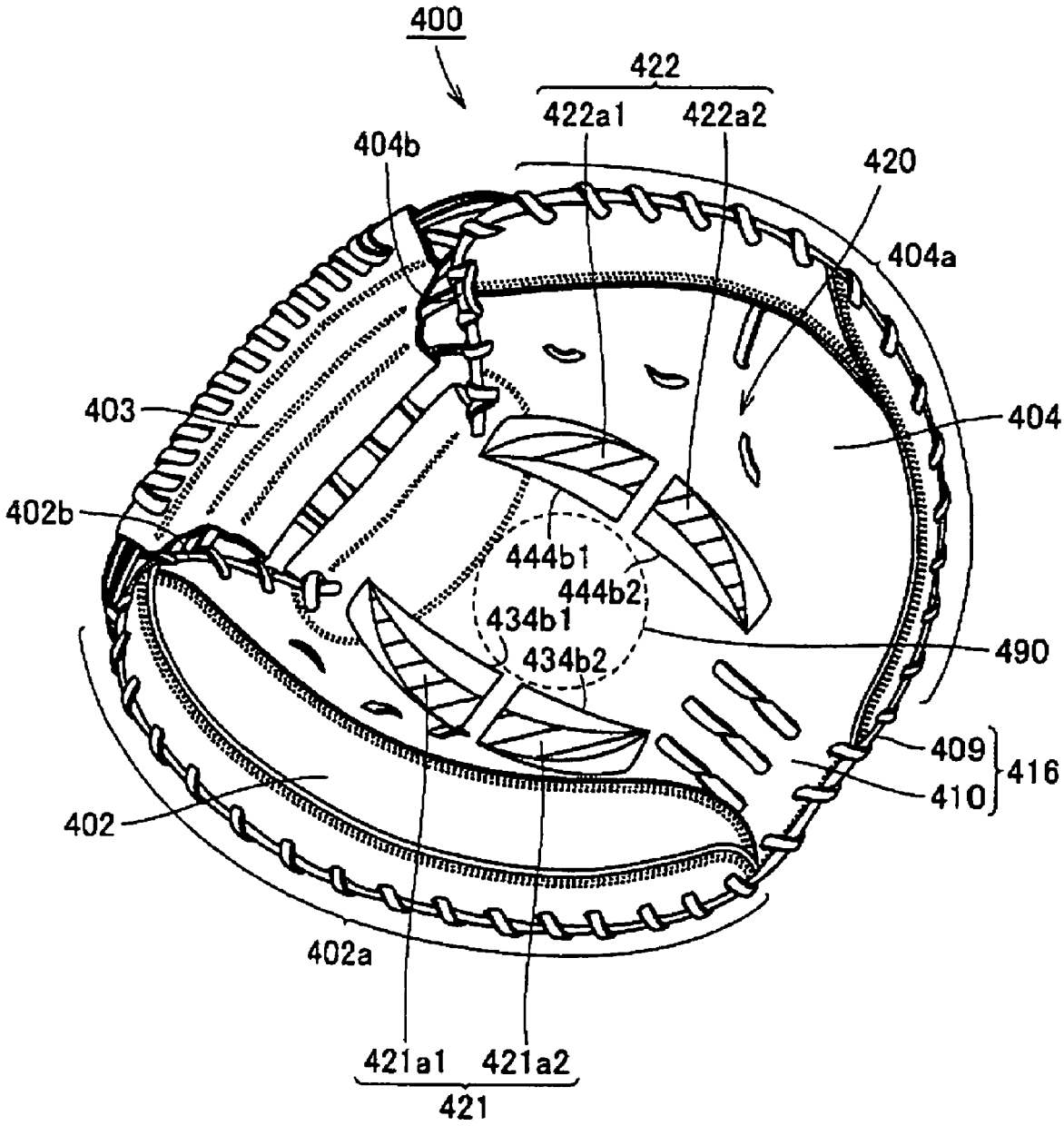
Figure 4:
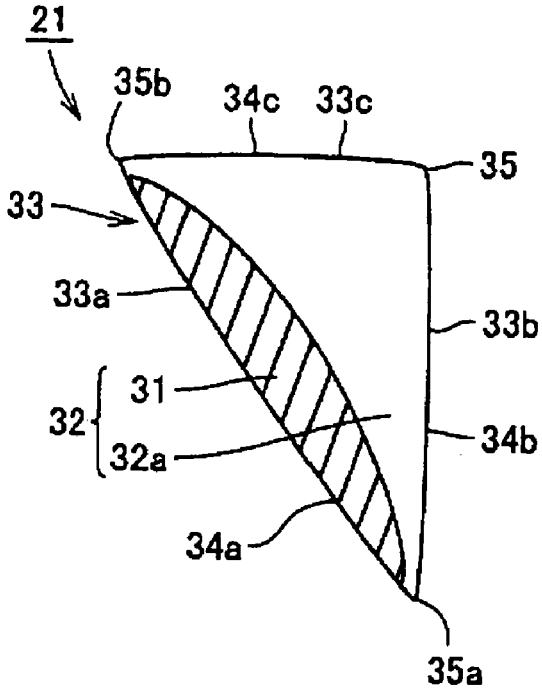
Figure 4:
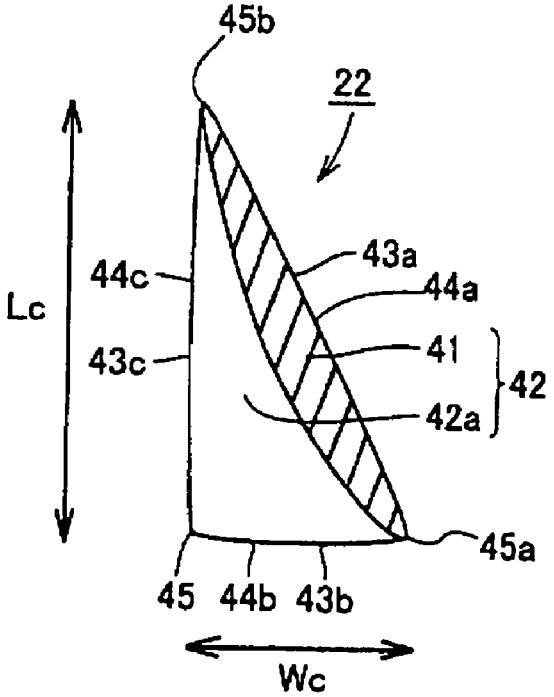
Figure 4:
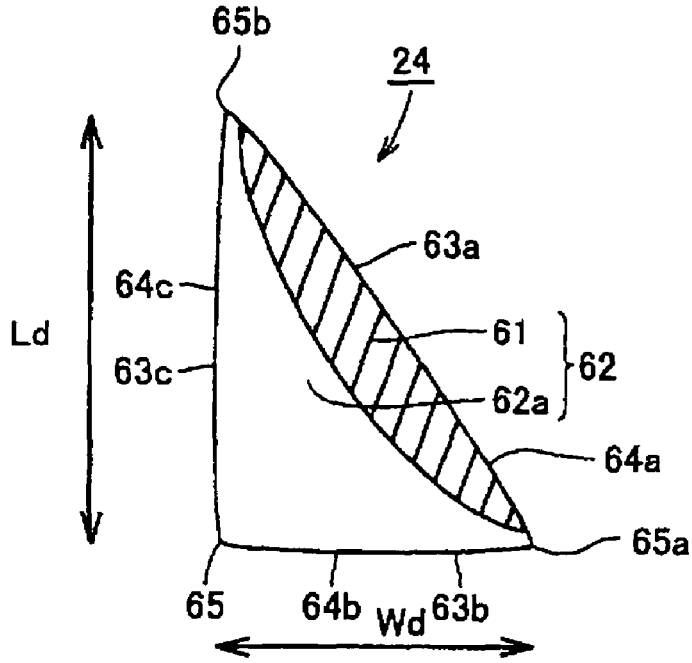
Figure 4:
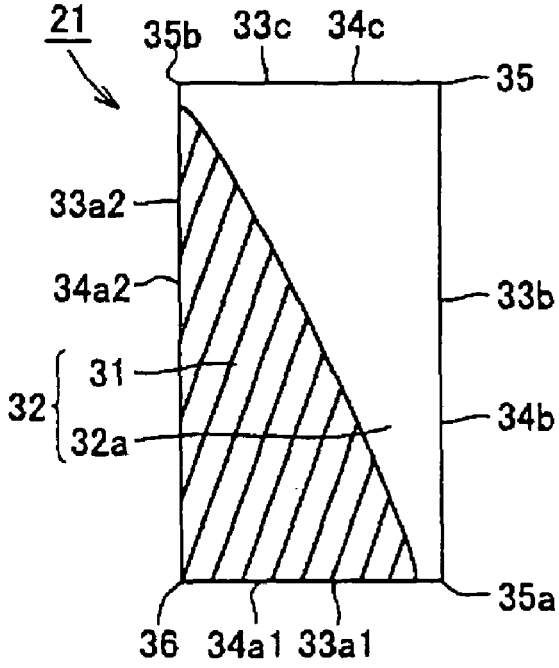
Figure 4:
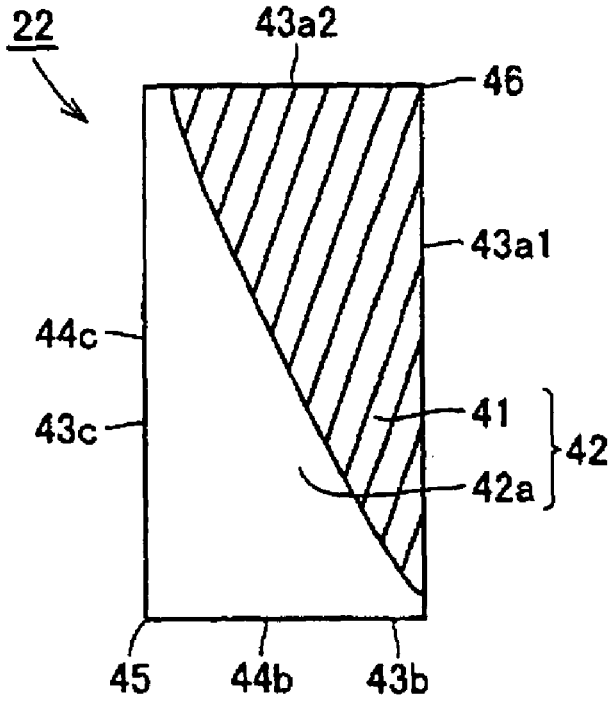
Figure 4:
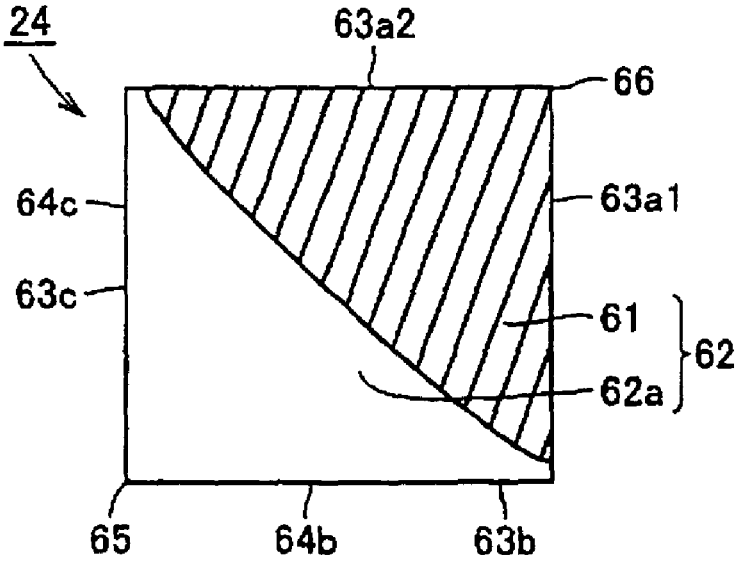
Figure 4:
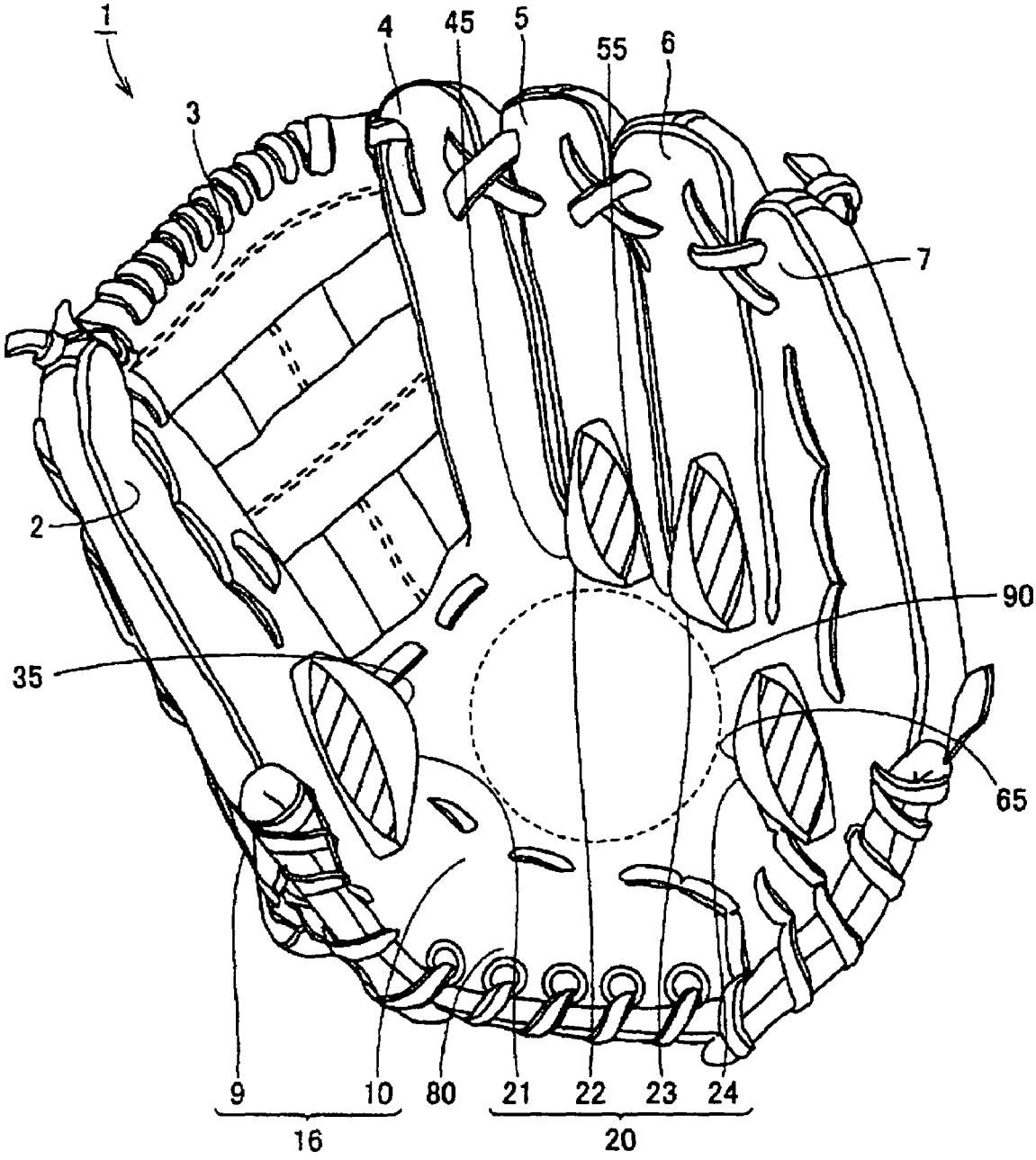
Figure 4:
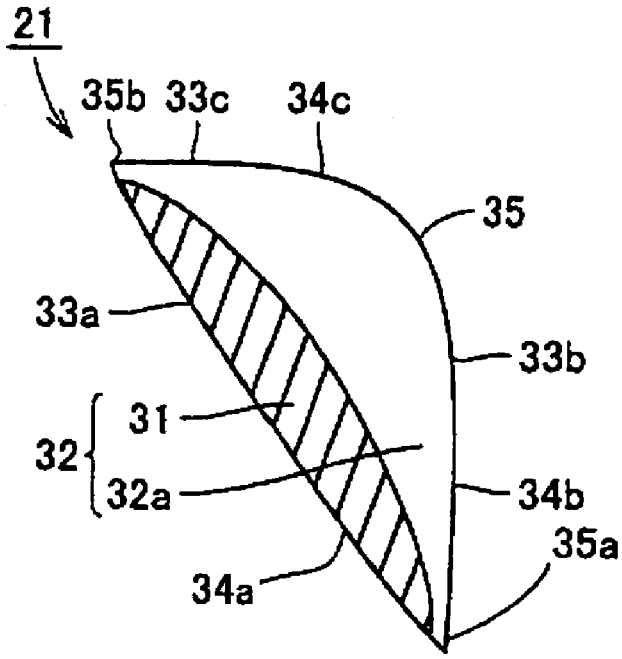
Figure 4:
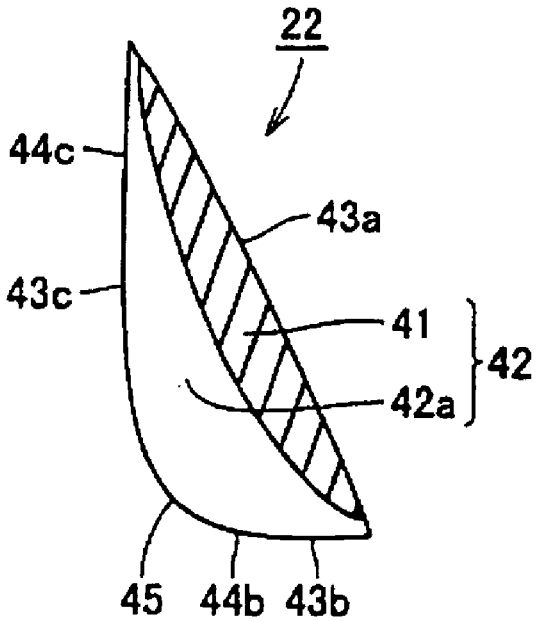
Figure 4:
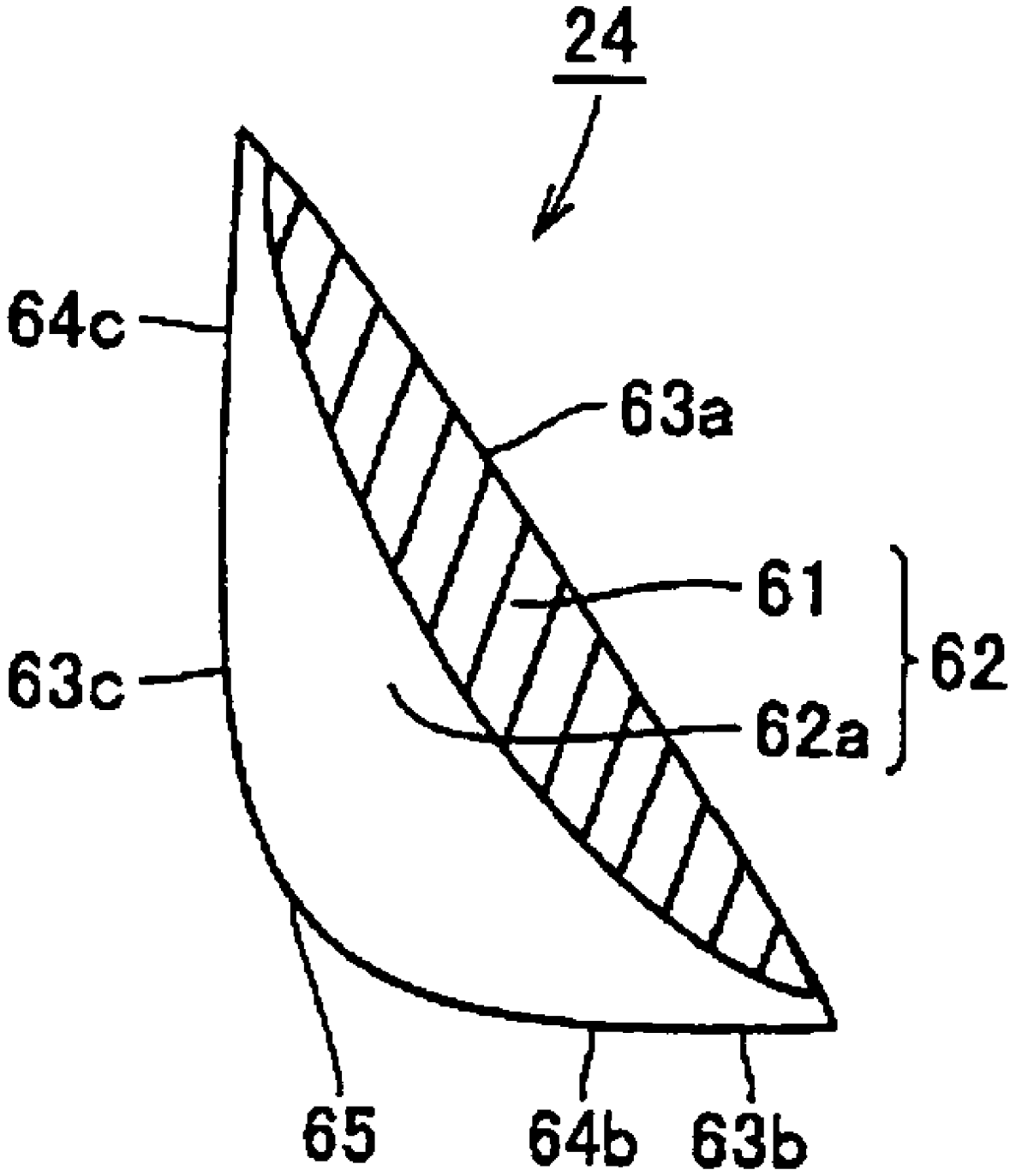
Figure 5:
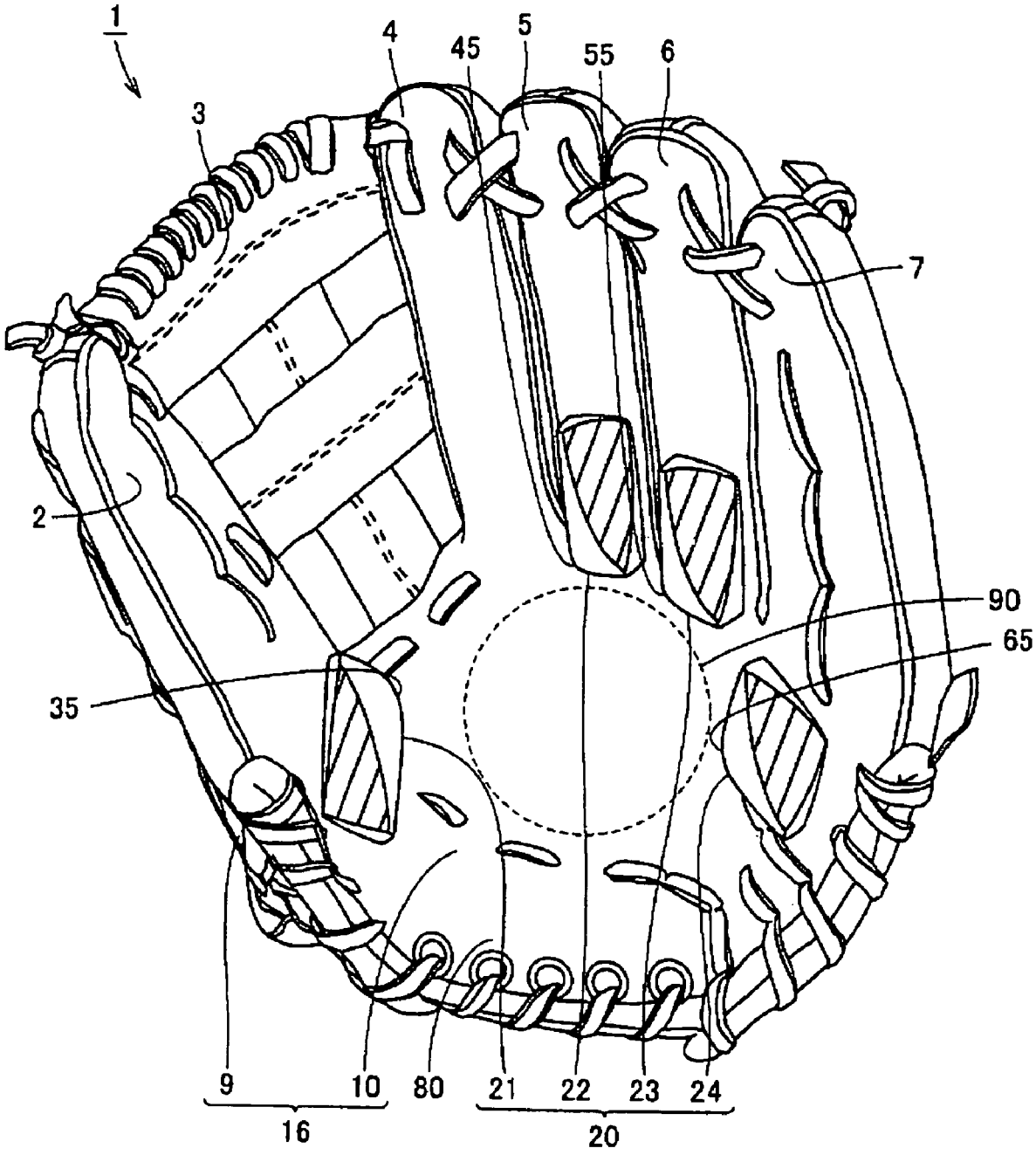
Figure 5:
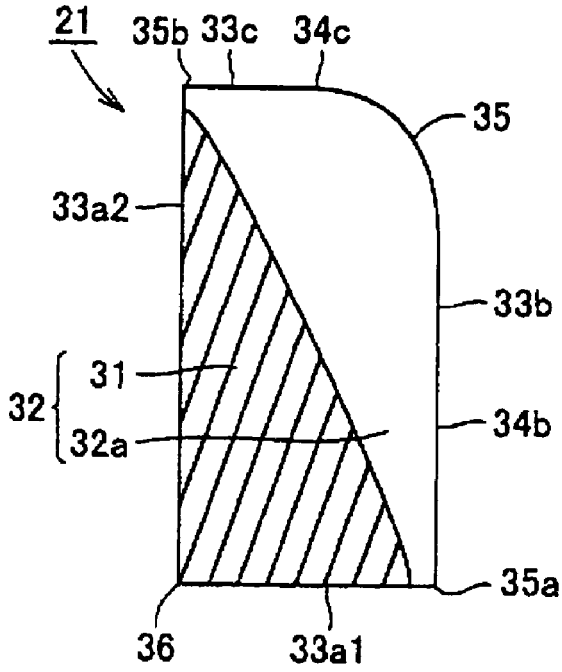
Figure 5:
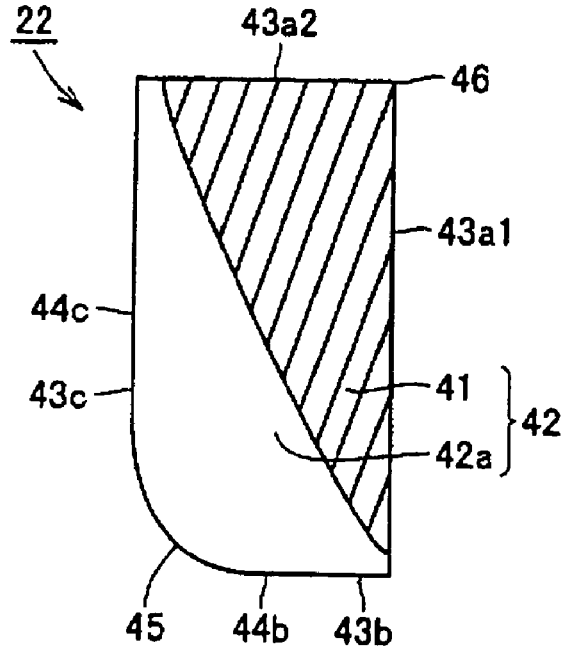
Figure 5:
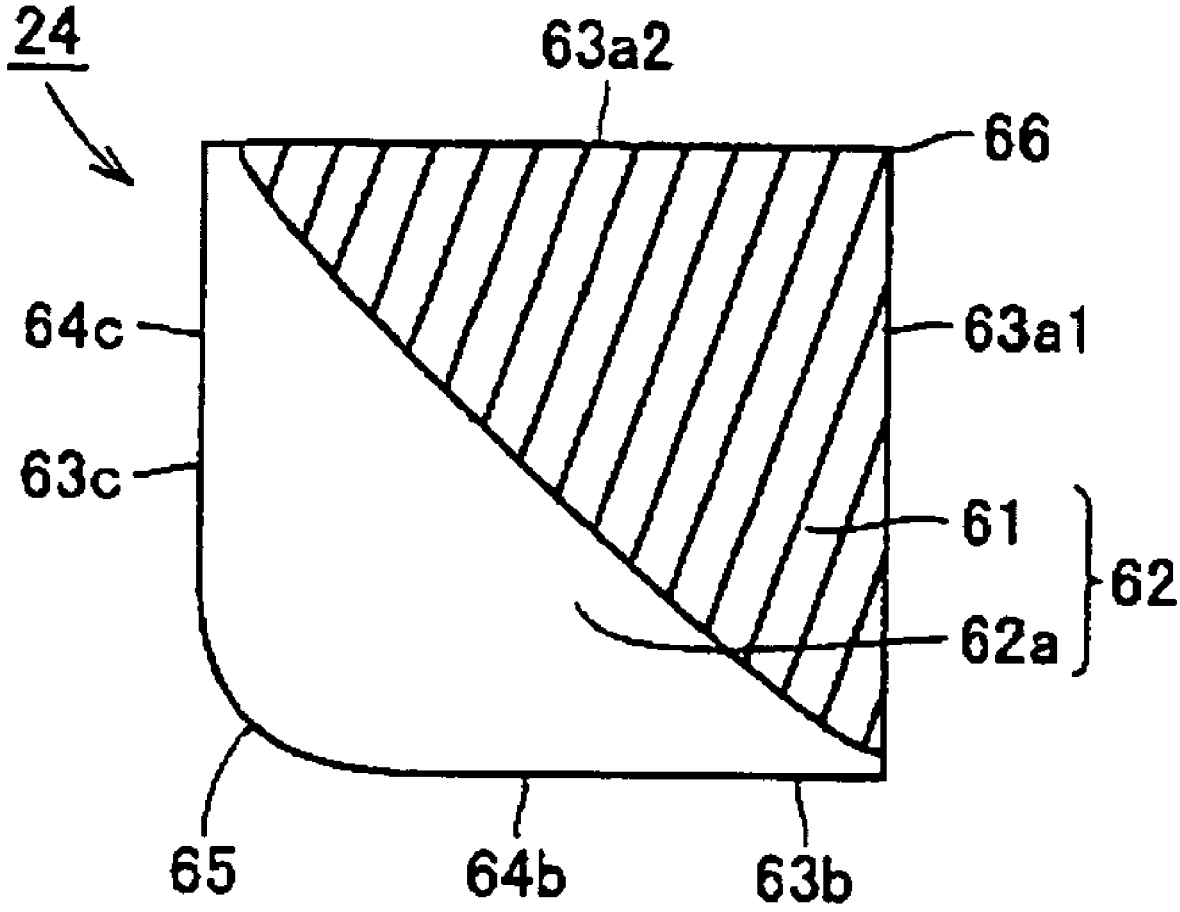
Figure 5:
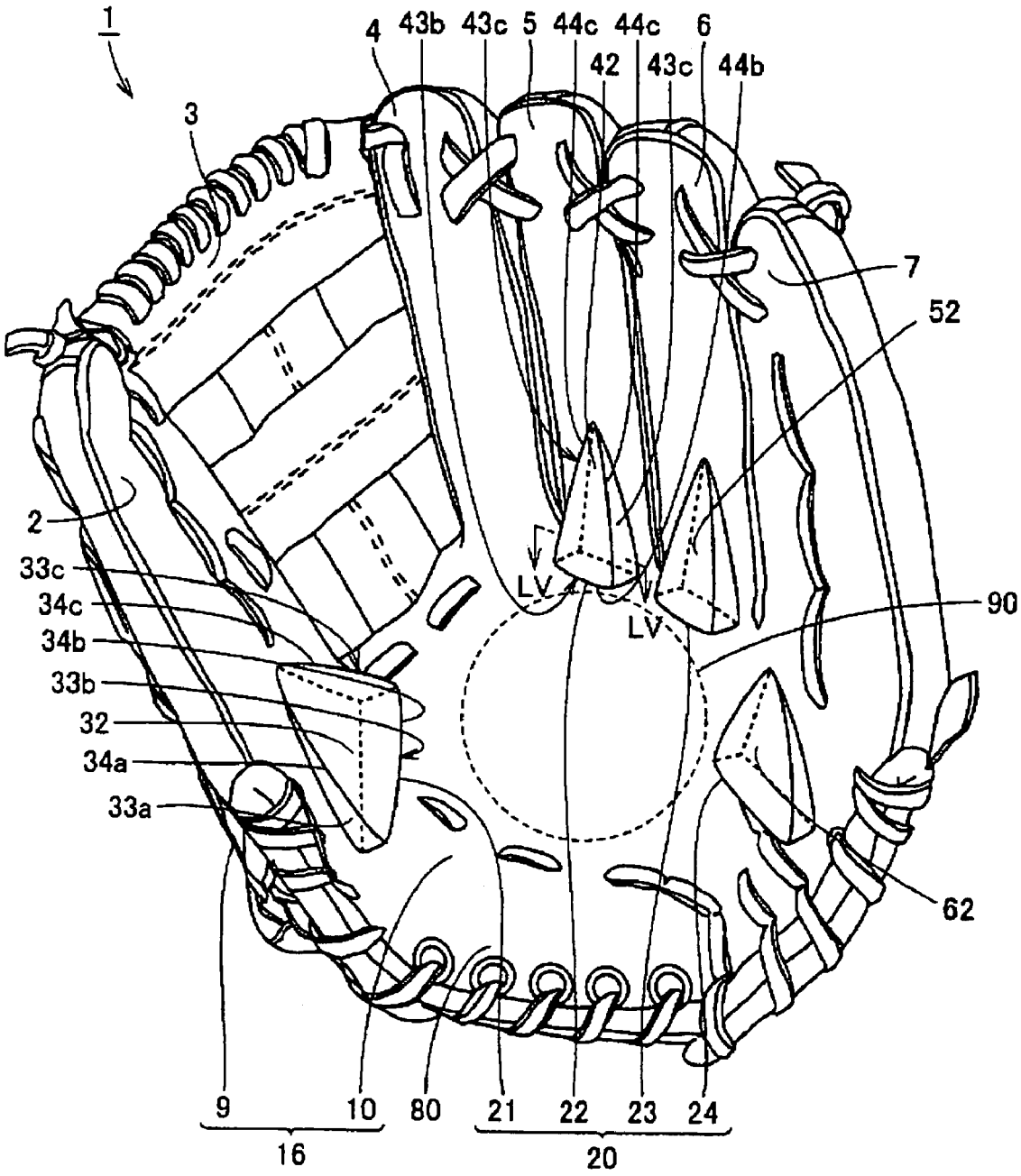
Figure 5:
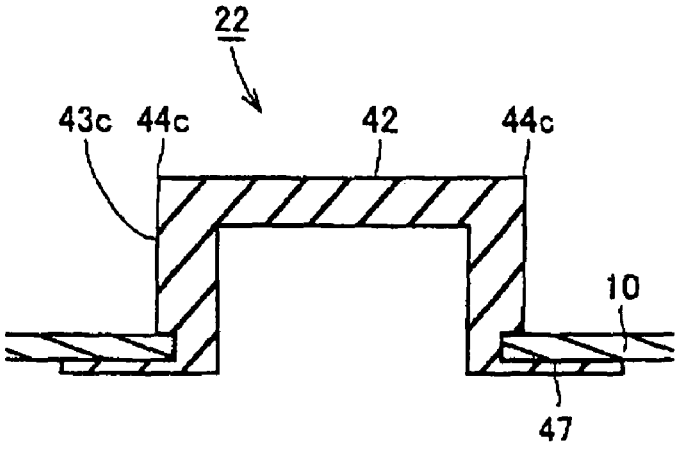
Figure 5:
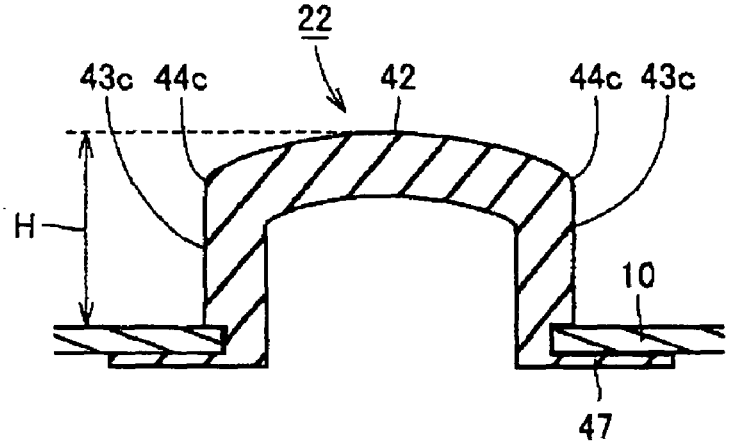
Figure 5:
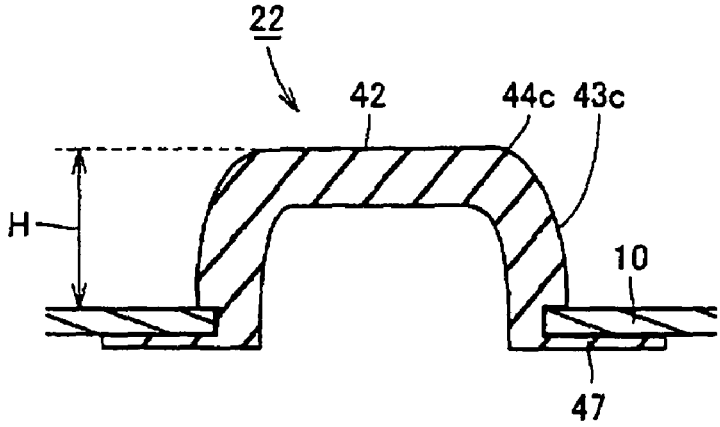
Figure 5:
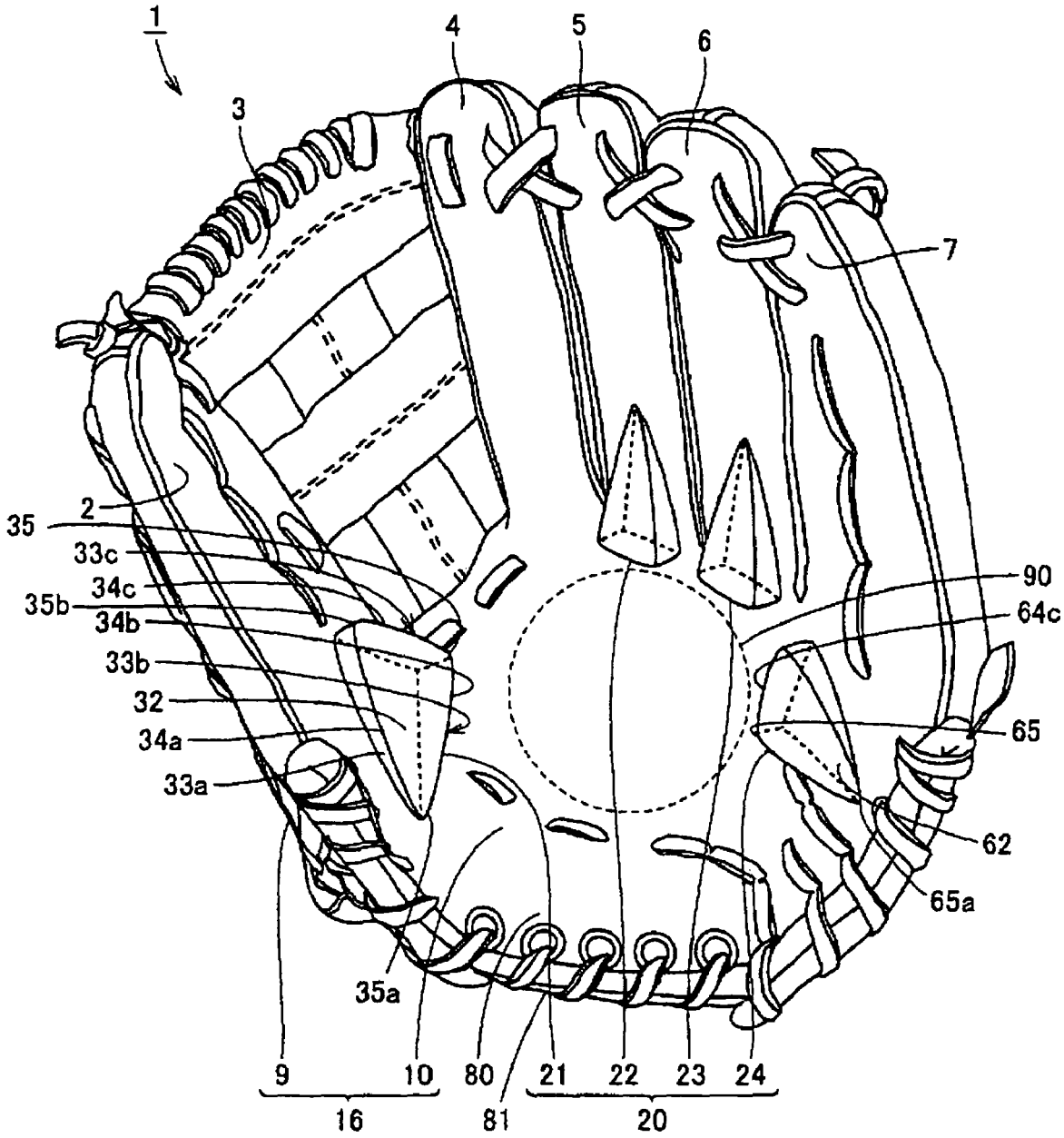
Figure 5:
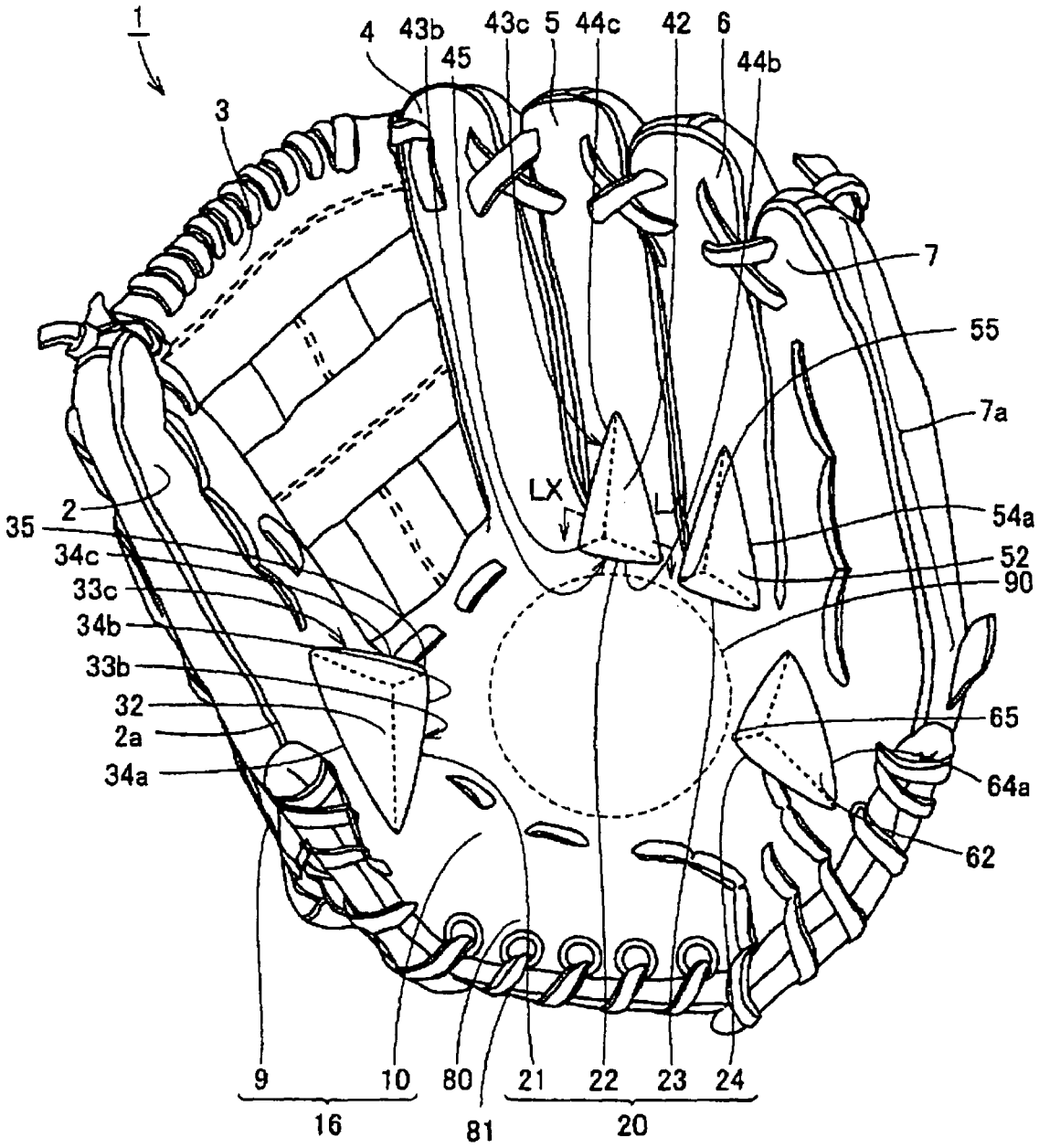
Figure 6:
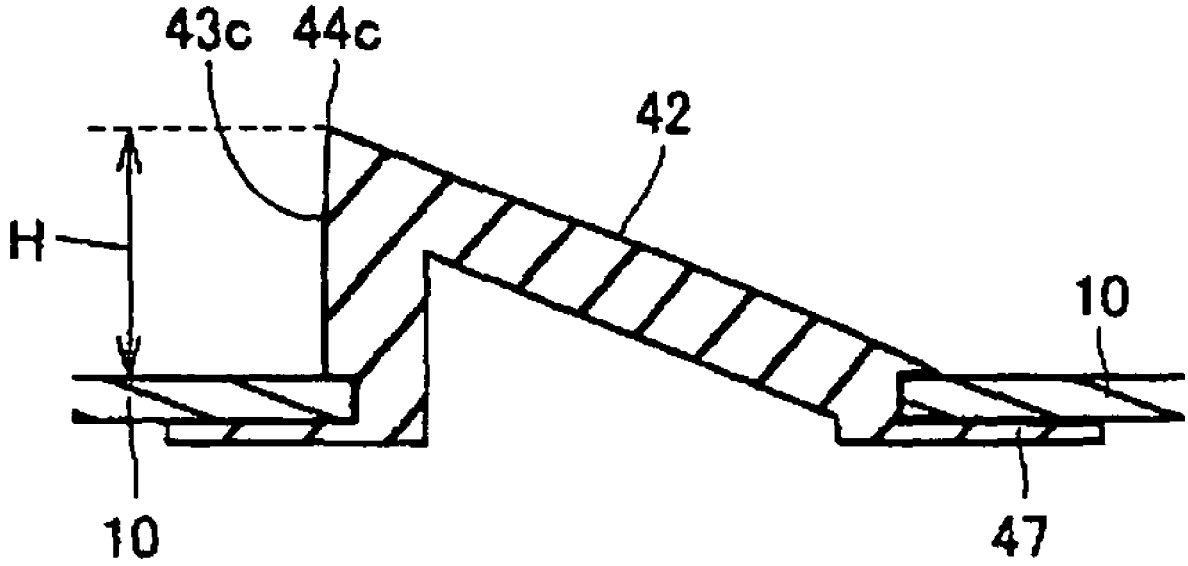
Figure 6:
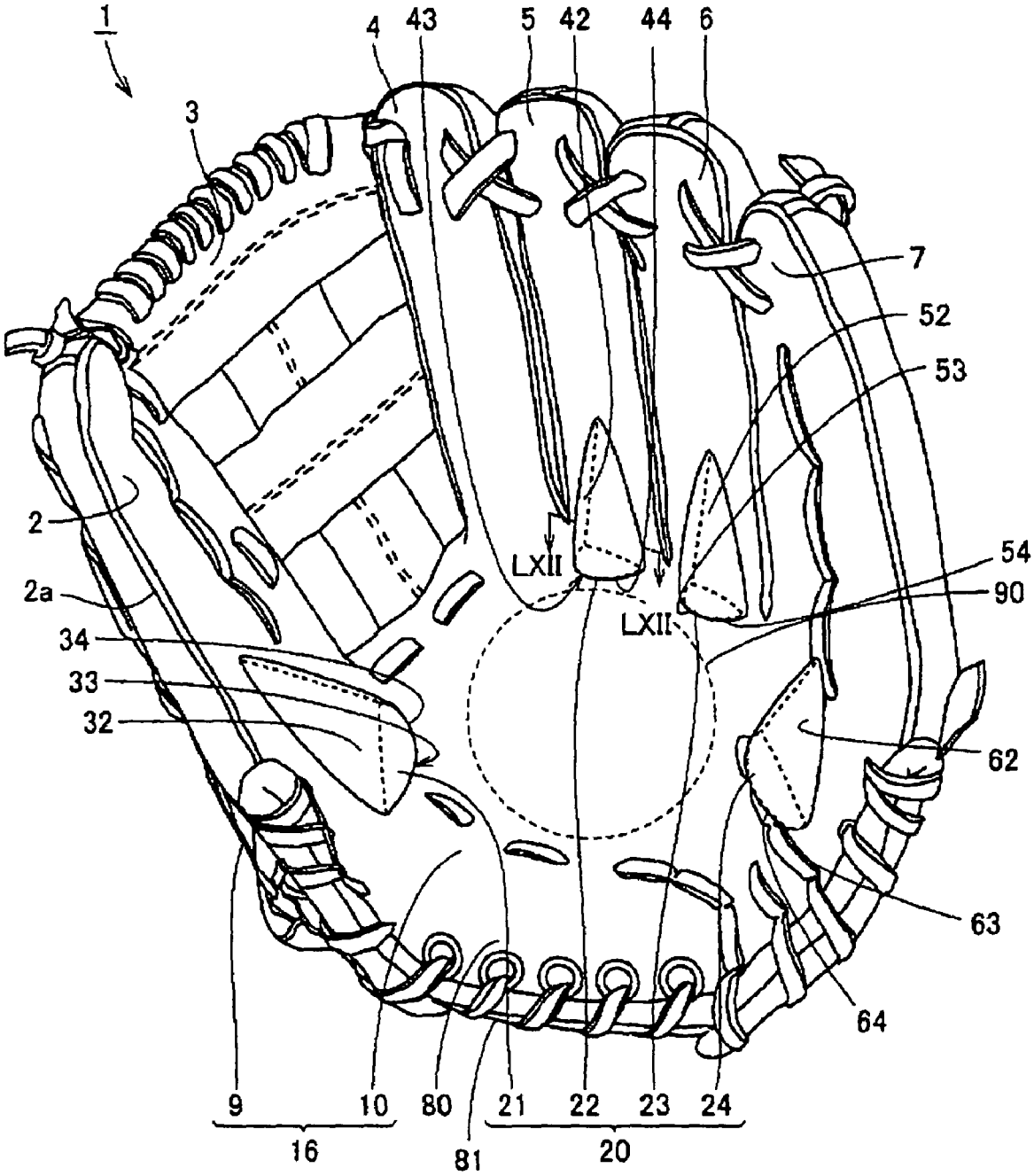
Figure 6:
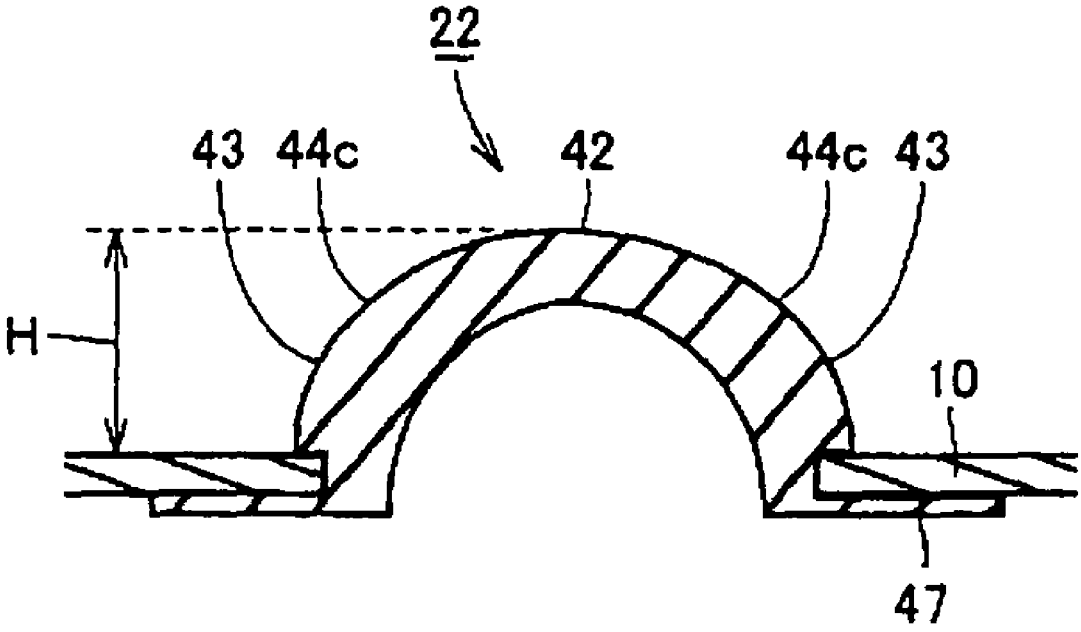
Figure 6:
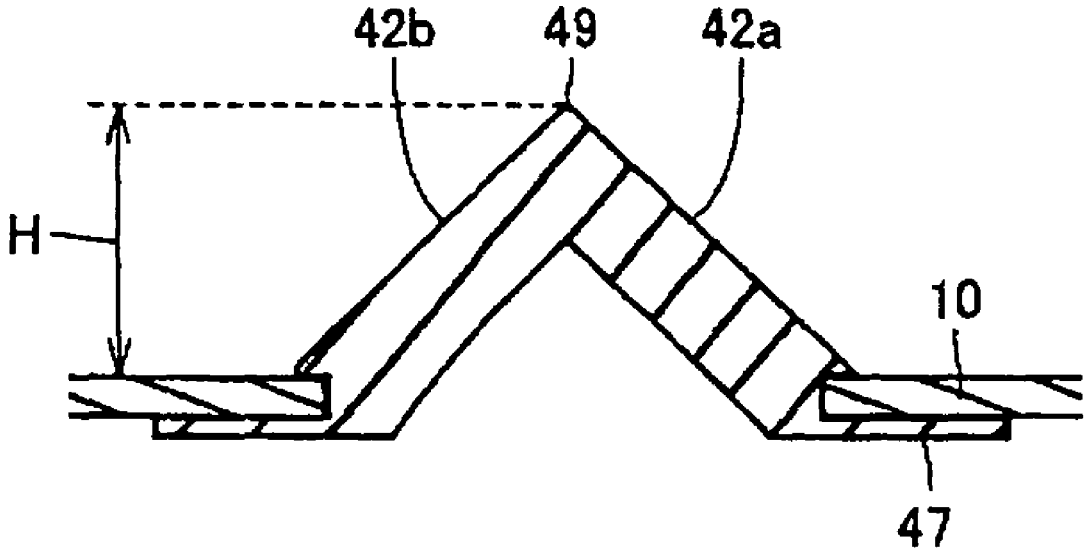
Figure 6:
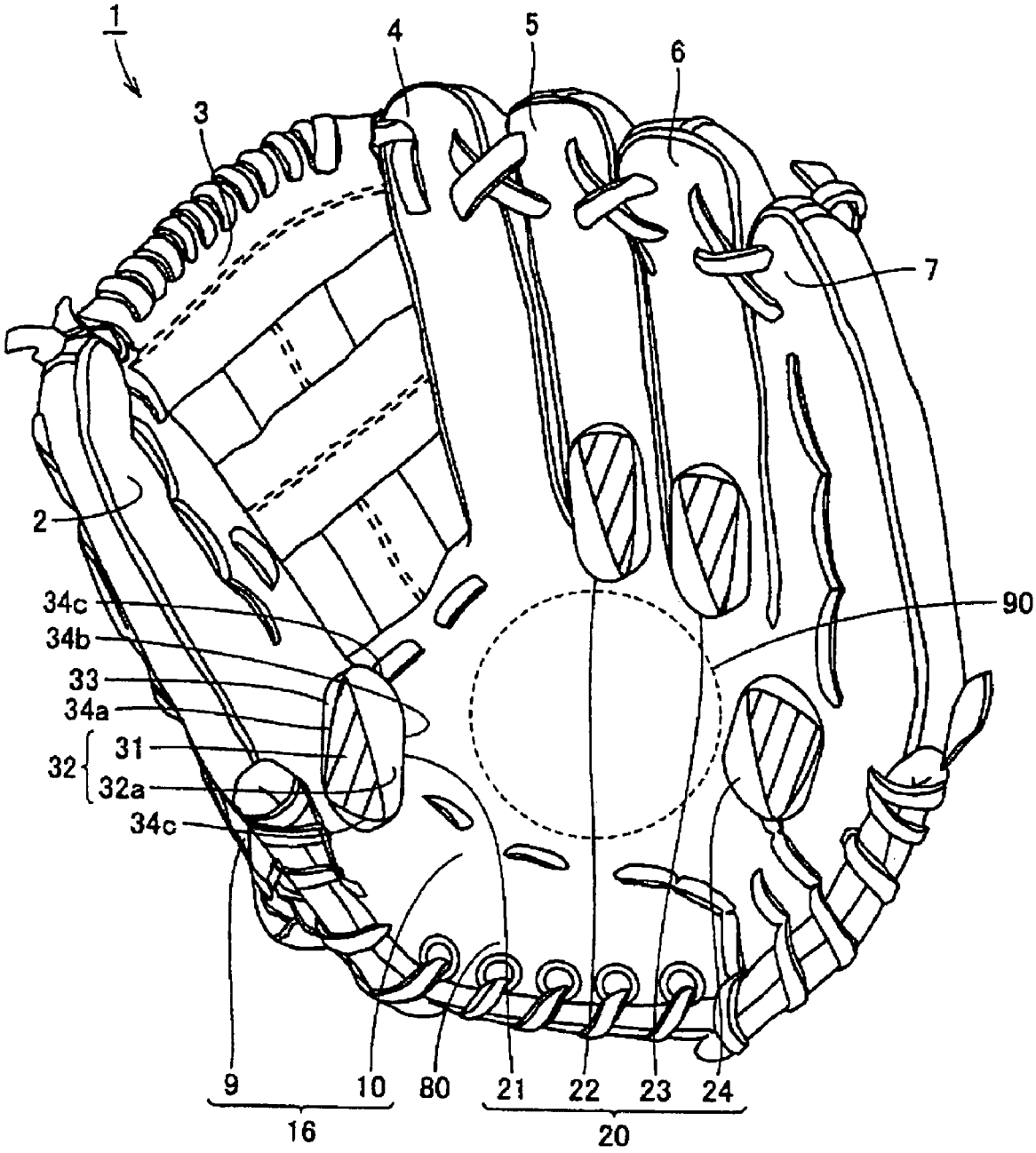
Figure 6:
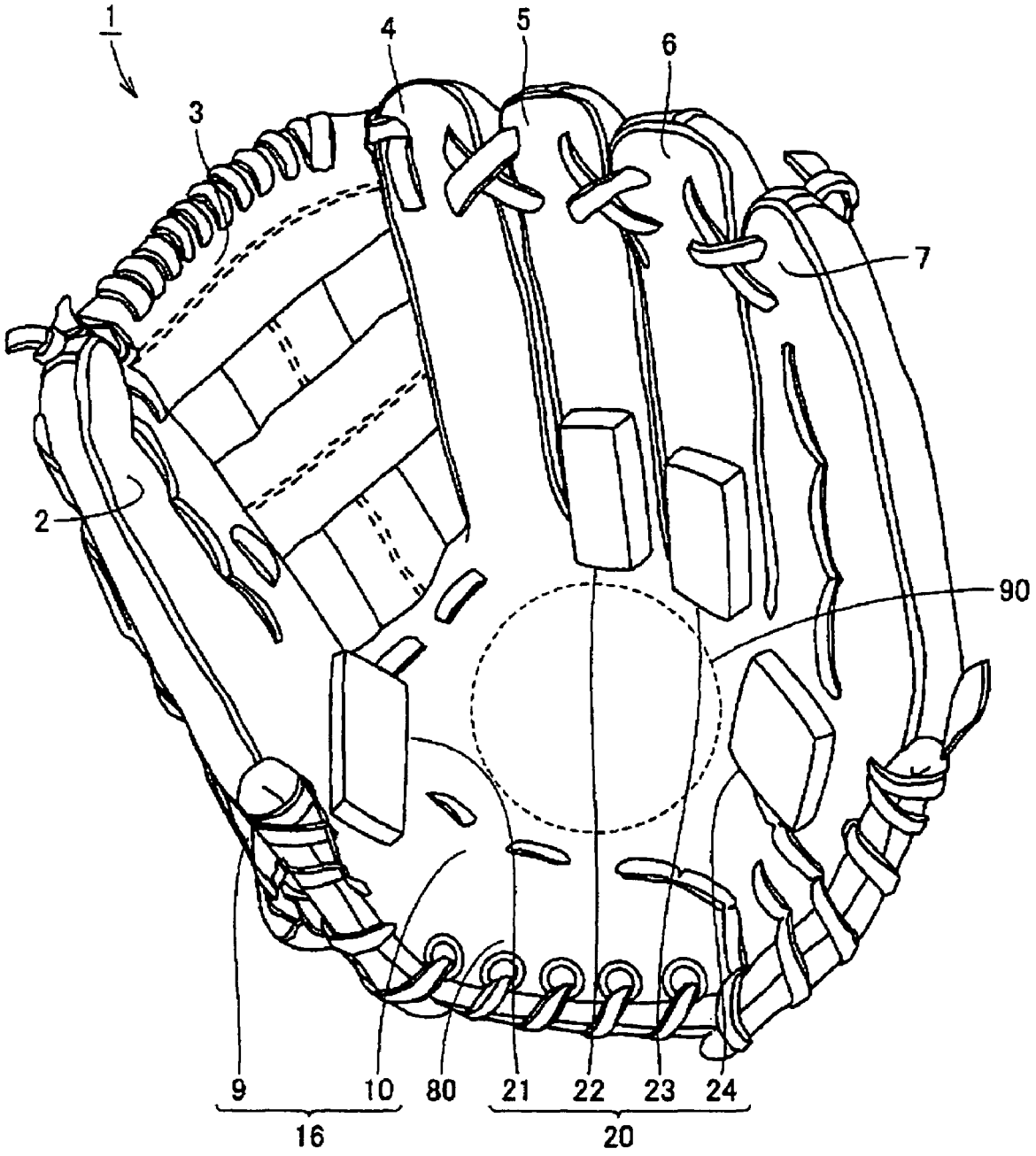
Figure 6:
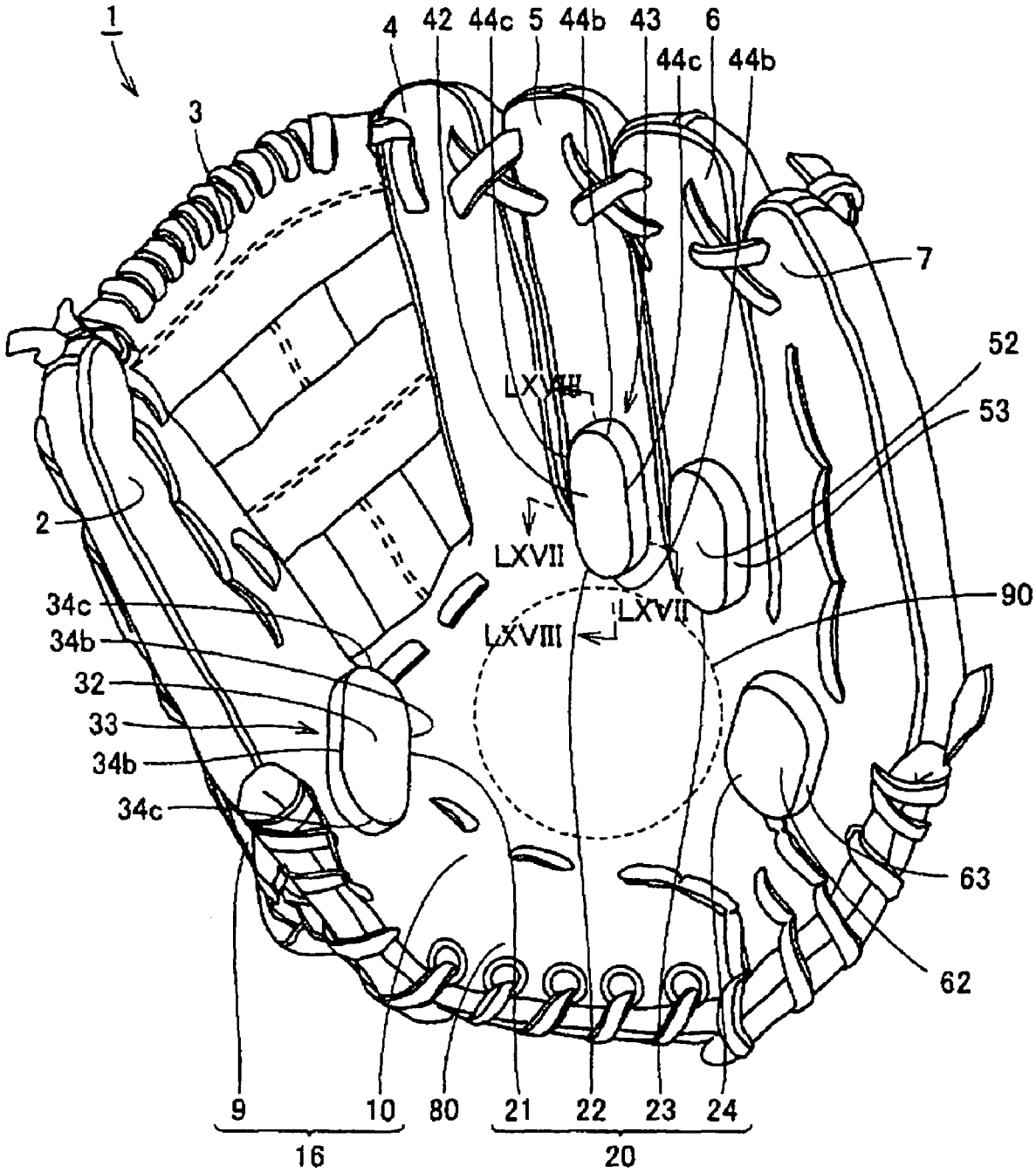
Figure 6:
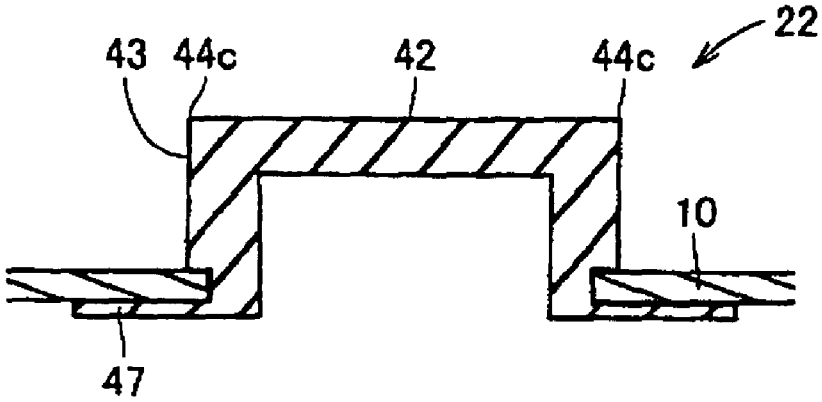
Figure 6:
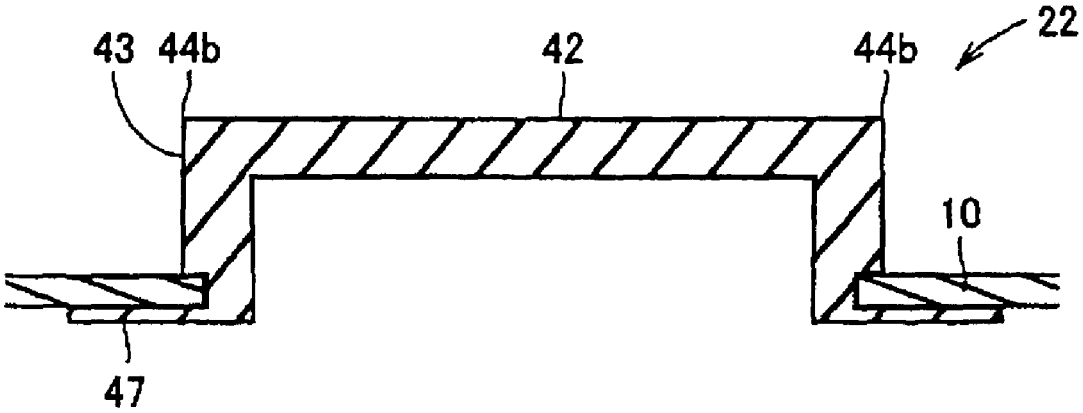
Figure 6:
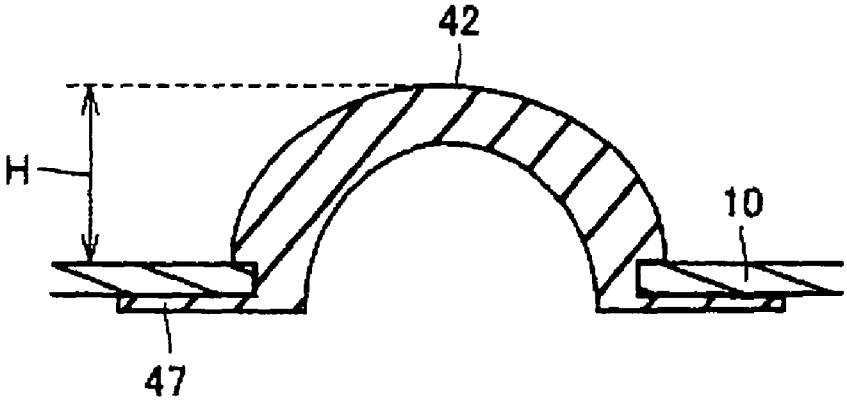
Figure 7:
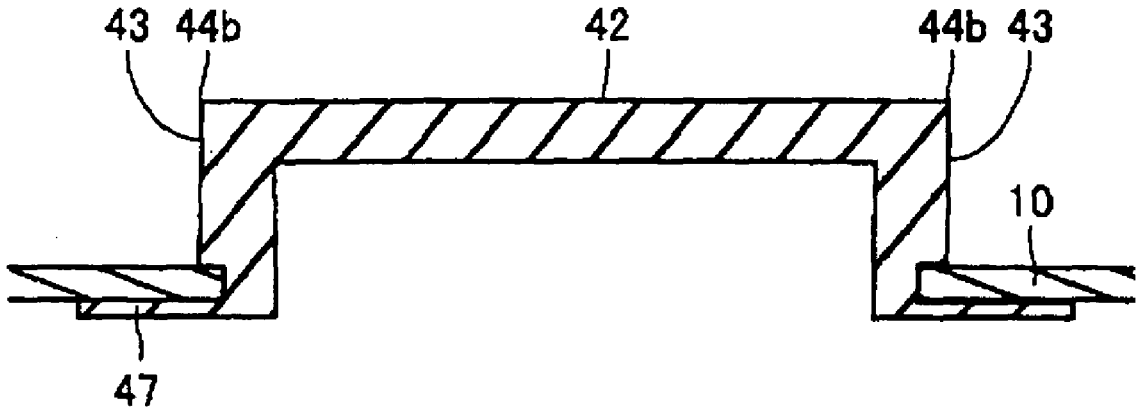
Figure 7:
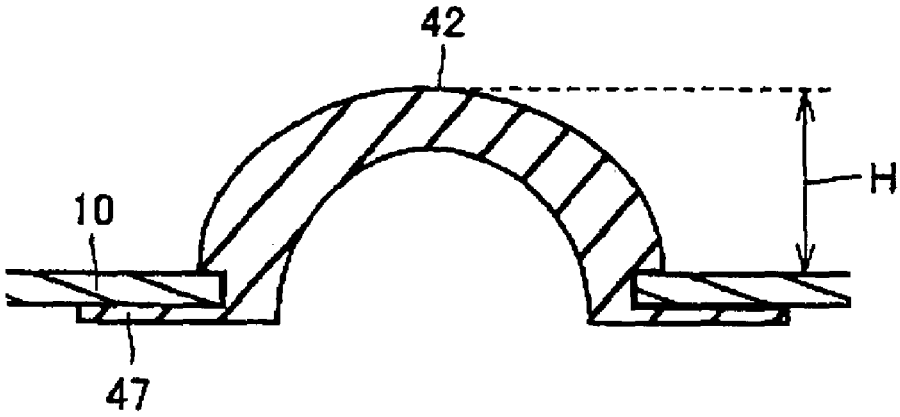
Figure 7:
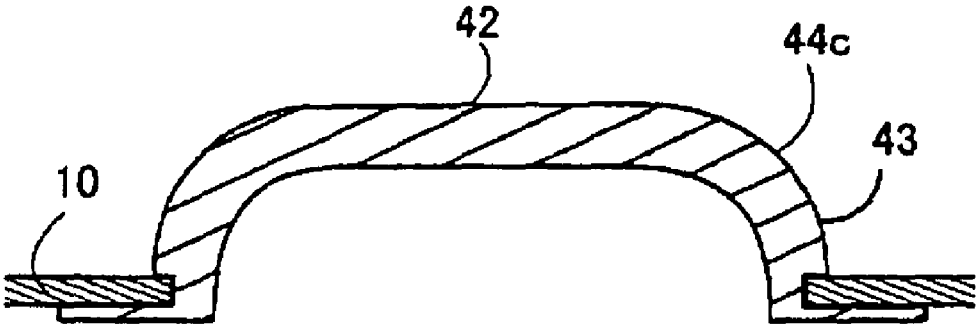
Figure 7:
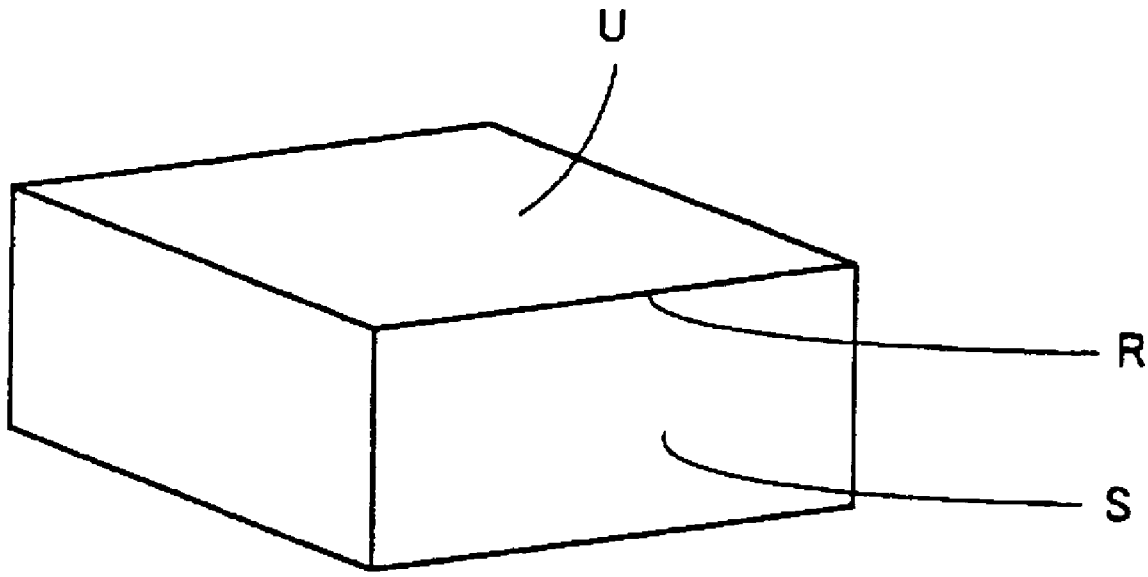
Figure 7:
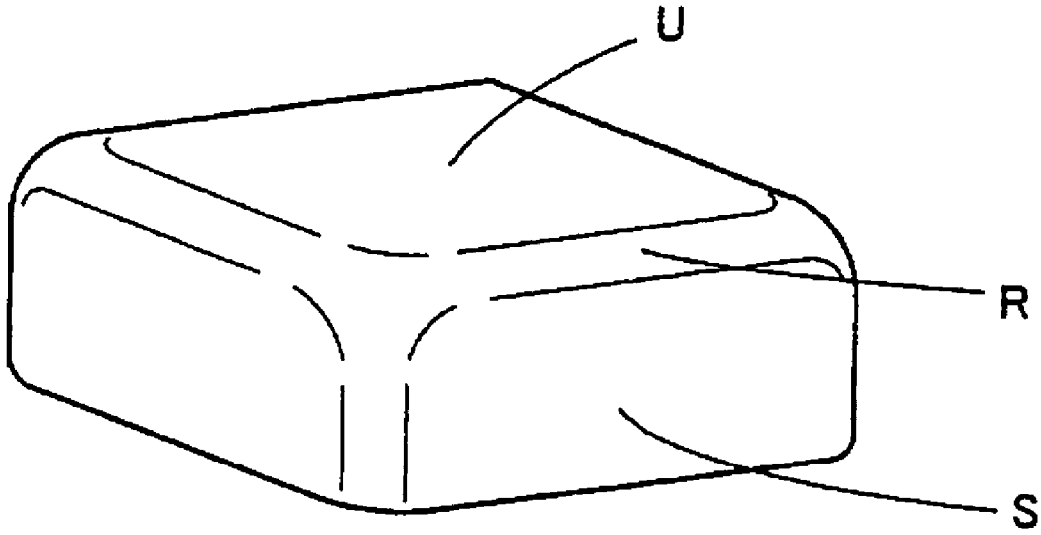
Figure 7:
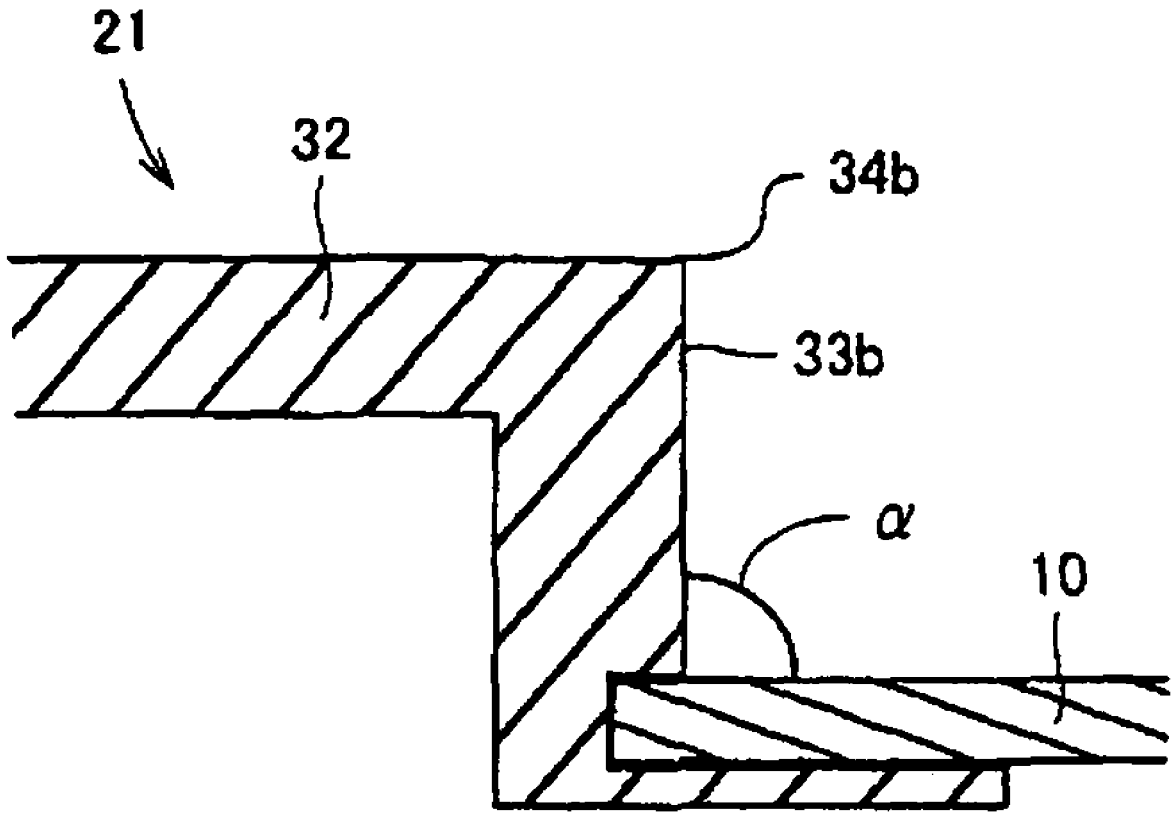
Figure 7:
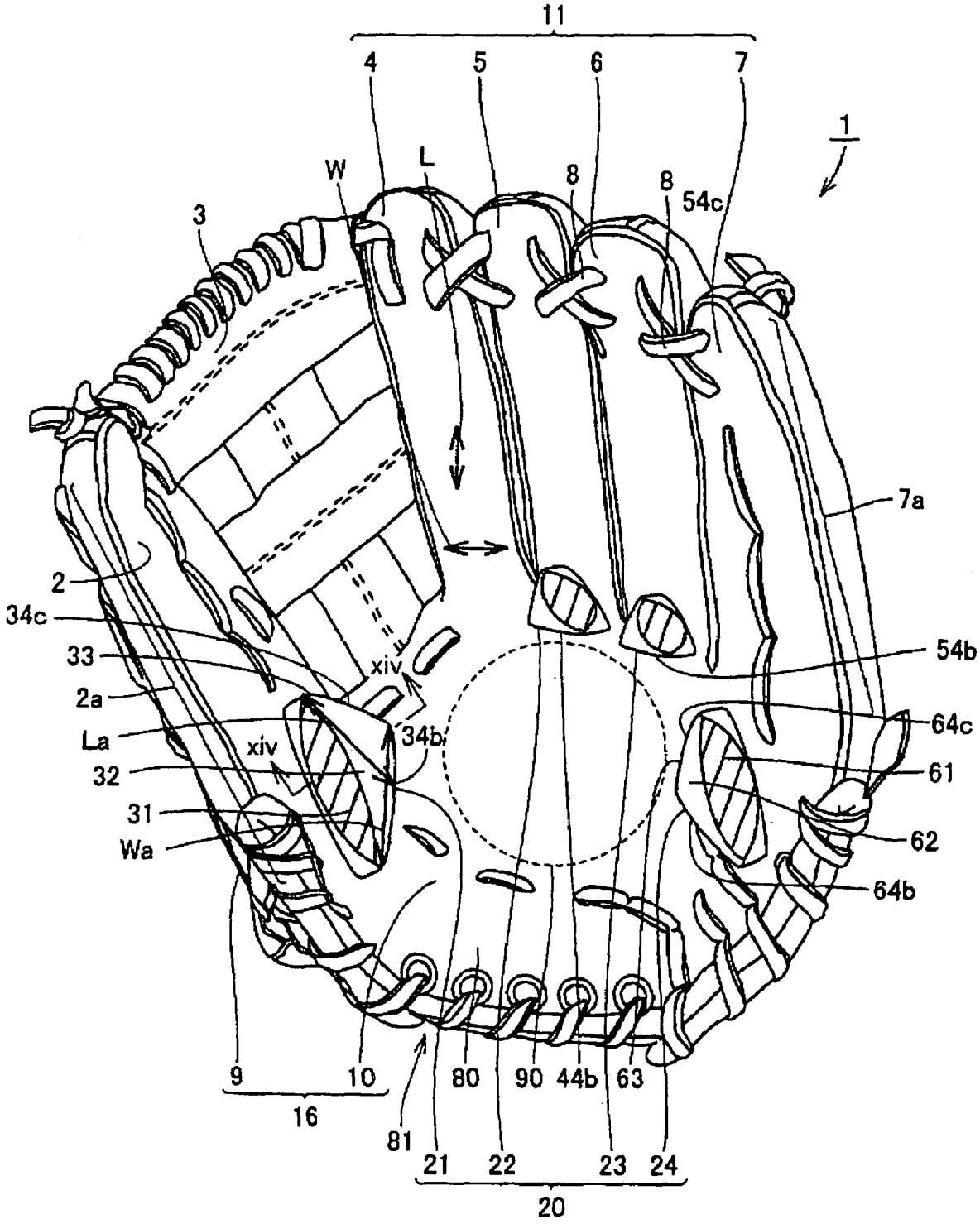

As can be seen from FIG. 9, the distance of movement of the thumb and the ring finger is the longest, that is, 26.6 mm. Therefore, when the sum of height of ball catching assisting portion 21 for the thumb and the height of ball catching assisting portion 22, 23 or 24 for the middle finger, ring finger or little finger exceeds 26.6 mm, it follows that when catching the ball with ball catching tool 1, the ball catching operation would be hindered by ball catching assisting portion 20. Therefore, the maximum value of the sum of height of ball catching assisting portion 21 for the thumb and the height of ball catching assisting portion 22, 23 or 24 for the middle finger, ring finger or little finger is set to be 26.6 mm. For detecting the position of each finger, using Microscribe-3DX of Immersion Corporation, spatial coordinates when ball catching tool 1 was open and when the catching tool grips a hardball were measured, and based on the measured spatial coordinates, distance of movement of each finger was calculated.

The maximum value Hmax of the sum of heights of ball catching assisting portions 22, 23 and 24 for the middle, ring and little fingers is set to be 26.6 mm when ball catching assisting portion 20 is adapted to include ball catching assisting portions 22, 23 and 24 for the middle, ring and little fingers, in order that ball catching assisting portion 20 does not hinder entrance of the ball. Similarly, the maximum value Hmax of the sum of heights of ball catching assisting portions 22 and 23 for the middle and ring fingers is set to be 26.6 mm when ball catching assisting portion 20 is adapted to include ball catching assisting portions 22 and 23 for the middle and ring fingers. Further, the maximum value Hmax of the sum of heights of ball catching assisting portion 21 and 22 for the thumb and the middle finger, and the maximum value Hmax of the sum of heights of ball catching assisting portion 21 and 23 for the thumb and the ring finger are each set to 26.6 mm, when ball catching assisting portion 20 is adapted to include ball catching assisting portions 21, 22 and 23 for the thumb and middle and ring fingers. Further, maximum height Hmax of ball catching assisting portion 21 for the thumb is set to 26.6 mm, when ball catching assisting portion 20 is adapted to include ball catching assisting portion 21 for the thumb only. Similarly, the maximum value Hmax of the heights of ball catching assisting portions 21 and 22 for the thumb and the middle finger is set to 26.6 mm, when ball catching assisting portion 20 is adapted to include ball catching assisting portions 21 and 22 for the thumb and the middle finger. With the height of ball catching assisting portion 20 set in such a manner, it is possible for the user to grip a hardball using the thumb and the ring finger. At this time, referring to FIG. 1, when ball catching assisting portion 20 includes ball catching assisting portions 21 and 23 for the thumb and the ring finger, the hardball would be pinched between upper surface 32 of ball catching assisting portion 21 for the thumb and upper surface 52 of ball catching assisting portion 23 for the ring finger. When ball catching assisting portion 20 does not include ball catching assisting portion 21 for the thumb as shown in FIG. 2, the hardball would be gripped between upper surface 52 of ball catching assisting portion 23 for the ring finger and the surface of ball catching surface skin 10 where thumb-stall 2 is positioned. Further, when ball catching assisting portion 20 does not include ball catching assisting portion 23 for the ring finger as shown in FIG. 6, the hardball would be gripped between upper surface 32 of ball catching assisting portion 21 for the thumb and the surface of ball catching surface skin 10 where ring-finger-stall 6 is positioned.

When the maximum value Hmax is set to 20.5 mm, the hardball may be gripped not only by the pattern using the thumb and the ring finger but also by the thumb and middle finger, when catching the ball, and therefore, the number of ball catching patterns can be increased. When the maximum value Hmax is set to 19.7 mm, a further pattern of gripping the hardball by the thumb and the little finger also becomes possible. Thus, it becomes possible to successfully grip the hardball, and the ball catching failure, that is, a so-called fumble, can be reduced.

For each of the sum of heights of ball catching assisting portions 21 and 22 for the thumb and the middle finger, the sum of heights of ball catching assisting portions 21 and 23 for the thumb and the ring finger and the sum of heights of ball catching assisting portions 21 and 24 for the thumb and the little finger, the minimum value Hmin is set to 6.15 mm. The minimum value Hmin is calculated, assuming that an experienced baseball player catches a hardball at a prescribed position where the caught hardball can be shifted to the other hand smooth, based on a difference in distance of finger movement Xs when the experienced baseball player catches the ball and the distance of finger movement D necessary for catching the ball in a time period t from when the hardball touches the ball catching tool until the ball reaches the prescribed position.

The prescribed position mentioned above is within reach of the finger of the user wearing ball catching tool 1, and assumed to be apart by a prescribed distance dmin, for example, 30 mm, from the surface of surface skin 16 at which a pocket portion 90 is positioned.

The time period t is calculated from the velocity Vb of hardball bouncing back from ball catching tool 1 and the prescribed distance dmin mentioned above. As the method of calculating the velocity Vb, the velocity Vb may be calculated based on the fact that even a beginner of baseball can catch the ball. In this case, the velocity Vb is calculated based on the time of ball catching T2*e* for the beginner to close ball catching tool 1, and the distance d of movement of the hardball within the time of ball catching T2*e*. Further, it is likely that a beginner may catch the hardball that bounces within ball catching tool 1 with tip portions of respective finger-stalls. Therefore, as the time of ball catching T2*e*, the longest time of ball catching (the longest among the times of ball catching by a beginner of baseball) is used. Among the time periods of ball catching by a beginner, the longest time of ball catching may come from catching with the tip portions of ball catching tool 1. Therefore, as the time Temax of closing ball catching tool 1 when a beginner catches ball with the tip portion of ball catching tool 1, the longest time of ball catching for a hardball of 40 km/h is used. Further, as the distance d of movement of the hardball, the maximum distance of movement dmax of the hardball from pocket portion 90 of ball catching tool 1 to immediately before slipping out from ball catching tool 1 is used. As the distance D of finger movement mentioned above, the distance Dm between the thumb and the middle finger is used. The reason for this is that at the time of catching a hardball, the hardball is substantially pinched between the thumb and the middle finger or between the thumb and the ring finger, while the distance Dm of finger movement between the thumb and the middle finger is smaller than the distance Dr between the thumb and the ring finger.

The distance Xs of finger movement when an experienced baseball player catches a ball is calculated from the time t mentioned above and the velocity Vfs of finger movement of the experienced player. In the present specification, the velocity Vfs is calculated from the minimum time of ball catching Tsmin of the experienced baseball player and the distance Dm of finger movement between the thumb and the middle finger.

Figure 7:
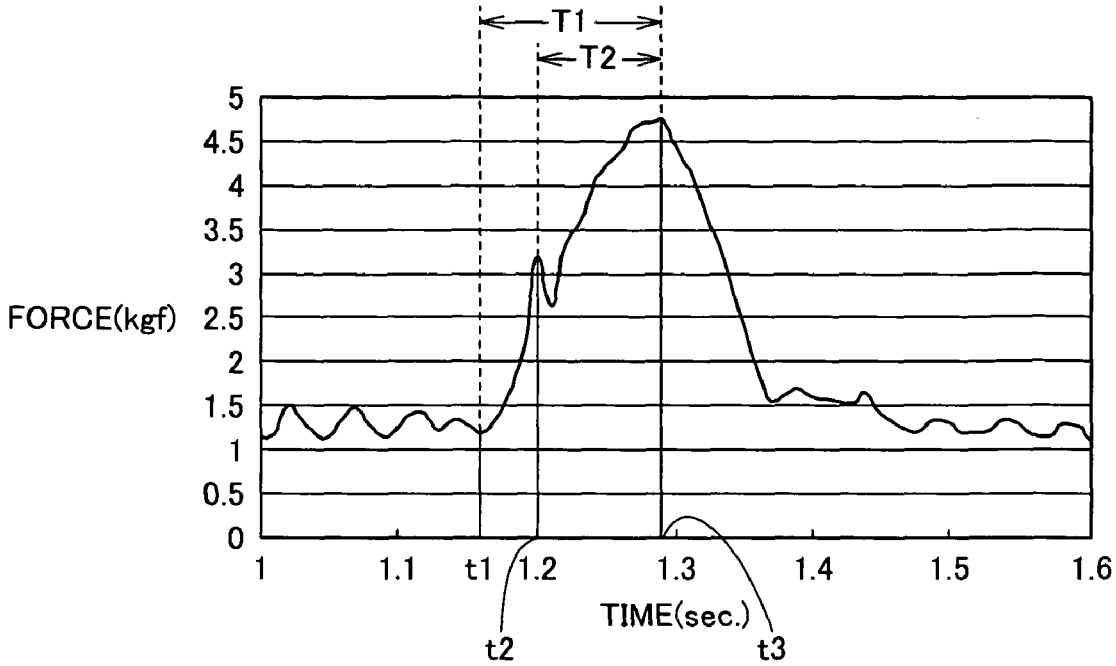
FIG. 7 is a graph representing a time period T2 from when a hardball hits the ball catching tool until the ball catching tool is closed.

FIG. 7 is a graph representing a time period T2 from when a hardball hits the ball catching tool until the ball catching tool is closed. The abscissa of the graph represents time and the ordinate represents force exerted on one's hand during the ball catching operation. The force exerted on one's hand is measured during a ball catching operation by a player wearing a common batting glove with a pressure sensor and further wearing ball catching tool 1 thereon, calculated as a total of forces exerted on respective fingers. The time t1 represents the time point when the wearer begins to apply force to his/her hand, and the time t2 represents the time point when the hardball hits ball catching tool 1. The time period between t2 to t3 represents the time period from when the hardball hits ball catching tool 1 until ball catching tool is closed, which corresponds to time T2 of ball catching. Time t3 represents the time point when the force on one's hand attains the maximum value. Here, the time period from when the force begins to act on the fingers until the force on one's hand attains the maximum value is represented by T1. The force exerted on one's hand is, specifically, measured using a thin type grip force distribution measurement system, by measuring pressure distribution on fingers in a baseball glove when catching a ball (Norikazu NINOMIYA et al., "Study on Pressure Distribution of Fingers in Baseball Glove at the Time of Ball Catching", collected papers [No. 00-38] of a symposium of The Japan Society of Mechanical Engineers, November 2000, pp. 17~20).

Table 10 below shows time of ball catching T2, when serious level players, that is, experienced baseball players and entry level players, that is, beginners, caught hardball of 40 km/h (in the unit of seconds).

TABLE 10

| | Tmin | Tmax | Tave |
|---|---|---|---|
| Serious level players | 0.05 (sec) (Tsmin) | 0.09 (sec) (Tsmax) | 0.07 (sec) (Tsave) |
| Entry level players | 0.08 (sec) (Temin) | 0.14 (sec) (Temax) | 0.11 (sec) (Teave) |

Tmin represents the shortest time of ball catching among (actual values of) the time of ball catching T2 when serious level players (15 players) and entry level players (10 players) caught hardball of 40 km/h. Tmax represents the longest time of ball catching among (actual values of) the time of ball catching T2 when catching the hardball of 40 km/h, and Tave represents the average time of ball catching T2 when catching the hardball of 40 km/h. Of the longest time of ball catching Tmax, the time of entry level players is represented as Temax, and the time of serious level players is represented as Tsmax.

Of the shortest time of ball catching Tmin, the time of entry level players is represented as Temin, and the time of serious level players is represented as Tsmin. Of the average time of ball catching Tave, the time of entry level players is represented as Teave, and the time of serious level players is represented as Tsave.

As shown in Table 10, the longest time of ball catching Temax of beginners, that is, entry level players is 0.14 seconds. The maximum distance of movement dmax represents the distance until the hardball slips out from ball catching tool 1, which is an actually measured value of 120 mm. Therefore, as the maximum distance of movement dmax, 120 mm is used. Accordingly, the velocity Vb mentioned above can be calculated from dmax/Temax. The time for a bounced hardball to reach the prescribed position described above can be calculated as dmin/Vb, assuming that dmin=30 (mm).

The time Tsmin is, as shown in Table 10, 0.05 seconds and the distance of finger movement Dm is 20.5 mm. Therefore, the velocity Vfs for an experienced baseball player to close ball catching tool 1 can be calculated from Dm/Tsmin. Therefore, the distance Xs for the experienced player to close ball catching tool 1 within the time period t mentioned above can be calculated by t×Dm/Tsmin. The minimum value Hmin of the sum of height of ball catching assisting portion 21 for the thumb and the height of any of ball catching assisting portions 22, 23 and 24 for the middle, ring and little fingers is calculated as Dm−Xs. Here, there is the following relation: Hmin=Dm−Xs=Dm−t×Dm/Tsmin=Dm−(dmin/Vb)×Dm/Tsmin=Dm−(dmin/(dmax/Temax))×Dm/Tsmin=Dm−Dm/Tsmin×dmin/dmax×Temax=20.5−20.5/0.05×30/120×0.14=6.15 (mm). Therefore, by making the sum of height of ball catching assisting portion 21 for the thumb and the height of any of ball catching assisting portions 22, 23 and 24 for the middle, ring and little fingers to be 6.15 mm, it becomes possible for an experienced player to pinch the hardball using the thumb and the middle finger at a position that allows easy shifting of the hardball. When the hardball is pinched by ball catching assisting portions 21 and 22 for the thumb and the middle finger, the hardball is pinched between upper surface 32 of ball catching assisting portion 21 for the thumb and upper surface 42 of ball catching assisting portion 22 for the middle finger.

For calculating the minimum value Hmin mentioned above, in the process of calculating the velocity of an experienced player for closing the fingers, the shortest time. Tsmin of the ball catching time of experienced players and the distance of finger movement Dm between the thumb and the middle finger are used. The combination, however, is not limited thereto. Specifically, any of the values Dm, Dr, Dl may be used as the distance of finger movement, and any of the values Tsmin, Tsave and Tsmax may be used as the time of ball catching by experienced baseball players. Therefore, there are nine possible minimum values Hmin.

By way of example, in calculating the minimum value Hmin described above, the distance Dm of the thumb and the middle finger is used as the distance D of finger movement necessary for catching the ball. This is, however, not limiting and the value may be calculated based on the distance Dr of movement of the thumb and the ring finger. In that case, the value will be Hmin=Dr−Xs=Dr−Dr/Tsmin×dmin/dmax×Temax=26.6−26.6/0.05×30/120×0.14=7.98 (mm). Therefore, by setting the value Hmin to 7.98 (mm), it becomes possible for an experienced player to catch the hardball using ball catching assisting portions 21 and 22 for the thumb and the middle finger or using ball catching assisting portions 21 and 23 for the thumb and the ring finger, at a position that allows easy shifting of the hardball.

Further, the minimum value Hmin mentioned above is calculated based on the shortest time of ball catching Tsmin among the time of ball catching T, by experienced baseball players. The value, however, may be calculated based on the longest time Tsmax. In this case, the value will be Hmin=Dm−Xs=Dm−Dm/Tsmax×dmin/dmax×Temax=20.5−20.5/0.09×30/120×0.14=12.5 (mm). Here, by setting the value Hmin to 12.5 (mm), it becomes possible even for an experienced player slow in ball catching operation to catch the hardball at a position that allows easy shifting of the hardball.

The minimum value Hmin described above is calculated based on the shortest Tsmin of the time T of ball catching by experienced baseball players. It may, however, be calculated based on the average Tsave among the ball catching time T of experienced baseball players. In that case, Hmin will be 10.3 (mm). Here, it becomes possible for an experienced baseball player with average ball catching time to catch the hardball at a position that allows easy shifting of the hardball.

Alternatively, the value Hmin described above may be calculated using the distance of movement Dr of the thumb and the ring finger as the necessary distance D of finger movement for ball catching and using Tsave in place of Tsmin. In that case, the value will be Hmin=Dr−Xs=Dr−Dr/Tsave×dmin/dmax×Temax=26.6−26.6/0.07×30/120×0.14=13.3 (mm). Here, it becomes possible for an experienced baseball player with average ball catching time to catch the hardball by ball catching assisting portions 21 and 22 for the thumb and the middle finger, or by ball catching assisting portions 21 and 23 for the thumb and the ring finger, at a position that allows easy shifting of the hardball.

The minimum value Hmin described above is calculated based on the shortest Tsmin of the time T of ball catching by experienced baseball players. It may, however, be calculated based on the average Teave among the ball catching time T by beginners of baseball. In that case, the value will be Hmin=Dm−Xs=Dm−Dm/Teave×dmin/dmax×Temax=20.5−20.5/0.08×30/120×0.14=11.5 (mm). Here, it becomes possible even for a beginner to catch the hardball at a position that allows easy shifting of the hardball, if he/she is quick in ball catching.

Specifically, by setting the maximum value Hmax and minimum value Hmin in the above-described manner, it becomes possible to grip the hardball at a position that allows easy shifting of the hardball, between the upper surfaces of ball catching assisting portion 20 or between the upper surface of ball catching assisting portion 20 and the surface of ball catching surface skin 10, with the ball catching assisting portion 20 not hindering the ball catching operation.

On the other hand, for a beginner of baseball to catch a ball in the same manner as an experienced player, the height of ball catching assisting portion 20 is set to a distance calculated from the difference between the distance α for the beginner to close the ball catching tool 1 within the ball catching time T2*s* of an experienced player and the distance D of finger movement necessary for catching the ball. The distance α is calculated from the velocity Vfe for the beginner to close ball catching tool 1 and the ball catching time T2*s* of an experienced player, and the velocity Vfe can be calculated from the distance D of finger movement necessary for catching the ball and the ball catching time T2*e* of the beginner of baseball.

Table 11 below shows time T1 of entire ball catching operation for entry level players, that is, beginners of baseball from when the force begins to act on each finger until the ball is fully caught, and time T2 of ball catching from when a hardball hits ball catching tool 1 until ball catching is complete. Values T1 and T2 are average values of measurements of serious level players (15 players) and entry level players (10 players), represented in the unit of the seconds.

TABLE 11

| | T1 | T2 |
|---|---|---|
| Serious level players | 0.14 (sec.) (T1s) | 0.07 (sec.) (T2s) |
| Entry level players | 0.18 (sec.) (T1e) | 0.11 (sec.) (T2e) |
| Time difference | 0.04 (sec.) | 0.04 (sec.) |

Here, T1*s* represents the time for the entire ball catching operation of serious level players, that is, experienced baseball players, from when the force begins to act on the fingers until the ball is fully caught. The value T1*e* represents the time for the entire ball catching operation of entry level players, that is, beginners of baseball, from when the force begins to act on the fingers until the ball is fully caught. The value T2*s* represents time from when the hardball hits ball catching tool 1 until the experienced players finish ball catching, and T2*e* represents time from when the hardball hits ball catching tool 1 until the beginners finish ball catching.

As shown in Table 11, the time T2*s* of ball catching by experienced baseball players is 0.07 seconds, while the time T2*e* of ball catching by beginners of baseball is 0.11 seconds. It is noted that the time T2*s* of ball catching is the average of ball catching time by experienced baseball players, and hence it is the same as the average ball catching time Tsave of Table 10 above, and the time T2*e* of ball catching is the same as the average ball catching time Teave of Table 10 above.

The distance D of finger movement corresponds to Dm for the thumb and the middle finger, Dr for the thumb and the ring finger, and Dl for the thumb and the little finger. Therefore, the distance α mentioned above can be calculated by α=(D (any of Dm, Dr and Dl)/T2*e* (closing time of entry level players))× T2*s* (closing time of serious level players). Therefore, the sum Hm of the heights of ball catching assisting portions 21 and 22 for the thumb and the middle finger becomes Hm=Dm−Dm/0.11×0.07=7.45 (mm). The sum Hr of the heights of ball catching assisting portions 21 and 23 for the thumb and the ring finger becomes Hr=Dr−Dr/0.11×0.07=9.67 (mm). Further, the sum Hl of the heights of ball catching assisting portions 21 and 24 for the thumb and the little finger becomes Hl=Dl−Dl/0.11×0.07=7.16 (mm). Exemplary values of Hr, Hm and Hl satisfying the above-described relation are as follows: the height of ball catching assisting portion 21 for the thumb is 4 mm, the height of ball catching assisting portion 22 for the middle finger is 3.45 mm, the height of ball catching assisting portion 23 for the ring finger is 5.67 mm, and the height of ball catching assisting portion 24 for the little finger is 3.16 mm.

Among the values Hm, Hr and Hl, Hr is the maximum, and therefore, it is preferred to set the sum of height of ball catching assisting portion 21 for the thumb and the height of any of ball catching assisting portions 22, 23 and 24 for the middle finger, ring finger and little finger to at least 9.67 (mm). In this case, it is possible for a beginner of baseball to catch a hardball in the similar manner as an experienced baseball player, no matter in any pattern he/she catches the ball, that is, using the thumb and the middle finger, the thumb and the ring finger or the thumb and the little finger.

A hardball and a rubber ball have different coefficients of restitution, and therefore, it is necessary to set the height H of ball catching assisting portion 20 taking into consideration the ratio E (=Er/Eh) between the coefficient of restitution Er of a rubber ball and the coefficient of restitution Eh of a hard ball, for catching a rubber ball. Specifically, the velocity Vh of a hardball that touches and bounces back from ball catching tool 1 and the velocity Vr of a rubber ball bouncing back satisfy the relation of Vr=Vh×E. Therefore, the time Tr of ball catching necessary for catching a rubber ball and the time Th of ball catching necessary for catching a hardball has the relation of Tr=Th/E.

Therefore, the distance Dtr of finger movement within ball catching time Tr is calculated as Dtr=D (distance of finger movement necessary for catching a ball)/E. Therefore, in order that an experienced baseball player catches a rubber ball with the same feeling as the experienced baseball player to catch a hardball, the height of ball catching assisting portion 20 must be set to a prescribed height Htr. The prescribed height Htr is defined as Htr=D (distance of finger movement necessary for catching a ball)−Dtr=D−D/E.

Table 12 below shows coefficients of restitution measured by hitting an iron plate, on which sorbothane having shock absorption ratio close to that of a human body and two sheets of leather are adhered, with hardballs and rubber balls with various velocities pitched by a pitching machine. As the hardballs, 2OH-110 (for collage baseball) manufactured by Mizuno Corporation, and as the rubber balls, KENKO-ball A manufactured by Nagase Kenko corporation were used for the measurement.

TABLE 12

Velocity dependence of restitution coefficients (sorbothane + leather)

| Hardball | | Rubber ball | |
|---|---|---|---|
| Velocity (Km/h) | Restitution coefficient | Velocity (Km/h) | Restitution coefficient |
| 109.0 | 0.441 | 104.3 | 0.459 |
| 112.1 | 0.442 | 106.5 | 0.459 |
| 111.0 | 0.439 | 106.7 | 0.450 |

TABLE 12-continued

| Velocity dependence of restitution coefficients (sorbothane + leather) | | | |
|---|---|---|---|
| Hardball | | Rubber ball | |
| Velocity (Km/h) | Restitution coefficient | Velocity (Km/h) | Restitution coefficient |
| 89.0 | 0.456 | 76.3 | 0.533 |
| 89.1 | 0.450 | 76.4 | 0.532 |
| 66.3 | 0.460 | 77.2 | 0.536 |
| 66.2 | 0.460 | 65.3 | 0.587 |
| 65.9 | 0.462 | 65.8 | 0.581 |
| 45.1 | 0.416 | 65.9 | 0.572 |
| 40.5 | 0.478 | 43.9 | 0.659 |
| 41.4 | 0.454 | 45.5 | 0.644 |
| | | 45.8 | 0.641 |

Figure 8:
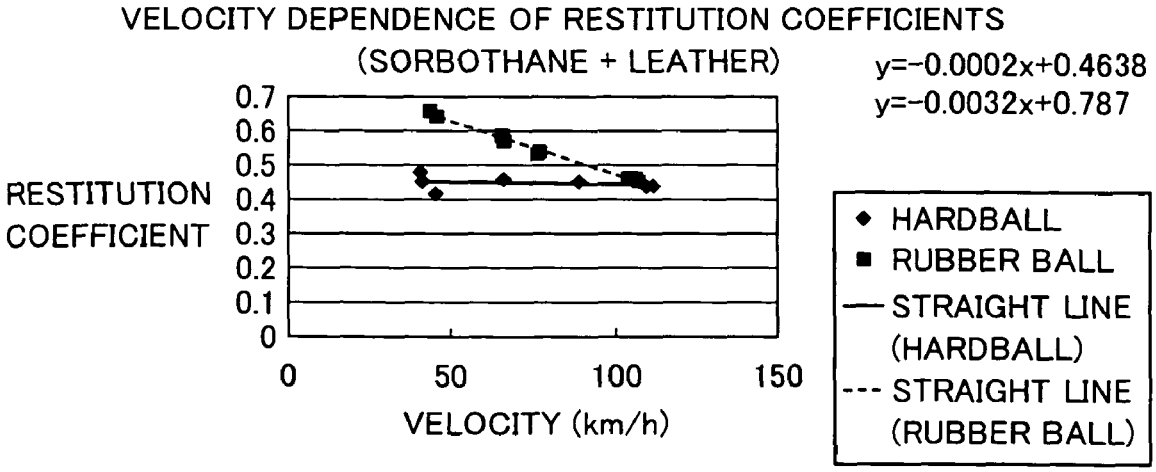
FIG. 8 is a graph representing coefficients of restitution of a rubber ball and a hardball, when sorbothane and leather are adhered on an iron plate.

FIG. 8 plots the data shown in Table 12 above, in which the ordinate (y-axis) represents the coefficient of restitution and the abscissa (x-axis) represents the velocity Vn (km/h) of entrance. As shown in FIG. 8, the coefficient of restitution Eh of a hardball is Eh=−0.0002×Vn+0.464. The coefficient of restitution Er of a rubber ball is Er=−0.0032×Vn+0.787. When the velocity Vn of entrance is 40 km/h, the coefficient of restitution Eh of a hardball is 0.456, the coefficient of restitution Er of a rubber ball is 0.659, and the ratio E of coefficients of restitution Er and Eh of a rubber ball and a hardball is 1.45. When the velocity Vn of entrance is 100 km/h, the coefficient of restitution Eh of a hardball is 0.444, the coefficient of restitution Er of a rubber ball is 0.467, and the ratio of coefficients of restitution Er and Eh of a rubber ball and a hardball is 1.05.

As the actual velocity of ball hitting is about 40 km/h, the value calculated by using the velocity of entrance Vn of 40 km/h is used as the ratio E of coefficients of restitution Er and Eh of a rubber ball and a hardball, that is, E=1.45. The prescribed height Htr mentioned above is calculated as Htr=D−D/E, and therefore, the sum Htrm of heights of ball catching assisting portions 21 and 22 for the thumb and the middle finger is Htrm=20.5−20.5/1.45=6.36 (mm). The sum Htrr of heights of ball catching assisting portions 21 and 23 for the thumb and the ring finger is Htrr=26.6−26.6/1.45=8.26 (mm). Further, the sum Htrl of heights of ball catching assisting portions 21 and 24 for the thumb and the little finger is Htrl=19.7−19.7/1.45=6.11 (mm). When the values Htrm, Htrr and Htrl satisfy the relation above, it becomes possible for an experienced baseball player to catch a rubber ball with the same feeling as catching a hardball. Ball catching tool 1 in which, by way of example, ball catching assisting portions 21, 22, 23 and 24 have the height of 3 mm, 3.36 mm, 5.26 mm and 3.11 mm, respectively, satisfies the relation of Htrm, Htrr and Htrl above.

Among the values Htrm, Htrr and Htrl, Htrr is the maximum, and therefore, it is preferred to set the sum of height of ball catching assisting portion 21 for the thumb and the height of any of ball catching assisting portions 22, 23 and 24 for the middle finger, ring finger and little finger to at least 8.26 (mm). In that case, it is possible for an experienced baseball player to catch a rubber ball with the same feeling as catching a hardball.

In order that a beginner of baseball catches a rubber ball with the same feeling as an experienced baseball player catching a hardball, the height of ball catching assisting portion 20 must be set to a prescribed height Htr'.

In order to calculate the prescribed height Htr', first, the height Hltr' of ball catching assisting portion 20 for "a beginner of baseball to catch a hardball" with "the same feeling as an experienced baseball player catching a hardball" is calculated. Then, using the ratio between the coefficients of restitution of the rubber ball and the hardball, the height Hltr' of ball catching assisting portion 20 for "a beginner of baseball to catch a hardball with the same feeling as an experienced baseball player catching a hardball" is converted to the height Htr' of ball catching assisting portion 20 for "a beginner of baseball to catch a rubber ball with the same feeling as an experienced baseball player catching a hardball."

Here, the height Hltr' of ball catching assisting portion 20 can be calculated from D (distance of finger movement for catching a hardball)−Dltr' (distance of finger movement of a beginner of baseball in ball catching time T2 of experienced baseball player for catching a hardball).

When the calculated height Hltr' of ball catching assisting portion 20 is converted to Htr', it is necessary to take into consideration that the time for the beginner to be able to move his/her finger becomes shorter, as a rubber ball tends to bounce stronger than a hardball. Thus, the height Htr' of ball catching assisting portion 20 is calculated as Htr'=D−Dltr'/E.

The value Hltr' above is calculated as Hltr'=D−D/T2*e*×T2*s*. Therefore, Htr'=D−Dltr'/E=D−D/T2*e*×T2*s*/E.

Consequently, the sum Htrm' of heights of ball catching assisting portions 21 and 22 for the thumb and the middle finger becomes Htrm'=20.5−20.5/0.11×0.07/1.45=11.5 (mm). The sum Htrr' of heights of ball catching assisting portions 21 and 23 for the thumb and the ring finger becomes Htrr'=26.6−26.6/0.11×0.07/1.45=14.9 (mm). Further, the sum Html' of heights of ball catching assisting portions 21 and 24 for the thumb and the little finger becomes Htrl'=19.7−19.7/0.11×0.07/1.45=11.1 (mm). By way of example, ball catching assisting portions 21, 22, 23 and 24 for the thumb, middle finger, ring finger and little finger having the heights of 6 mm, 5.50 mm, 8.93 mm and 5.05 mm, respectively, satisfy the relation of Htrm', Htrr' and Htrl' described above. Among the values Htrm', Htrr' and Htrl' above, Htrr' is the maximum, and therefore, the sum of height of ball catching assisting portion 21 for the thumb and the height of any of ball catching assisting portions 22, 23 and 24 for the middle finger, ring finger and little finger should preferably be set to at least 14.9 (mm). In that case, it becomes possible for a beginner of baseball to catch a rubber ball with the same feeling as an experienced baseball player catching a hardball.

Referring to FIG. 1, ball catching assisting portion 21 for the thumb is formed to have an approximately triangular shape when viewed from above, and tapered such that its width becomes gradually narrower from the root side to the tip end of thumb-stall 2. Further, ball catching assisting portion 21 for the thumb has an inclined surface 31 that becomes gradually higher from the side of side surface 2*a* of thumb-stall 2 toward pocket portion 90, on the side of edge 80.

FIG. 9 is a perspective view showing in detail the ball catching assisting portion 21 for the thumb. As shown in FIG. 9, ball catching assisting portion 21 for the thumb includes an upper surface 32, and a peripheral surface 33 formed around upper surface 32. Upper surface 32 is formed to have an approximately triangular shape when viewed from above, and includes the inclined surface 31 formed on the bottom side, and a flat surface 32*a* formed on the side closer to vertex portion 35 than inclined surface 31. Peripheral surface 33 includes a peripheral surface 33*a* adjacent to the bottom side portion of upper surface 32, a peripheral surface 33*b* adjacent to one side portion, and a peripheral surface 33*c* adjacent to the other side portion.

At the boundary between peripheral surface 33*b* and upper surface 32, a ridge portion 34*b* is formed, and at the boundary between peripheral surface 33*c* and upper surface 32, a ridge portion 34*c* is formed. Ridge portion 34*b* extends in a direction crossing ridge portion 34*c*. In the present embodiment, upper surface 32 of ball catching assisting portion 21 for the thumb is formed approximately as an isosceles triangle with a right angle, and ridge portion 34*c* is approximately orthogonal to ridge portion 34*b*. Here, the ridge portion is formed by intersection of two flat or curved surfaces having normals of different directions, that is, formed by intersecting points between the two surfaces extending as a straight or curved line, at the boundary between the two surfaces.

Here, the meaning of "ridge" includes not only the intersecting line of two surfaces but also a curved surface positioned at the boundary region of the two surfaces and providing smooth connection of the two surfaces. The surface means both flat surface and curved surface. FIGS. 73 and 74 are illustrations clarifying the meaning of the ridge, and as shown in FIG. 73, the ridge includes the intersecting line R, that is the straight line shared by a flat surface U and a flat surface S. Though an intersecting line between two flat surfaces is shown in FIG. 73, it is not limiting, and the ridge may include an intersecting line between a flat surface and a curved surface as in the case where at least one of the surfaces U and S is a curved surface, or between curved surfaces. Further, as shown in FIG. 74, the meaning of ridge includes a curved surface. R positioned at the boundary region of flat surfaces U and S and providing smooth connection of the two surfaces. It is noted, however, that in the present specification, the curved surface as the ridge means a curved surface of which radius of curvature is smaller than 3 mm.

Referring to FIG. 9, upper surface 32 has flat surface 32*a* on the side of pocket portion 90, and therefore, when a ball is gripped by using ball catching assisting portion 21 for the thumb, the ball can be gripped firmly by flat surface 32*a*. Inclined surface 31 is inclined such that the height thereof gradually increases from the bottom side to the side of vertex portion 35. Further, inclined surface 31 is a convex curved surface sinking toward vertex portion 35, conforming to the ball surface. Further, inclined surface 31 is formed such that the width in the direction crossing the bottom side gradually increases from an end portion to the central potion of the bottom side. Therefore, thickness in the height direction of the boundary portion between inclined surface 31 and peripheral surface 33*a* becomes gradually thinner from the end portion to the central portion of the bottom side. Of the boundary between inclined surface 31 and peripheral surface 33*a*, the central portion is formed to be the thinnest. On a lower surface of ball catching assisting portion 21 for the thumb, an outlet seam 37 is formed along an outer peripheral portion of peripheral surface 33 and protruded outward.

Here, referring to FIG. 1, a hole, not shown, is opened in the surface of ball catching surface skin 10, at a root portion of thumb-stall 2. Ball catching assisting portion 21 for the thumb is inserted to the hole formed in the surface of ball catching surface skin 10, and ball catching surface skin 10 and outlet seam 37 are sewn together. Thus, ball catching assisting portion 21 for the thumb is sewn and fixed on ball catching surface skin 10. Peripheral surface 33 and upper surface 32 of ball catching assisting portion 21 for the thumb protrude from the surface of ball catching surface skin 10. In FIG. 1, it is arranged on ball catching tool 1 with bottom side portion facing edge portion 80. Therefore, inclined surface 31 of ball catching assisting portion 21 for the thumb is arranged facing the side surface 2*a* of thumb-stall 2 on edge portion 80, with its height gradually increasing from the side of side surface 2*a* to pocket portion 90. Therefore, even when a ball comes in from the side of side surface 2*a* of thumb-stall 2 to pocket portion 90, contact of ball catching assisting portion 21 for the thumb and the ball is suppressed. Further, ridge portion 34*b* extends along pocket portion 90 and ridge 34*c* extends toward the direction crossing ridge 34*b*, from the side of pocket portion 90 to the tip end of thumb-stall 2. Preferably, there is almost no step between ball catching surface skin 10 and a portion near the central portion of the boundary between inclined surface 31 and peripheral surface 33*a*, so that the portion near the central portion of inclined surface 31 and ball catching surface skin 10 are continued smooth.

The width Wa of ball catching assisting portion 21 in the direction along the root portion of thumb-stall 2 (width in the width direction of thumb-stall 2) is larger than the width La in the direction from the root portion to the tip end of thumb-stall 2 (width in the longitudinal direction of thumb-stall 2). Therefore, it is likely that the ball entering pocket portion 90 is caught by ridge portion 34*b*. Here, the width direction of index-finger-stall 4 refers to the direction along the root portion of index-finger-stall 4, that is, the direction of an arrow W in FIG. 1, and the longitudinal direction refers to the direction from the root portion to the tip end side of index-finger-stall 4, that is, the direction of an arrow L. Directions are similarly defined for other finger-stalls.

FIG. 40 is a plan view of ball catching assisting portion 21 for the thumb. As shown in FIG. 40, at the boundary of ridge portion 34*a* that is the intersecting line between inclined surface 31 and peripheral surface 33*a* and the ridge portion 34*b*, a vertex portion 35*a* is formed, which is an intersecting point of ridge portions 34*a* and 34*b*. Similarly, at the boundary between ridge portions 34*c* and 34*a*, a vertex portion 35*b* is formed, which is an intersecting point of ridge portions 34*c* and 34*a*. Further, at the boundary between ridge portions 34*c* and 34*b*, vertex portion 35 is formed, which is an intersecting point of ridge portions 34*c* and 34*b*. Specifically, ball catching assisting portion 21 for the thumb has a triangular shape consisting of three vertexes and three sides, when viewed from above. FIG. 75 is a cross-sectional view showing, in enlargement, a portion of ball catching assisting portion 21 for the thumb. In FIG. 75, peripheral surface 33*a* arranged along pocket portion 90 shown in FIG. 1 forms an angle $\alpha$ with ball catching surface skin 10 in the range of about 80° to about 120°, and preferably about 85° to about 95°. By setting the angle between peripheral surface 33*b* and ball catching surface skin 10 as described above, it becomes more likely that the ball is caught by ridge portion 34*b*.

Though the width Wa of ball catching assisting portion 21 for the thumb is made larger than the width La, it is not limiting. By way of example, the width Wa of ball catching assisting portion 21 for the thumb may be the same as the width La, or the width La may be made larger than Wa. By making the width La of ball catching assisting portion 21 for the thumb larger than the width Wa, it becomes possible to firmly catch the ball at ridge portion 34*c* when catching the ball at web portion 3.

Ball catching assisting portions 22, 23 and 24 for the middle finger, ring finger and the little finger are formed in the similar manner as ball catching assisting portion 21 for the thumb. FIG. 10 is a perspective view showing in detail the ball catching assisting portion 22 for the middle finger, FIG. 11 is a perspective view showing in detail the ball catching assisting portion 23 for the ring finger, and FIG. 12 is a perspective view showing in detail the ball catching assisting portion 24 for the little finger. As shown in FIGS. 10 to 12, ball catching assisting portions 22, 23 and 24 for the middle finger, ring finger and little finger have upper surfaces 42, 52 and 62 of approximately triangular shape when viewed from above, and peripheral surfaces 43, 53 and 63 arranged around upper surfaces 42, 52 and 62. Upper surfaces 42, 52 and 62 include inclined surfaces 41, 51 and 61, and flat surfaces 42*a*, 52*a* and 62*a* formed closer to the vertex portions 45, 55 and 65 than inclined surfaces 41, 51 and 61. Peripheral surfaces 43, 53 and 63 include peripheral surfaces 43*a*, 53*a* and 63*a* adjacent to the bottom side portion of upper surfaces 42, 52 and 62, peripheral surfaces 43*b*, 53*b* and 63*b* adjacent to one side, and peripheral surfaces 43*c*, 53*c* and 63*c* adjacent to the other side.

At the boundary between peripheral surfaces 43*b*, 53*b* and 63*b* and upper surfaces 42, 52 and 62, ridge portions 44*b*, 54*b* and 64*b* are formed, and at the boundary between peripheral surfaces 43*c*, 53*c* and 63*c* and upper surfaces 42, 52 and 62, ridge portions 44*c*, 54*c* and 64*c* are formed. Ridge portions 44*c*, 54*c* and 64*c* are arranged to extend from the tip end side of middle-finger-stall 5, ring-finger-stall 6 and little-finger-stall 7 to the side of pocket portion 90.

Ridge portions 44*b*, 54*b* and 64*b* extend in a direction crossing ridge portions 44*c*, 54*c* and 64*c*. In the present embodiment, upper surfaces 42, 52 and 62 of ball catching assisting portions 22, 23 and 24 for the middle finger, ring finger and little finger are each formed approximately as an isosceles triangles with a right angle, and ridge portions 44*b*, 54*b* and 64*b* extend in a direction approximately orthogonal to the ridge portions 44*c*, 54*c* and 64*c*.

Inclined surfaces 41, 51 and 61 are formed to incline gradually upward from bottom side toward vertex portions 45, 55 and 65. Further, inclined surfaces 41, 51 and 61 are curved surfaces sinking toward the vertex portions 45, 55 and 65, conforming to the ball surface.

Inclined surfaces 41, 51 and 61 are formed toward a side surface 7*a* of little-finger-stall 7, on edge portion 80. Specifically, inclined surfaces 31, 41, 51 and 61 formed at respective ball catching assisting portions 20 are arranged such that their height increases gradually from the side of edge portion 80 to the side of pocket portion 90 of ball catching tool 1. The ball enters from the side of edge portion 80 of ball catching tool 1 and proceeds from edge portion 80 to pocket portion 90, and therefore, inclined surfaces 31, 41, 51 and 61 are arranged to be gradually higher from the entrance side along the traveling direction of the ball.

Further, inclined surfaces 41, 51 and 61 are formed such that the width in the direction crossing the bottom side increases gradually from the end portion to the central portion of the bottom side. Therefore, the thickness in the height direction at the boundary between inclined surfaces 41, 51 and 61 and peripheral surfaces 43*a*, 53*a* and 63*a* becomes gradually thinner from the end portion to the central portion of the bottom side. Of the boundary between inclined surfaces 41, 51 and 61 and peripheral surfaces 43*a*, 53*a* and 63*a*, the central portion is formed to be the thinnest.

Preferably, there is no step between ball catching surface skin 10 and the central portion of the boundary between inclined surfaces 41, 51 and 61 and peripheral surfaces 43*a*, 53*a* and 63*a*, so that the central portion of inclined surfaces 41, 51 and 61 and ball catching surface skin 10 are continued smooth.

Further, on a lower surface of ball catching assisting portions 22, 23 and 24 for the middle finger, ring finger and little finger, outlet seams 47, 57 and 67 are formed along an outer peripheral portion of peripheral surfaces 43, 53 and 63 and protruded outward.

FIG. 41 is a plan view of ball catching assisting portion 22 for the middle finger, and FIG. 42 is a plan view of ball catching assisting portion 24 for the little finger. As shown in FIG. 41, at the boundary of ridge portion 44*a* that is an intersecting line between inclined surface 41 and peripheral surface 43*a* and the ridge portion 44*b*, a vertex portion 45*a* is formed, which is an intersecting point of ridge portions 44*a* and 44*b*. Similarly, at the boundary between ridge portions 44*a* and 44*c*, a vertex portion 45*b* is formed, which is an intersecting point of ridge portions 44*a* and 44*c*. Further, at the boundary between ridge portions 44*b* and 44*c*, vertex portion 45 is formed, which is an intersecting point of ridge portions 44*b* and 44*c*. Specifically, similar to ball catching assisting portion 21 for the thumb, ball catching assisting portion 22 for the middle finger is also formed to have an approximately triangular shape. Referring to FIGS. 1 and 41, the width Lc of ball catching assisting portion 22 for the middle finger in the direction along the longitudinal direction of middle-finger-stall 5 is made larger than the width Wc in the direction along the width of middle-finger-stall 5. Therefore, it becomes more likely that the ball entering web portion 3 shown in FIG. 1 is caught by ridge portion 44*c* of ball catching assisting portion 22 for the middle finger. Further, by making the width Lc of ball catching assisting portion 22 for the middle finger larger than the width Wc, the distance that allows gripping of a ball entered and bounced back from pocket portion 90 becomes longer, and therefore, even when the ball catching operation starts late, it would be possible to grip the ball. Ball catching assisting portion 23 for the ring finger is formed in the similar manner as ball catching assisting portion 22 for the middle finger.

As shown in FIG. 42, ball catching assisting portion 24 for the little finger is also formed to have an approximately triangular shape when viewed from above, similar to ball catching assisting portions 21 and 22 for the thumb and the middle finger. Referring to FIGS. 1 and 42, the width Ld of ball catching assisting portion 24 for the little finger in the direction along the longitudinal direction of little-finger-stall 7 is made larger than the width Wd in the direction along the width of little-finger-stall 7. By making larger the width Ld of ball catching assisting portion 24 for the little finger as described above, the length of ridge portion 64*c* along the pocket portion 90 becomes longer, and it becomes easier to successfully catch the ball that enters pocket portion 90. The relation of width Ld and width Wd of ball catching assisting portion 24 for the little finger is not limited to that described above, and the width Wd may be the same as Ld, or the width Wd may be made larger than Ld. When the width Wd of ball catching assisting portion 24 is made larger than the width Ld, the distance allowing gripping of a ball entered and bounced back from pocket portion 90 can be made longer, and hence, the ball can be gripped successfully.

Here, referring to FIG. 1, holes, not shown, are opened in the surface of ball catching surface skin 10, at root portions of middle-finger-stall 5, ring-finger-stall 6 and little-finger-stall 7. Ball catching assisting portions 22, 23 and 24 for the middle finger, ring finger and little finger are inserted to the holes formed in the surface of ball catching surface skin 10, and ball catching surface skin 10 and outlet seams 47, 57 and 67 are sewn together. Thus, ball catching assisting portions 22, 23 and 24 for the middle finger, ring finger and little finger are sewn and fixed on ball catching surface skin 10. Peripheral surfaces 43, 54 and 63 and upper surfaces 42, 52 and 62 of ball catching assisting portions 22, 23 and 24 for the middle finger, ring finger and little finger protrude from the surface of ball catching surface skin 10.

As described above, ball catching tool 1 includes ball catching assisting portions 20 of which height from the highest position of the upper surface to ball catching surface skin 10 set in the above-described manner, and therefore, it assists the player in catching the ball, by supplementing the distance of finger movement.

On the other hand, by making the width La, Lc or Wd larger than the width Wa, Wc or Ld along the width direction for at least one of the ball catching assisting portions 20, the distance allowing gripping of the ball entering pocket portion 90 can be made longer, and even if ball catching operation started late, the ball would be successfully caught, without setting the height of each of the ball catching assisting portion 20 in the above-described manner.

Preferably, the width Wa is made larger than the width La of ball catching assisting portion 21 for the thumb. Further, at least one of ball catching assisting portions 22 and 23 for the middle finger and ring finger is provided, and the width Lc is set larger than the width Wc of the provided ball catching assisting portion 22 or 23 for the middle finger or the ring finger. By such setting, it becomes possible to catch the ball in pocket portion 90 by ridge portion 34*b* of ball catching assisting portion 21 for the thumb and, even when the ball catching operation delays, it is possible to catch the ball by ball catching assisting portion 22 or 23 for the middle finger or the ring finger.

FIG. 76 is a front view showing a modification of ball catching tool 1 shown in FIG. 1. As shown in FIG. 76, the width Wc of at least one of ball catching assisting portions 22 and 23 for the middle finger and ring finger may be made larger than the width Lc. By forming ball catching assisting portions 22 and 23 for the middle finger and ring finger in this manner, ball catching assisting portions 22 and 23 for the middle finger and ring finger can be made compact, and when the ball enters, entrance of the ball is not hindered by ball catching assisting portions 22 and 23 for the middle finger and ring finger. On the other hand, by setting the width Wc of ball catching assisting portions 22 or 23 for the middle finger or ring finger to be approximately the width of middle-finger-stall 5 and ring-finger-stall 6, it becomes possible to catch the ball by ridge portion 44*b* or 54*b*.

Ball catching assisting portions 22, 23 and 24 for the middle finger, ring finger and little finger are arranged such that ridge portions 44*b*, 54*b* and 64*b* face pocket portion 90. Therefore, it follows that pocket portion 90 is surrounded by ridge portion 34*b* of ball catching assisting portion 21 for the thumb, and ridge portions 44*b*, 54*b* and 64*c* of ball catching assisting portions 22, 23 and 24 for the middle finger, ring finger and little finger.

Therefore, in catching a ball with pocket portion 90, the ball is gripped by ridge portion 34*b* of ball catching assisting portion 21 for the thumb, and ridge portions 44*b*, 54*b* and 64*c* of ball catching assisting portions 20 other than ball catching assisting portion 21 for the thumb. Further, at this time, the ball is also pinched by upper surface 32 of ball catching assisting portion 21 for the thumb and upper surfaces 42, 52 and 62 of ball catching assisting portions 20 other than ball catching assisting portion 21 for the thumb. Specifically, when the ball is gripped, the stress generated between the ball and ball catching assisting portions 20 other than ball catching assisting portion 21 for the thumb is supported by the ridge 34*b* of ball catching assisting portion 21 for the thumb. Therefore, by making longer the ridge portion 34*b* of ball catching assisting portion 21 for the thumb than ridge portions 44*b*, 54*b* and 64*c* of ball catching assisting portions 20 other than ball catching assisting portion 21 for the thumb, it becomes possible to successfully support at ridge portion 34*b* the force applied by ridge portions 44*b*, 54*b* and 64*c* to the ball, and slipping of the ball can be suppressed.

Here, each of the ball catching assisting portions 20 has a prescribed height, and therefore, ridge portions 34*b*, 44*b*, 54*b* and 64*c* of respective ball catching assisting portions 20 arranged along pocket portion 90 are also formed at desired positions from the surface of ball catching surface skin 10. Thus, when ball catching assisting portion 20 is provided one at each of thumb-stall 2, middle-finger-stall 5, ring-finger-stall 6 and little-finger-stall 7, it is possible to hold the ball successfully by ridges 34*b*, 44*b*, 54*b* and 64*c* provided at respective ball catching assisting portions 20.

Though ball catching assisting portion 20 is formed to have a triangular shape as viewed from above in Embodiment 1, the shape is not limited. By way of example, FIG. 13 is a front view showing a modification of ball catching tool 1 in accordance with Embodiment 1, and as shown in FIG. 13, ball catching assisting portion 20 may have an approximately rectangular shape when viewed from above. When ball catching assisting portion 20 is adapted to have an approximately rectangular shape when viewed from above, the distance from the portion of each ball catching assisting portion 20 closest to pocket portion 90 to a portion furthest from pocket portion 90 can be made longer than when ball catching assisting portion 20 is formed to have a triangular shape, and hence, the section for holding the ball can be made larger. Therefore, the time necessary for the ball that touches ball catching surface skin 10 to pass over the upper surfaces of respective ball catching assisting portions 20 can be made longer, and hence, even if ball catching operation delays, the ball can successfully be gripped by ball catching assisting portions 20.

FIG. 43 is a plan view of ball catching assisting portion 21 for the thumb shown in FIG. 13. As can be seen from FIG. 43, ball catching assisting portion 21 for the thumb is formed to have an approximately rectangular shape, consisting of four ridge portions 34*a*1, 34*a*2, 34*c* and 34*b*, and vertexes 35*a*, 35*b*, 35 and 36 as intersecting points between each of ridge portions 34*a*1, 34*a*2, 34*c* and 34*b*. FIG. 44 is a plan view of ball catching assisting portion 22 for the middle finger, and FIG. 45 is a plan view of ball catching assisting portion 24 for the little finger. As can be seen from FIGS. 44 and 45, ball catching assisting portions 22 and 24 for the middle finger and little finger are also formed to have approximately rectangular shape when viewed from above, similar to ball catching assisting portion 21 for the thumb described above. Ball catching assisting portion 23 for the ring finger is also formed in the similar manner as other ball catching assisting portions 20.

Further, the vertex portion of each ball catching assisting portion 20 may be rounded. FIG. 46 is a front view of ball catching tool 1 including ball catching assisting portions 20, in which the vertex portion of each of the ball catching assisting portion 20 closest to pocket portion 90 is rounded. As shown in FIG. 46, among the vertexes of ball catching assisting portions 20, vertexes 35, 45, 55 and 65 that are closest to pocket portion 90 are rounded. By rounding vertexes 35, 45, 55 and 65 of ball catching assisting portions 20, even when the ball collides against vertex 35, 45, 55 or 65 during catching, the stress generated between the ball and the vertex 35, 45, 55 or 65 can be suppressed low, and hence, it is possible to suppress slipping of ball out from the ball catching tool 1.

FIG. 47 is a plan view of ball catching assisting portion 21 for the thumb having vertex 35 rounded. As can be seen from FIG. 47, vertex portion 35 formed at the boundary between ridge portions 34*c* and 34*b* has a curved shape that smoothly connects ridge portions 34*b* and 34*c* to each other. FIG. 48 is a plan view of ball catching assisting portion 22 for the middle finger having vertex 45 rounded, and FIG. 49 is a plan view of ball catching assisting portion 24 for the little finger having vertex 65 rounded. As can be seen from FIGS. 48 and 49, vertex portions 45 and 65 also have rounded, curved shape that smoothly connecting ridge portions 44*c* and 64*c* to ridge portions 44*b* and 64*b*, respectively. Ball catching assisting portion 23 for the ring finger is also formed in the similar manner as other ball catching assisting portions 20.

In FIGS. 47 and 1, it is assumed that vertex portion 35 is rounded. It is, however, not limiting. For instance, vertex portion 35*a* formed at the boundary between ridge portion 34*a* as an intersecting line between inclined surface 31 and peripheral surface 33*a* and ridge portion 34*b* arranged along pocket portion 90 may have a curved shape that smoothly connects ridge portions 34*b* and 34*a* to each other. By rounding vertex portions 35 and 35*a* positioned at opposite ends of ridge portion 34*b* arranged along pocket portion 90, even when the ball collides against vertex portion 35 or 35*a* during catching, it is possible to suppress slipping of ball out from the ball catching tool 1.

Further, vertex portion 35*b* positioned at the boundary between ridge portions 34*c* and 34*a* may also have a curved shape that smoothly connects ridge portions 34*c* and 34*a* to each other. By rounding vertex portion 35*b* as well, even when the ball collides against vertex portion 35*b* as the ball enters, the velocity of the ball going out from ball catching tool 1 can be reduced. Ball catching assisting portions 22, 23 and 24 for the middle finger, ring finger and little finger may also be formed in the similar manner.

FIG. 50 is a front view of ball catching tool 1 having ball catching assisting portions 20 having rectangular shape as viewed from above, of which vertex portions 35, 45, 55 and 65 that are positioned closest to pocket portion 90 are rounded. By this ball catching tool 1, similar to ball catching tool 1 shown in FIG. 46, it is possible to suppress the ball colliding against the vertex 35, 45, 55 or 65 of respective ball catching assisting portion 20 to be bounced back to the outside of ball catching tool 1, when the ball is to be gripped. FIG. 51 is a plan view of ball catching assisting portion 21 for the thumb shown in FIG. 50. As shown in FIG. 51, ball catching assisting portion 21 for the thumb has approximately rectangular shape when viewed from above, and vertex portion 35 positioned at the boundary between ridge portion 34*b* arranged along pocket portion 90 and ridge portion 34*c* has a curved shape that smoothly connects ridge portions 34*b* and 34*c* to each other. FIG. 52 is a plan view of ball catching assisting portion 22 for the middle finger shown in FIG. 50, and FIG. 53 is a plan view of ball catching assisting portion 24 for the little finger shown in FIG. 50. Ball catching assisting portions 22 and 24 for the middle finger and the little finger are also formed in the similar manner as ball catching assisting portion 21 for the thumb. Ball catching assisting portion 23 for the ring finger is also formed in the similar manner as other ball catching assisting portions 20.

The upper surface of ball catching assisting portion 20 provided on ball catching tool 1 in accordance with Embodiment 1 is adapted to have a flat surface. It is, however, not limiting. By way of example, the upper surfaces of ball catching assisting portions 20 may be entirely inclined. FIG. 54 is a front view of ball catching tool 1 including ball catching assisting portions 20 of which upper surfaces are inclined. Each ball catching assisting portion 20 is adapted to have an approximately triangular shape when viewed from above. Upper surfaces 32, 42, 52 and 62 of ball catching assisting portions 20 are inclined surfaces, of which height from the surface of ball catching surface skin 10 gradually decreases from the side of pocket portion 90 to the tip end side of thumb-stall 2, middle-finger stall 5, ring-finger-stall 6 and little-finger-stall 7 on which respective ball catching assisting portions 20 are provided. As upper surfaces 32, 42, 52 and 62 of ball catching assisting portions 20 are inclined in this manner, when a ball enters ball catching tool 1, contact between the ball and ball catching assisting portion 20 can be suppressed. Particularly when the ball enters from the tip end side of each finger-stall to pocket portion 90, contact between the ball and each ball catching assisting tool 20 can be suppressed.

FIG. 55 is a cross-sectional view of ball catching assisting portion 22 for the middle finger taken along the line LV-LV of FIG. 54. As shown in FIG. 55, upper surface 42 of ball catching assisting portion 22 for the middle finger is made flat, and at the boundary between upper surface 42 and peripheral surface 43*c* positioned on both sides of upper surface 42, ridge portion 44*c* as an intersecting line between upper surface 42 and peripheral surface 43*c*, is formed. The upper surface 42 is not limited to the flat surface as described above. FIG. 56 is a cross-sectional view showing a modification of ball catching assisting portion 22 for the middle finger shown in FIG. 55. As can be seen from FIG. 56, upper surface 42 may be formed to have a curved shape, with the central portion protruding upward. FIG. 57 is a cross-sectional view showing another modification of ball catching assisting portion 22 for the middle finger, and as can be seen from FIG. 57, peripheral surface 43*c* may be formed to have a curved shape. In that case, ridge portion 44*c* positioned at the boundary between peripheral portion 43*c* and upper surface 42 comes to have a curved surface that smoothly connects the peripheral surface 43*c* to upper surface 42. The radius of curvature of ridge portion 44*c* is set to be smaller than 3 mm. When ridge portion 44*c* is formed as a curved surface having the radius of curvature smaller than 3 mm, the ball is reliably caught by ridge portion 44*c* at the time of catching the ball.

FIG. 58 is a front view of ball catching tool 1 showing a modification of ball catching tool 1 shown in FIG. 54. As can be seen from FIG. 58, upper surface 32 of ball catching assisting portion 21 for the thumb is inclined with the height gradually decreasing from the side of ridge portion 34*c* extending from the root side of thumb-stall 2 to the tip end of thumb-stall 2, to the side of vertex portion 35*a* arranged near the edge portion 80 positioned on the side of opening 81. Further, upper surface 62 of ball catching assisting portion 64*c* for the little finger is inclined with the height gradually decreasing from the ridge portion 64*c* arranged along pocket portion 90 to vertex portion 65*a* arranged near the edge portion 80 positioned on the side of opening 81. As the upper surfaces 32 and 62 of ball catching assisting portions 21 and 24 for the thumb and the little finger are adapted to have lower height from the inner side to edge portion 80 of ball catching tool 1, ball catching assisting portions 21 and 24 for the thumb and the little finger do not hinder movement of the ball when the ball enters from the side of opening 80 into ball catching tool 1.

FIG. 59 is a front view of ball catching tool 1 showing a modification of ball catching tool 1 shown in FIG. 58. As can be seen from FIG. 59, upper portion 32 of ball catching assisting portion 21 for the thumb is inclined with the height gradually decreasing from the vertex portion 35 at the furthest position from side surface 2*a* of thumb-stall 2 to the side of side surface 2*a* of thumb-stall 2, to the tip end side of thumb-stall 2 and toward the edge portion 80 positioned on the side of opening 81. Peripheral portions of upper surface 32 on the side of side surface 2*a* and on the side of edge portion 80 are positioned on the surface of ball catching surface skin 10. Therefore, even when the ball enters from the side of side surface 2*a* of thumb-stall 2, from the tip end side of thumb-stall 2 or from the edge portion 80 of opening 81 into ball catching tool 1, contact between ball catching assisting portion 21 for the thumb and the ball is suppressed.

Further, the upper surface of ball catching assisting portion 24 for the little finger is also inclined with its height gradually decreasing from the vertex portion 65 closest to pocket portion 90 to the side of side surface 7*a* of little-finger-stall 7, to the tip end side of little-finger-stall 7 and toward the edge portion 80 positioned on the side of opening 81. Further, upper surfaces 42 and 52 of ball catching assisting portions 22 and 23 for the middle finger and ring finger are also inclined with their height gradually decreasing from the vertex portions 45, 55 furthest from the side surface 7*a* of little-finger-stall 7 to the side of side surface 7*a* of little-finger-stall 7, tip end portions of finger-stalls and toward the edge portion 80 positioned on the side of opening 81. Therefore, when the ball enters from the side of side surface 7*a* of little-finger-stall 7 or when the ball enters from the tip end side of little-finger-stall 7, ring-finger-stall 6 or middle-finger-stall 5, entrance of the ball is not hindered by ball catching assisting portions 22, 23 and 24 for the middle finger, ring finger and the little finger.

FIG. 60 is a cross-sectional view taken along the line LX-LX of FIG. 59, of ball catching assisting portion 22 for the middle finger.

As shown in FIG. 60, at the boundary between inclined upper surface 42 and peripheral surface 43*c*, there is a ridge portion 44*c* formed as an intersecting line between upper surface 42 and peripheral surface 43*c*. Ridge portion 44*c* may be formed as a curved surface that smoothly connects upper surface 42 and peripheral surface 43*c*. Ball catching assisting portions 21, 23 and 24 for the thumb, ring finger and little finger are also formed in the similar manner as ball catching assisting portion 22 for the middle finger.

FIG. 61 is a front view of ball catching tool 1 including ball catching assisting portions 20 formed to have approximately semi-conical shape. As can be seen from FIG. 61, ball catching assisting portion 20 is formed with its width along the width direction of each finger stall decreasing gradually from the root side of thumb-stall 2, middle-finger-stall 5, ring-finger-stall 6 or little-finger-stall 7, on which each ball catching assisting portion is provided, toward the tip end side of each finger stall. Further, the upper surface of each ball catching assisting portion 20 is inclined with its height gradually decreasing from the tip end side to the root of the finger stall on which respective ball catching assisting portion is provided.

FIG. 62 is a cross-sectional view taken along the line LXII-LXII of FIG. 61, of ball catching assisting portion 22 for the middle finger. As can be seen from FIG. 62, upper surface 42 of ball catching assisting portion 22 for the middle finger is curved with the central portion along the width direction protruded highest upward. The skirt of upper surface 42 is positioned on the upper surface of ball catching surface skin 10. In FIG. 61, other ball catching assisting portions 20 are also formed in the similar manner.

Therefore, upper surface 32 of ball catching assisting portion 21 for the thumb is inclined with its height increasing from the tip end portion of thumb-stall 2 to the side of pocket portion 90, and curved with its height increasing from the side of side surface 2*a* of thumb-stall 2 and the side of edge portion 80 of opening 81 to the inner side of ball catching tool 1.

Therefore, even when the ball enters from the tip end side or from the side of side surface 2*a* of thumb-stall 2, or from the side of edge portion 80 positioned on the side of opening 80, into ball catching tool 1, ball catching assisting portion 21 for the thumb does not hinder entrance of the ball. Specifically, entrance of the ball is not hindered by ball catching assisting portion 21 for the thumb no matter from which direction the ball comes into ball catching tool 1. Further, ball catching assisting portion 21 for the thumb has an approximately semi-circular peripheral surface 34 that stands straight from ball catching surface skin 10, on the side of the pocket portion 90. Ball catching assisting portions 24, 23 and 22 for the little finger, ring finger and middle finger are also adapted not to hinder the traveling of the ball even when the ball enters form the side of side surface 7*a* of little-finger-stall 7 or from the side of tip end portion of each finger stall.

Ball catching assisting portions 20 have ridge portions 34, 44, 54 and 64 as intersecting lines between upper surfaces 32, 42, 52 and 62 and peripheral surfaces 33, 43, 53 and 63, at the boundaries between upper surfaces 32, 42, 52 and 62 of curved shape and peripheral surfaces 33, 43, 53 and 63 arranged along pocket portion 90, so as to catch the ball that fits in pocket portion 90. Ridge portions 34, 44, 54 and 64 may be formed as curved surfaces that smoothly connect upper surfaces 32, 42, 52 and 62 to peripheral surfaces 33, 43, 53 and 63.

FIG. 63 is a cross-sectional view showing a modification of ball catching assisting portion 22 for the middle finger shown in FIG. 21. As shown in FIG. 63, upper surface 42 may consist of two inclined surfaces 42*a* and 42*b* that contact with each other at the central portion along the width direction of middle-finger-stall 6. At the boundary between inclined surfaces 42*a* and 42*b*, a ridge portion 49 as an intersecting line between inclined surfaces 42*a* and 42*b* is formed. As upper surface 42 is adapted to include a plurality of flat planes having different normal directions, at least one ridge portion 49 is formed on upper surface 42.

By forming upper surfaces of other ball catching assisting portions 20 in the similar manner, ridge portions 49 may be formed on upper surfaces of respective ball catching assisting portions 20.

As the ridge portion 49 is formed at the upper surface of each ball catching assisting portion 20, when the ball is pinched between ball catching assisting portions 20, the force on the fingers of the user is concentrated on the ridge portion 49 of each ball catching assisting portion 20, and hence, a large force could be exerted on the ball. Thus, it is possible to grip the ball successfully.

Ball catching assisting portion 20 may be adapted to have a circular or polygonal shape when viewed from above.

FIG. 64 is a front view of ball catching tool 1 including approximately elliptical ball catching assisting portion 20 formed with semi-circular opposite end portions protruded outward.

Ball catching assisting portion 21 for the thumb includes upper surface 32 formed to have opposite end portions protruded semi-circularly outward along the width direction of thumb-stall 2, and peripheral surface 33 positioned around the upper surface. The ridge portion, which is the intersecting line between upper surface 32 and peripheral surface 33 and positioned at the boundary between upper surface 32 and peripheral surface 33 includes ridge portion 34*b* arranged along pocket portion 90, ridge portion 34*a* arranged opposite to opposite end portion 34*b*, and ridge portion 34*c* smoothly connecting ridge portions 34*a* and 34*b* to each other and having a semi-circular shape with the radius of curvature larger than 3 mm. Specifically, upper surface 32 and peripheral surface 33 do not have any vertex portion of which radius of curvature is, for example, not larger than 3 mm. Therefore, even when the ball collides against ball catching assisting portion 21 for the thumb, the stress generated between the ball and ball catching assisting portion 21 for the thumb can be reduced, and hence, large bound of the ball can be suppressed. Ball catching assisting portions 22, 23 and 24 for the middle finger, ring finger and little finger are also formed in the similar manner.

FIG. 14 is a cross-sectional view taken along the line XIV-XIV of FIG. 1, and as shown in FIG. 14, ball catching assisting portion 21 for the thumb includes a protruded portion 21A protruded outward from a hole 10*a* formed in ball catching surface skin 10, and a base 21B formed to cover the surface of protruded portion 21A. In protruded portion 21, a recessed portion 21E is formed, that is, protruded portion 21A is formed to have a hollow shape, and lower surface of recessed portion 21E is opened outward. Protruded portion 21A is formed of a material different from ball catching surface skin 10. Protruded portion 21A is formed of a material having friction coefficient comparable to and preferably larger than that of ball catching surface skin 10. By way of example, it is formed of nylon, polyurethane, urethane, EVA (ethylene-vinyl acetate copolymer), VS-1 (tri-block copolymer of polystyrene and vinyl-polyisoprene), elastomer, rubber, silicone, PEF (foamed polyethylene) or sorbothane. Sorbothane is ether-based polyurethane containing polyol and MDI (diphenylmethane-diisocyanate) specially devised during designing molecular structure. Protruded portion 21A formed of such a material comes to have the hardness of at least 10A and at most 100A (JIS K 6253 indication), and preferable hardness is about 40A, with which the caught ball can be gripped firmly. Base 21B is formed of natural leather, artificial leather, polyurethane resin, unwoven fabric, woven fabric or knitting. Base 21B is arranged over upper surface 32 and peripheral surface 33 of protruded portion 21A, and base 21B is formed to extend outward at the lower end portion of protruded portion 21A.

Ball catching assisting portion 21 for the thumb is inserted to hole 10*a* from the back side of ball catching surface skin 10. Base 21B is sewn to ball catching surface skin 10. Specifically, outlet seam 37 shown in FIG. 9 is implemented by base 21B in Embodiment 1. The height H of ball catching assisting portion 21 for the thumb is defined as a distance from the surface of ball catching surface skin 10 to the upper surface 32 of ball catching assisting portion 21 for the thumb. If the upper surface 32 of ball catching assisting portion 21 for the thumb is curved or inclined, the distance between the highest position of upper surface 32 and the surface of ball catching surface skin 10 is defined as the height of ball catching assisting portion 21 for the thumb.

Further, ball catching assisting portion 21 for the thumb is sewn to ball catching surface skin 10 at base 21B. Therefore, when the ball is held, positional deviation or uplifting of ball catching assisting portion 21 for the thumb from ball catching surface skin 10 is suppressed. Thus, it is possible by ball catching assisting portion 21 for the thumb to firmly hold the ball in ball catching tool 1.

FIG. 15 is a cross-sectional side view showing a first modification of ball catching assisting portion 21 for the thumb. As can be seen from FIG. 15, ball catching assisting portion 21 for the thumb may include protruding portion 21A formed as a solid body, and base 21B formed at the bottom surface of protruded portion 21A.

Ball catching assisting portion 21 for the thumb is inserted to hole 10*a* from the back side of ball catching surface skin 10. Base 21B is sewn to ball catching surface skin 10. Specifically, outlet seam 37 shown in FIG. 9 is implemented by base 21B in ball catching assisting portion 21 for the thumb shown in FIG. 15.

FIG. 16 is a cross-sectional side view showing a second modification of ball catching assisting portion 21 for the thumb. As can be seen from FIG. 16, ball catching assisting portion 21 for the thumb may include protruded portion 21A formed as a hollow body, sponge 21C filled in the hollow portion of protruded portion 21A, base 21B arranged at the bottom surface of protruded portion 21A, and a leather 21D arranged to cover the surface of protruded portion 21A.

Leather 21D is arranged to cover upper surface 32 and peripheral surface 33 of protruded portion 21A, and formed to extend outward at the lower surface side of protruded portion 21A. On the lower surface side of leather 21D, base 21B is arranged. At the side of outer peripheral edge of leather 21D and base 21B, ball catching surface skin 10, leather 21D and base 21B are sewn together. Specifically, at this ball catching assisting portion 21 for the thumb, outlet seam 37 shown in FIG. 9 is implemented by leather 21D and base 21B.

FIG. 17 is a cross-sectional view showing a third modification of ball catching assisting portion 21 for the thumb. As can be seen from FIG. 17, ball catching assisting portion 21 for the thumb includes protruded portion 21A formed as a hollow body, and base 21B arranged at the bottom surface of protruded portion 21A. In protruded portion 21A, a recessed portion 21E is formed, and an opening edge of recessed portion 21E is adhered to base 21B.

Protruded portion 21A extends outward. The portion extending outward formed at the lower surface of protruded portion 21A and base 21B arranged at the lower surface of protruded portion 21A are sewn to ball catching surface skin 10. Specifically, in ball catching assisting portion 21 for the thumb shown in FIG. 17, outlet seam 37 shown in FIG. 9 is implemented by the portion extending outward formed at the lower surface of protruded portion 21A and base 21B.

Therefore, at ball catching assisting portion 21 for the thumb shown in FIG. 17, when opening of recessed portion 21E is about to deform to open wider, deformation of recessed portion 21E is suppressed by base 21B. Specifically, base 21B functions as a stopper suppressing deformation of the opening of recessed portion 21E to open wider, and suppresses deformation of protruded portion 21A.

Ball catching assisting portion 21 for the thumb shown in FIG. 14 has recessed portion 21E formed inside protruded portion 21A, and therefore, it is prone to deformation. Ball catching assisting portion 21 for the thumb shown in FIG. 15 has protruded portion 21A formed as a solid body, and hence, deformation is not likely. Ball catching assisting portion 21 for the thumb shown in FIG. 16 has recessed portion 21E, while elastic member such as sponge 21C is inserted to recessed portion 21E. Therefore, it is less susceptible to deformation than ball catching assisting portion 21 for the thumb shown in FIG. 14, and more susceptible to deformation than ball catching assisting portion 21 for the thumb shown in FIG. 15. In ball catching assisting portion 21 for the thumb shown in FIG. 17, base 21B functions as a stopper suppressing deformation of protruded portion 21A, and therefore, the structure is less susceptible to deformation than ball catching assisting portion 21 for the thumb shown in FIG. 14.

Therefore, by selecting any of the ball catching assisting portions 21 for the thumb shown in FIGS. 14 to 17 in accordance with the hardness of the material forming the ball catching assisting portion 21 for the thumb, it becomes possible to set the hardness of ball catching assisting portion 21 for the thumb to a prescribed value. Therefore, regardless of the material forming protruded portion 21A, by adopting any of the structures shown in FIGS. 14 to 17 for ball catching assisting portion 21 for the thumb, hardness of ball catching assisting portion 21 for the thumb can be set, for example, from at least 20 (A) to at most 40 (A). By similarly forming ball catching assisting portions 20 as ball catching assisting portion 21 for the thumb, the hardness of ball catching assisting portions 20 can be set to a prescribed value, for example, from at least 20 (A) to at most 40 (A), regardless of the material forming ball catching assisting portions 20.

When protruded portions 21A of ball catching assisting portion 21 for the thumb shown in FIGS. 14 to 17 are formed of the same material, ball catching assisting portion 21 for the thumb shown in FIG. 14 has the lowest hardness, and ball catching assisting portion 21 for the thumb shown in FIG. 15 has the highest hardness. The hardness of ball catching assisting portion 21 for the thumb show in FIG. 16 is higher than that of ball catching assisting portion 21 for the thumb shown in FIG. 14 and lower than that of ball catching assisting portion 21 for the thumb shown in FIG. 15. Further, ball catching assisting portion 21 for the thumb shown in FIG. 17 is less susceptible to deformation than ball catching assisting portion 21 for the thumb shown in FIG. 14, or it has higher hardness.

Therefore, when ball catching assisting portions 21 for the thumb are formed of the same material, ball catching assisting portion 21 for the thumb shown in FIG. 14 is more prone to deformation than ball catching assisting portions 21 shown in FIGS. 15, 16 and 17, and hence, when catching the ball, ball catching assisting portion 21 deforms conforming to the circumferential surface of the ball to grip the ball, and the ball can be kept in ball catching tool 1.

When ball catching assisting portion 21 for the thumb is formed as shown in FIG. 15, ball catching assisting portion 21 for the thumb does not much deform, while it can exert large force on the point of contact with the ball. Therefore, at the time of catching, the force on the fingers can be transmitted immediately to the ball, and the ball can be instantaneously fixed in ball catching tool 1.

Ball catching assisting portion 21 for the thumb shown in FIG. 16 is less susceptible to deformation than ball catching assisting portion 21 for the thumb shown in FIG. 14, and therefore, it is easier to transmit the force on the fingers to the ball, and easier to fix the ball in ball catching tool 1. On the other hand, ball catching assisting portion 21 for the thumb shown in FIG. 16 is more susceptible to deformation than ball catching assisting portion 21 for the thumb shown in FIG. 15, and therefore, it is more easily deformed along the circumferential surface of the ball, and by holding the ball, it keeps the ball within ball catching tool 1.

Further, ball catching assisting portions 21 for the thumb shown in FIGS. 15 and 17 have protruded portions 21A extending outward, and therefore, by selecting the material of protruding portion 21A, coefficient of restitution between the ball and protruded portion 21A and the like can easily be changed.

Further, ball catching assisting portion 21 for the thumb shown in FIG. 17 is formed to have lower hardness than ball catching assisting portion 21 for the thumb shown in FIG. 15. Therefore, it is possible to select the material of protruded portion 21A in consideration of coefficient of restitution between the ball and protruded portion 21A and the like. Further, by selecting either of ball catching assisting portions 21 for the thumb shown in FIGS. 14 and 17, the hardness of ball catching assisting portion 21 for the thumb can be set to a prescribed value. By similarly forming ball catching assisting portions 20 as ball catching assisting portion 21 for the thumb, similar effects as ball catching assisting portion 21 for the thumb can be attained.

Ball catching assisting portions 22, 23 and 24 for the middle finger, ring finger and little finger are structured similar to ball catching assisting portion 21 for the thumb. Specifically, ball catching assisting portions 22, 23 and 24 for the middle finger, ring finger and little finger each include a base and a protruded portion provided on the base, and the protruded portion is inserted to the hole formed in ball catching surface skin 10. Ball catching assisting portions 21, 22, 23 and 24 for the thumb, middle finger, ring finger and little finger may have mutually different type structures.

As to the height of ball catching assisting portions 22, 23 and 24 for the middle finger, ring finger and little finger, the height is defined as the distance from the surface of ball catching surface skin 10 to the upper surface 42, 52 and 62 of ball catching assisting portions 22, 23 and 24 for the middle finger, ring finger and little finger, as in ball catching assisting portion 21 for the thumb.

FIGS. 18 and 19 show a method of manufacturing ball catching assisting portion 20. As can be seen from FIG. 18, a metal mold 114 includes a recessed portion 114*b* formed along the shape of ball catching assisting portion 20, and a suction hole 114*a* opened to recessed portion 114*b* for sucking air in recessed portion 114*b*. In manufacturing ball catching assisting portion 20, first, base 113 is sucked through suction hole 114*a*, so that base 113 is adhered on an inner peripheral surface of recessed portion 114*b*. Then, as shown in FIG. 19, an upper metal mold 115 is arranged to cover the opening of recessed portion 114*b*. Upper metal mold 115 has a supply inlet 115A for supplying resin A to the inside of recessed portion 114*b*, and through supply inlet 115A, the resin is supplied to recessed portion 114*b*. Then, by hot press followed by cooling, ball catching assisting portion 20 is formed. Ball catching assisting portion 21 for the thumb shown in FIG. 14 is manufactured through these steps.

FIGS. 20 and 21 show another method of manufacturing ball catching assisting portion 20, and the process of manufacturing ball catching assisting portion 20 includes the steps of filling a metal mold 110 with resin 112, and removing the resin from metal mold 110. As can be seen from FIG. 20, first, resin 112 is filled in recessed portion 110A formed in metal mold 110. Then, as shown in FIG. 21, a base 111 is placed on the side of the upper surface of filled resin 112, and hot-pressed, so that resin 112 in recessed portion 110A is adhered to base 111. When resin 112 is adhered to base 111, resin 112 is taken out from metal mold 110. At this time, a plurality of ball catching assisting portions 20 are in mutually connected state, and therefore, each ball catching assisting portion 20 is cut, and thus, ball catching assisting portion 20 is manufactured. Ball catching assisting portion 21 for the thumb shown in FIG. 15 is formed through these steps.

FIGS. 22 to 25 show a still further method of manufacturing ball catching assisting portion 20. In manufacturing ball catching assisting portion 20, first, leather 132 is arranged along the surface of recessed portion 131A formed in a metal mold 131, as shown in FIG. 22. Then, as shown in FIG. 23, a sponge 133 is inserted into recessed portion 131A. Then, as shown in FIG. 24, a base 134 is arranged on leather 132 and sponge 133 and hot-pressed, so that sponge 133, leather 132 and base 134 are adhered. Then, as shown in FIG. 25, sponge 133, leather 132 and base 134 adhered to each other are taken out from recessed portion 131A. At this time, a plurality of ball catching assisting portions 20 are in mutually connected state, and therefore, each ball catching assisting portion 20 is cut, and thus, ball catching assisting portion 20 is manufactured. Ball catching assisting portion 21 for the thumb shown in FIG. 16 is formed through these steps.

In Embodiment 1, ball catching assisting portion 20 is sewn to ball catching surface skin 10 and inseparable from ball catching tool 1. The ball catching assisting portion 20 of the present invention, however, may be provided separate from ball catching tool 1. Specifically, ball catching assisting portion 20 may be provided as a structure separate and independent from ball catching tool 1, and it may be attached to the surface of ball catching surface skin 10 of ball catching tool 1 by adhering means such as a two-sided tape. Particularly, when the ball catching surface skin is formed of artificial leather, ball catching assisting portion 20 formed of resin or the like can satisfactorily adhered on ball catching surface skin 10.

Further, as shown in FIG. 26, ball catching tool 1 may include a plurality of divided ball catching assisting portions, by dividing ball catching assisting portions 20. Specifically, ball catching assisting portion 21 for the thumb may be divided into divided ball catching assisting portions 21*a* and 21*b* for the thumb, ball catching assisting portion 22 for the middle finger may be divided into divided ball catching assisting portions 22*a* and 22*b* for the middle finger, ball catching assisting portion 23 for the ring finger may be divided into divided ball catching assisting portions 23*a* and 23*b* for the ring finger, and ball catching assisting portion 24 for the little finger may be divided into divided ball catching assisting portions 24*a* and 24*b* for the little finger. When ball catching assisting portions 20 are formed by a plurality of divided ball catching assisting portions, the number of portions to be in contact with the ball increases, and the ball is gripped stably in ball catching tool 1.

Further, tip end assisting portions 71, 72 and 73 may be provided at tip end portions of index-finger-stall 4, middle-finger-stall 5 and ring-finger-stall 6, as shown in FIG. 27. In this case, the ball that touched and bounced back from ball catching tool 1 can be gripped by tip end assisting portions 71, 72 and 73, and failure of catching, that is, a so-called fumble, can be suppressed.

In the present embodiment, ball catching assisting portions 21, 22, 23 and 24 for the thumb, middle finger, ring finger and little finger respectively have inclined surfaces 31, 41, 51 and 61. However, these are not limiting. Specifically, ball catching assisting portions 21A, 22A, 23A and 24A for the thumb, middle finger, ring finger and little finger having peripheral surfaces 33A, 43A, 53A and 63A formed approximately vertical to ball catching surface skin 10 as shown in FIG. 28 may be used.

FIG. 65 is a front view showing a modification of ball catching tool 1 shown in FIG. 13. As shown in FIG. 65, each ball catching assisting portion 20 may be formed to have an approximately rectangular shape when viewed from above, and the upper surface may be formed not as an inclined surface but as a flat surface. When the upper surface of ball catching assisting portion 20 is formed flat, it becomes easier to grip the ball at the upper surface, and successful ball catching is possible.

FIG. 66 is a front view of ball catching tool 1 including ball catching assisting portion 20 formed with semi-circular opposite end portions of the upper surface protruded outward. As shown in FIG. 66, upper surfaces 32, 42, 52 and 62 of respective ball catching assisting portions 20 are made approximately flat. Radius of curvature of approximately semi-circular protruded portion formed at opposite ends of each ball catching assisting portion 20 is made at least 3 mm, and radius of curvature of upper surfaces 32, 42, 52 and 62 as well as peripheral surfaces 33, 43, 53 and 63 positioned at the opposite end portions is also set to at least 3 mm. FIG. 67 is a cross-sectional view taken along the line LXVII-LXVII of FIG. 66, showing ball catching assisting portion 22 for the middle finger along the width direction of middle-finger-stall 5. FIG. 68 is a cross-sectional view taken along the line LXVIII-LXVIII of FIG. 66, showing ball catching assisting portion 22 for the middle finger along the longitudinal direction of middle-finger-stall 5. As shown in FIGS. 67 and 68, ball catching assisting portion 22 for the middle finger has ridge portions 44*b* and 44*c* as intersecting lines between upper surface 42 and peripheral surface 43, at the boundary between upper surface 42 and peripheral surface 43. Other ball catching assisting portions 20 are also formed in the similar manner as ball catching assisting portion 22 for the middle finger.

FIG. 69 is a cross-sectional view showing a modification of ball catching assisting portion 22 for the middle finger shown in FIG. 67, and FIG. 70 is a cross-sectional view of ball catching assisting portion 22 for the middle finger shown in FIG. 69, along the longitudinal direction of middle-finger-stall 5. As shown in FIGS. 69 and 70, ball catching assisting portion 22 for the middle finger is formed to have a curved shape that bulges upward at the central portion in the direction to the root portion of middle-finger-stall 5. Skirts at opposite ends in the direction along the root portion of middle-finger-stall 5 have curved shape. Further, the width in the direction along the root portion of middle-finger-stall 5 of ball catching assisting portion 22 for the middle finger (width in the width-wise direction of middle-finger-stall 5) is formed to be approximately uniform over the side of root portion to the tip end portion of middle-finger-stall 5. Peripheral surface 43 is formed at opposite end portions along the longitudinal direction of ball catching assisting portion 22 for the middle finger, to have circular arc shape. At the boundary between peripheral surface 43 as such and upper surface 42, ridge portion 44*b* as the intersecting line between upper surface 42 and peripheral surface 43 is formed. Specifically, ball catching assisting portion 22 for the middle finger is formed to have an approximately semi-columnar shape.

FIG. 71 is a cross-sectional view showing a still further modification of ball catching assisting portion 22 for the middle finger shown in FIG. 67, and FIG. 72 is a cross-sectional view of ball catching assisting portion 22 for the middle finger shown in FIG. 71, in the direction from the side of the root portion to the tip end portion of middle-finger-stall 5 (longitudinal direction of middle-finger-stall 5). As shown in FIGS. 71 and 72, upper surface 42 of ball catching assisting portion 22 for the middle finger has a curved surface that bulges upward at the central portion in the direction along the root portion of middle-finger-stall 5, and is connected smooth to peripheral surface 43 at opposite end portions in the longitudinal direction of ball catching assisting portion 22 for the middle finger. Therefore, at opposite end portions along the longitudinal direction of ball catching assisting portion 22 for the middle finger, a curved surface 44*c* is formed that smoothly connects upper surface 42 and peripheral surface 43 at the boundary between upper surface 42 and peripheral surface 43.

As described above, ball catching assisting portion 22 for the middle finger shown in FIGS. 71 and 72 is formed such that radius of curvature is larger than 3 mm at any of upper surface 42, peripheral surface 43 and the boundary between upper surface 42 and peripheral surface 43. Specifically, in this ball catching assisting portion 22 for the middle finger, at any portion positioned above ball catching surface skin 10, every surface is flat or smooth curved surface and therefore, even when the ball collides, stress generated between the ball and ball catching assisting portion 22 for the middle finger can be reduced. Therefore, even when the ball collides against ball catching assisting portion 22 for the middle finger, large bounce to the outside of ball catching tool 1 can be suppressed.

When catching a hardball, rubber ball or softball using the ball catching tool 1 structured as described above, the hardball, rubber ball or softball can be held firmly even if there is a difference between the distance of finger movement by the wearer and the distance of finger movement necessary for catching the ball, as the difference can be compensated for by the height of ball catching assisting portions 20.

Particularly, a softball has larger diameter than a hardball or rubber ball, and therefore, the distance of finger movement necessary for catching a softball is smaller than the necessary distance for catching a hardball or rubber ball. Therefore, when catching a softball by ball catching tool 1 described above, the user can catch the ball almost solely by simply turning the ball catching surface of ball catching tool 1 to face the softball, hardly moving his/her fingers.

Further, as ridge portions 34*b*, 44*b*, 54*b* and 64*c* are formed at ball catching assisting portions 20 arranged along pocket portion 90, it is possible to successfully fix the held ball within ball catching tool 1 by the ridge portions 34*b*, 44*b*, 54*b* and 64*c*.

Further, as inclined surfaces 31, 41, 51 and 61 are formed at ball catching assisting portions 20, travel of the ball is not hindered by ball catching assisting portions 20 when the ball enters ball catching tool 1.

Specifically, inclined surfaces 31, 41, 51 and 61 formed at ball catching assisting portions 20 are formed inclined upward gradually from the side of edge portion 80 to the pocket portion 90, that is, inclined gradually from the direction of entrance of the ball along the course of the ball.

Therefore, when the ball enters ball catching tool 1, ball catching assisting portion 20 is low in height and hence ball catching assisting portion 20 does not hinder entrance of the ball, and as the ball proceeds in ball catching tool and reaches pocket portion 90, ball catching assisting portion 20 is higher and hence, the ball that has been fit in the pocket portion 90 does not easily go out from ball catching tool 1.

Particularly, ridge portions 34*b*, 44*b*, 54*b* and 64*c* of ball catching assisting portions 20 are arranged around pocket portion 90, and hence, the ball fitted in pocket portion 90 is caught by ridge portions 34*b*, 44*b*, 54*b* and 64*c* on the side of pocket portion 90, and hence, slipping of the ball out from pocket portion 90 is suppressed.

A ball that touches near opening portion 81 is pinched by ridge portions 34*b* and 64*b*, and held in ball catching tool 1. A ball that touches near web portion 3 is pinched by ridge portion 34*c* and 44*c*, and held in ball catching tool 1.

Further, ball catching assisting portion 20 is formed to have an approximately triangular shape when viewed from above, and therefore, when the ball hits a portion closer to the tip end portion than ball catching assisting portion 20 and rolls down into pocket portion 90, ball catching assisting portion 20 hardly hinders rolling of the ball. Further, as ridge portions 34*c*, 44*c*, 54*c* and 64*c* are formed from the tip end side of thumb-stall 2, middle-finger-stall 5, ring-finger-stall 6 and little-finger-stall 7 to the side of pocket portion 90, even when a ball touches the tip end side of ball catching tool 1, the ball is guided by ridge portions 34*c*, 44*c*, 54*c* and 64*c* from the tip end side of ball catching tool 1 to the pocket portion 90.

When ball catching assisting portions 20 are divided to provide divided ball catching assisting portions 21*a*, 21*b*, 22*a*, 22*b*, 23*a*, 23*b* and 24*a*, 24*b*, the ball comes to be pressed by a plurality of portions, and hence, the ball can be gripped firmly.

Further, ball catching assisting portions 21, 22, 23 and 24 for the thumb, middle finger, ring finger and little finger have upper surfaces 32, 42, 52 and 62 provided with flat surfaces 32*a*, 42*a*, 52*a* and 62*a*, and hence, it is easy to grip the ball at flat surfaces 32*a*, 42*a*, 52*a* and 62*a*, and the ball can be kept in ball catching tool 1.

When the ball catching surface skin is formed of artificial leather and ball catching assisting portion 20 is formed separate and independent from ball catching tool 1, it is possible to the user to set the height of ball catching assisting portion 20, and further, to set the position of arranging ball catching assisting portion 20, in consideration of his/her ability. It is noted that ball catching assisting portion 20 may be easily mounted on an existing ball catching tool, if the tool is formed of artificial leather. Ball catching tool 1 is not limited to a glove such as shown in Embodiment 1, and includes a first-baseman's glove and a catcher's mitt.

In ball catching tool 1 of Embodiment 1, ball catching assisting portions 20 of similar shapes are provided at thumb-stall 2 and other finger-stalls. It is not limiting, and ball catching assisting portions 20 of different shapes may be provided on the thumb- and other finger-stalls.

Table 13 below represents results of sensory test on 15 trial subjects, using ball catching tool 1 with ball catching assisting portions 20 with different heights and hardness. Evaluation was given by each of the 15 subjects on 5 point scale, that is, one subject evaluates with 5 being the highest, and the total is given as "score (in 75 points)", and "Evaluation" is a 100-point equivalent of the 75-point-scale score.

TABLE 13

| Height (H) | | | Hardness | | | |
|---|---|---|---|---|---|---|
| Height (mm) | Score | Evaluation | Hardness (c) | JISK6301A | Score | Evaluation |
| 2.5 | 19 | 25 | 10 | Approx. 4 | 57 | 76 |
| 5.0 | 72 | 96 | 20 | 8 | 73 | 97 |
| 7.5 | 67 | 89 | 30 | 12 | 51 | 68 |
| 10.0 | 25 | 33 | 50 | 24 | 33 | 44 |
| | | | 70 | 44 | 29 | 39 |

From Table 13, it can be understood that preferable height of ball catching assisting portion 20 is 5.0 (mm) and 7.5 (mm). Further, preferable hardness of ball catching assisting portion 20 is 10 (c) and 20 (c). The height of ball catching assisting portion 20 of Table 13 represents the height of one ball catching assisting portion.

Embodiment 2

Embodiment 2 of the present invention will be described with reference to FIG. 29. FIG. 29 is a front view of a ball catching tool 100 in accordance with Embodiment 2, and as can be seen from FIG. 29, on a surface of ball catching surface skin 10 of ball catching tool 100, ball catching assisting portion 21 for the thumb is arranged near the root portion of thumb-stall 2, and at root portions of finger-stalls, bulged portions 120 are formed. Bulged portions 120 include bulged portions 122, 123 and 124 for the middle finger, ring finger and little finger arranged at the root portions of middle-finger-stall 5, ring-finger-stall 6 and little-finger-stall 7, respectively.

Bulged portions 122, 123 and 124 for the middle finger, ring finger and little finger are all formed such that the front surface of ball catching surface skin 10 bulges outward. Further, sponge or the like is filled in each of bulged portions 122, 123 and 124 for the middle finger, ring finger and little finger.

Bulged portion 122 for the middle finger includes an extending portion 122*a* formed extending from the root portion to the tip end portion of middle-finger-stall 5, and a bent portion 122*b* arranged at an end portion on the root side of extending portion 122*a* and bent toward adjacent ring-finger-stall 6. Bulged portion 123 for the ring finger includes an extending portion 123*a* formed extending from the root portion to the tip end portion of ring-finger-stall 6, and a bent portion 123*b* arranged at an end portion on the root side of extending portion 123*a* and bent toward adjacent little-finger-stall 7. Further, bulged portion 124 for the little finger includes an extending portion 124*a* formed extending from the root portion to the tip end portion of little-finger-stall 7, and a bent portion 124*b* arranged at an end portion on the root side of extending portion 124*a* and bent toward side surface 7*a* of little-finger-stall 7 of edge portion 80. These bent portions 122*b*, 123*b* and extending portion 124*a* are arranged around pocket portion 90.

In the present embodiment, bulged portions 120 are arranged at the root portions of middle-finger-stall 5, ring-finger-stall 6 and little-finger-stall 7. The arrangement, however, is not limited thereto. Specifically, bulged portion 120 may be formed on at least one portion of thumb-stall 2 or a finger-stall 11 or on a root portion thereof, except for thumb-stall 2 or finger-stall 11 that have ball catching assisting portion 20 formed thereon, among thumb-stall 2, middle-finger-stall 5, ring-finger-stall 6 and little-finger-stall 7. Preferably, ball catching assisting portion 21 for the thumb as ball catching assisting portion 20 may be provided on thumb-stall 2 or at the root portion thereof, and bulged portion 120 is formed at any of middle-finger-stall or its root portion, ring-finger-stall 6 or its root portion, or little-finger stall 7 or its root portion. In the present embodiment also, ball catching assisting portion 21 may be formed as a structure separate and independent from ball catching tool 1.

In Embodiment 2, the sum of heights of ball catching assisting portion 21 for the thumb and bulged portion 122 for the middle finger is set to at least 6.15 mm and at most 26.6 mm. The sum of heights of ball catching assisting portion 21 for the thumb and bulged portion 123 for the ring finger is set to at least 6.15 mm and at most 26.6 mm. Further, the sum of heights of ball catching assisting portion 21 for the thumb and bulged portion 124 for the little finger is set to at least 6.15 mm and at most 26.6 mm. Here, the height of bulged portions 122, 123 and 124 for the middle finger, ring finger and little finger is defined as the distance from the surface of ball catching surface skin 10 to the upper surface of bulged portions 122, 123 and 124 for the middle finger, ring finger and little finger. When a bulged portion for the thumb is formed, the height of bulged portion for the thumb is also defined as the height from the surface of ball catching surface skin 10 to the upper surface of bulged portion for the thumb.

When bulged portions 122, 123 and 124 for the middle finger, ring finger and little finger are formed, first, metal mold having a recessed portion modeling the shape of bulged portions 122, 123 and 124 for the middle finger, ring finger and little finger is prepared.

Then, leather is pressed along the inner wall surface of the recessed portion. Sponge or the like is inserted to the recess formed in the leather. Then, a base material is arranged on the leather and on the upper surface of sponge. Thereafter, bulged portions 122, 123 and 124 for the middle finger, ring finger and little finger are formed by hot press, on ball catching surface skin 10.

In ball catching tool 100 of Embodiment 2, as ridge portion 34*b* formed on ball catching assisting portion 21 for the thumb, bent portions 122*b* and 123*b* and extending portion 124*a* are arranged around pocket portion 90, the ball, once fit in pocket portion 90, is caught by ridge portion 34*b*, bent portions 122*b* and 123*b* and the extending portion 124*a*, and prevented from slipping out from pocket portion 90. Thus, satisfactory ball catching is possible.

A ball that touches web portion 3 is pinched between ridge portion 34*c* of ball catching assisting portion 21 for the thumb and extending portion 122*a* of bulged portion 122 for the middle finger, and held in ball catching tool 100. A ball that touches near opening portion 81 is pinched between ridge portion 34*c* of ball catching assisting portion 21 for the thumb and bent portion 124*b* of bulged portion 124 for the little finger, and held in ball catching tool 100. In this manner, in Embodiment 2 also, even when the ball touches at a position slightly off from the pocket portion 90, the ball can be held in ball catching tool 100.

Further, bulged portions 122, 123 and 124 for the middle finger, ring finger and little finger are all formed by embossing, and sponge is arranged therein. Therefore, these portions easily deform by the force of fingers of the user, to conform to the circumferential surface of the ball in pocket portion 90. Therefore, the force of fingers of the user is well transmitted to the ball in pocket portion 90, and the ball can be held firmly. Further, in Embodiment 2 also, the height of ball catching assisting portions are set in the similar manner as in Embodiment 1, and hence, function and effects similar to Embodiment 1 above can be attained.

Embodiment 3

Referring to FIG. 30, Embodiment 3 of the present invention will be described. FIG. 30 is a front view of a ball catching tool 200 in accordance with Embodiment 3, and as can be seen from FIG. 30, ball catching tool 200 includes ball catching assisting portion 21 for the thumb and bulged portion 220. Bulged portion 220 includes a bulged portion 222 for the middle and ring fingers, and a bulged portion 223 for the little finger. Bulged portion 222 for the middle and ring fingers includes an extending portion 222*a* extending from the root portion to the tip end portion of middle-finger-stall 5, and a bent portion 222*b*. Bent portion 222*b* is bent at the root portion of extending portion 222*a* toward the side surface 7*a* of little-finger-stall 7, and arranged along the root portions of middle-finger-stall 5 and ring-finger-stall 6. Therefore, bulged portion 222 for the middle and ring fingers is formed to serve both as bulged portion for the middle finger and bulged portion for the ring finger. Thus, bent portion 222*b* is arranged around pocket potion 90.

Bulged portion 223 for the little finger includes an extending portion 223*a* arranged to extend from the root portion to the tip end portion of little-finger-stall 7 and a bent portion 223*b* arranged at the root portion of extending portion 223*a*. Bent portion 223*b* is arranged to extend from the root portion of little-finger-stall 7 to the side of side surface 7*a* of little-finger-stall 7 of edge portion 80. The sum of heights of ball catching assisting portion 21 for the thumb and bulged portion 222 for the middle and ring fingers is set to be at least 6.15 mm and at most 26.6 mm, and the sum of heights of ball catching assisting portion 21 for the thumb and bulged portion 223 for the little finger is set to be at least 6.15 mm and at most 26.6 mm.

FIG. 31 is a perspective view showing a modification of ball catching tool in accordance with Embodiment 3. As shown in FIG. 30, bulged portion 222 for the middle and ring fingers and bulged portion 223 for the little finger may be connected to provide a bulged portion 225. Bulged portion 225 includes an extending portion 225*a* extending from the root portion to the tip end portion of middle-finger-stall 5, a bent portion 225*b* provided at the root portion of extending portion 225*a* and bent toward side surface 7*a* of little-finger-stall 7, a downward portion 225*c* provided at an end of bent portion 225*b* and extending downward to the side of the root portion of little-finger-stall 7, and a bent portion 225*d* provided at a lower end of downward portion 225*c* and arranged at the root portion of little-finger-stall 7. In this case, bent portion 225*b* and downward portion 225*c* come to be arranged around pocket portion 90, and these are arranged to easily catch the periphery of the ball contained in pocket portion 90. In the present embodiment also, ball catching assisting portion 21 for the thumb may be a structure separate and independent from ball catching tool 1. Except for the points described above, the structure is the same as Embodiments 1 and 2 above.

In ball catching tool 200 of Embodiment 3, as bent portion 222*b* and extending portion 223*a* are arranged around pocket portion 90, the ball that touches pocket portion 90 is caught by bent portion 222*b* and extending portion 223*a* and kept in pocket portion 90, so that satisfactory ball catching is possible. Particularly when bulged portion 222 for the middle and ring fingers is coupled to bulged portion 223 for the little finger, the ball that has entered the pocket portion 90 is firmly fixed by bent portion 225*b* and downward portion 225*c*. Specifically, long bent portion 225*b* and downward portion 225*c* deform along the circumferential surface of the ball that has entered pocket portion 90, and fix the ball in pocket portion 90. Thus, the ball is kept in pocket portion 90.

Further, when a ball touches near web portion 3, it can be pinched between ridge portion 34*c* of ball catching assisting portion 21 for the thumb and extending portion 222*a* of bulged portion 222 for the middle and ring fingers, and held in ball catching tool 200. When a ball touches near opening portion 81, the ball is pinched between ridge portion 34*b* of ball catching assisting portion 21 for the thumb and bent portion 223*b* of bulged portion 223 for the little finger, and held in ball catching tool 200.

When bulged portion 225 is provided, a ball that touches web portion 3 is pinched by extending portion 225*a* of bulged portion 225 and ridge portion 34*c* of ball catching assisting portion 21 for the thumb, and held in ball catching tool 200. Further, a ball that touches near opening portion 81 is pinched by ridge portion 34*b* of ball catching assisting portion 21 for the thumb and bent portion 225*d* of bulged portion 225. In this manner, in Embodiment 3 also, even when the ball touches at a position slightly off from the pocket portion 90, the ball can be held in ball catching tool 200.

As in Embodiment 1 described above, in ball catching tool 200 in accordance with Embodiment 3, the sum of heights of ball catching assisting portion 21 for the thumb and bulged portion 222 for the middle and ring fingers is set to be at least 6.15 mm and at most 26.6 mm, and the sum of heights of ball catching assisting portion 21 for the thumb and bulged portion 223 for the little finger is set to be at least 6.15 mm and at most 26.6 mm. Further, the sum of heights of ball catching assisting portion 21 for the thumb and bulged portion 225 is also set to be at least 6.15 mm and at most 26.6 mm. Therefore, function and effects similar to those of Embodiment 1 above can be attained.

Further, as the bulged portion is provided as in Embodiment 2, function and effects similar to those of Embodiment 2 above can be attained.

Embodiment 4

Referring to FIGS. 32 to 35, Embodiment 4 of the present invention will be described. FIG. 4 is a front view of a mitt 300 (ball catching assisting tool for baseball or softball) in accordance with Embodiment 4. As shown in FIG. 32, mitt 300 is a first-baseman's mitt, and mitt 300 includes a surface skin 316 formed by sewing ball catching surface skin 310 and dorsal skin 309 together, and pocket portion 90 at the central portion of ball catching surface skin 310. Further, mitt 300 includes a thumb-stall 302 receiving the thumb of the user, and a finger-stall 304 receiving fingers other than the thumb of the user, formed by surface skin 316. Between thumb-stall 302 and finger-stall 304, a web portion 303 is arranged. Mitt 300 further includes an opening 381 to which user's hand is inserted.

Within surface skin 316, a lining, not shown, is provided. The lining includes an inner-thumb-stall, an inner-index-finger-stall, an inner-middle-finger-stall, an inner-ring-finger-stall and an inner-little-finger-stall, not shown, to which the thumb, index finger, middle finger, ring finger and little finger are inserted.

The peripheral portion of thumb-stall 302 includes an outer edge portion 302*a* and an inner edge portion 302*b*. Outer edge portion 302*a* of thumb-stall 302 consists of a tip end portion of thumb-stall 302 and a side surface that is exposed outward, of the side surfaces of thumb-stall 302. Further, inner edge portion 302*b* of thumb-stall 302 consists of the side surface adjacent to web portion 303, of the side surfaces of thumb-stall 302.

The peripheral portion of finger-stall 304 includes an outer edge portion 304*a* and an inner edge portion 304*b*. Outer edge portion 304*a* of finger-stall 304 is formed of a side surface that is exposed outward, of the side surfaces of finger-stall 304 and the tip end portion of finger-stall 304. Inner edge portion 304*b* of finger-stall 304 is formed of the side surface adjacent to web portion 303, of the side surfaces of finger-stall 304.

The peripheral portion of opening portion 381 consists of an edge portion 381*a* on the side of ball catching surface skin 310 and an edge portion, not shown, on the side of dorsal skin 309. The peripheral portion of the opening of mitt 300 arranged to face the ball includes outer edge portion 302*a* of thumb-stall 302, edge portion 381*a* on the side of ball catching surface skin 310 of opening portion 381, outer edge portion 304*a* of finger-stall 304, and the tip end of web portion 303. A ball enters mitt 300 from the peripheral portion of mitt 300.

Mitt 300 includes a ball catching assisting portion 320, and ball catching assisting portion 320 includes ball catching assisting portion 321 for the thumb provided at the root portion of thumb-stall 302, and a ball catching assisting portion 322 for the finger-stall arranged at the root portion of finger-stall 304. Ball catching assisting portion 321 may be arranged at the belly portion of thumb-stall 302, and ball catching assisting portion 322 for the finger-stall may be arranged at the belly of finger-stall 304.

Ball catching assisting portion 321 for the thumb includes an upper surface 332 formed to have an approximately triangular shape when viewed from above, and a peripheral surface 333 arranged on an outer peripheral portion of upper surface 332. Of upper surface 332, the side of outer edge portion 302*a* of thumb-stall 302 has an inclined surface 331. Further, on the side of pocket portion 390 of upper surface 332, a flat surface 332*a* is formed. Inclined surface 331 has its height increased from the side of outer edge portion 302*a* to the side of pocket portion 390.

Peripheral surface 333 includes a peripheral surface 333*a* arranged on the side of outer edge portion 302*a* of outer peripheral portion of upper surface 332, a peripheral surface 333*b* adjacent to one side of upper surface 332, and a peripheral surface 333*c* adjacent to the other side of upper surface 332. At the boundary between peripheral surface 333*b* and upper surface 332, a ridge portion 334*b* is formed, and at the boundary between peripheral surface 333*c* and upper surface 332, ridge portion 334*c* is formed.

Ridge portion 334*b* of ball catching assisting portion 321 for the thumb is arranged along pocket portion 390. Further, ridge portion 334*c* is arranged along inner edge portion 302*b* of thumb-stall 302.

Ball catching assisting portion 322 for the finger-stall is structured in the similar manner as ball catching assisting portion 321 for the thumb described above. Ball catching assisting portion 322 for the finger-stall includes an upper surface 342 formed to have an approximately triangular shape when viewed from above, and a peripheral surface 343 arranged at the outer peripheral portion of upper surface 342. Of upper surface 342, on the side of outer edge portion 304*a* of finger-stall 304, an inclined surface 341 is formed, and on the side of pocket portion 390 of upper surface 342, a flat surface 342*a* is formed. Inclined surface 341 has its height increased from the side of outer edge portion 304*a* to the side of pocket portion 390.

Peripheral surface 343 includes a peripheral surface 343*a* arranged on the side of outer edge portion 304*a* of outer peripheral portion of upper surface 342, a peripheral surface 343*b* adjacent to one side of upper surface 342, and a peripheral surface 343*c* adjacent to the other side of upper surface 342. At the boundary between peripheral surface 343*b* and upper surface 342, a ridge portion 344*b* is formed, and at the boundary between peripheral surface 343*c* and upper surface 342, ridge portion 344*c* is formed.

Ridge portion 322 of ball catching assisting portion 322 for the finger-stall is arranged along pocket portion 390. Further, ridge portion 344*c* is arranged along inner edge portion 304*b* of finger-stall 304.

Here, the height of ball catching assisting portion 321 for the thumb is defined as a distance from the surface of ball catching surface skin 310 to the upper surface 332 of ball catching assisting portion 321 for the thumb, and the height of ball catching assisting portion 322 for the finger-stall is defined as the distance from the surface of ball catching surface skin 310 to the upper surface 342 of ball catching assisting portion 322 for the finger-stall. The sum of heights of ball catching assisting portion 321 for the thumb and ball catching assisting portion 322 for the finger-stall is at least 6.15 mm and at most 26.6 mm. Though ball catching assisting portion 320 includes ball catching assisting portion 321 for the thumb and ball catching assisting portion 322 for the finger-stall in Embodiment 4, it is not limiting.

FIG. 33 is a front view showing a first modification of mitt 300 shown in FIG. 32. As can be seen from FIG. 33, ball catching assisting portion 320 may include ball catching assisting portion 321 for the thumb only.

In this case, the height of ball catching assisting portion 321 for the thumb is set to at least 6.15 mm and at most 26.6 mm. FIG. 34 shows a second modification of the mitt shown in FIG. 32, and as can be seen from FIG. 34, ball catching assisting portion 320 may include ball catching assisting portion 322 for the finger-stall only. In this case, the height of ball catching assisting portion 322 for the finger-stall is set to at least 6.15 mm and at most 26.6 mm.

Though ball catching assisting portion 322 for the finger-stall is arranged at a portion on the ball catching side surface of finger-stall 304 where the inner-index-finger-stall or the inner-middle-finger-stall, not shown, is arranged inside, the position is not limited thereto. Specifically, ball catching assisting portion 322 for the finger-stall may be arranged on at least one of the portion where the inner-index-finger-stall is arranged inside, the portion where the inner-middle-finger-stall is arranged inside, the portion where the inner-ring-finger-stall is arranged inside, and the portion where the inner-little-finger-stall is arranged inside, on the ball catching side surface of finger-stall 304.

Preferably, ball catching assisting portion 322 for the finger-stall is arranged at a portion on the ball catching side surface of finger-stall 304 where the inner-index-finger-stall or the inner-middle-finger-stall is arranged inside, as shown in FIG. 32. Specifically, when ball catching assisting portion 322 for the finger-stall is arranged at a portion on the ball catching side surface of finger-stall 304 where the inner-index-finger-stall or the inner-middle-finger-stall is arranged inside, ridge portion 344*c* of ball catching assisting portion 322 for the finger-stall is positioned adjacent to the web portion 303, and therefore, ridge portion 344*c* more likely comes into contact with the ball, when the ball enters the web portion 303.

Specifically, when ball catching assisting portion 322 for the finger-stall is arranged at a portion of the surface of finger-stall 304 where the inner-index-finger-stall or the inner-middle-finger-stall is arranged, the ball can instantaneously be pinched when it enters web portion 303, as ridge portions 344*c* and 334*c* are adjacent to each other.

FIG. 35 is a front view of a third modification of the mitt shown in FIG. 32, and as can be seen from FIG. 35, ball catching assisting portion 321 for the thumb may include divided ball catching assisting portion 321*a*1 for the thumb and ball catching assisting portion 321*a*2 for the thumb. Further, ball catching assisting portion 322 for the finger-stall may include divided ball catching assisting portion 322*a*1 for the finger-stall and divided ball catching assisting portion 322*a*2 for the finger-stall. Divided ball catching assisting portion 321*a*1 for the thumb and ball catching assisting portion 321*a*2 for the thumb are arranged along a peripheral portion of pocket portion 390, and divided ball catching assisting portion 322*a*1 for the finger-stall and divided ball catching assisting portion 322*a*2 for the finger-stall are arranged along the peripheral portion of pocket portion 390.

Divided ball catching assisting portion 321*a*1 for the thumb has a ridge portion 334*b*1 extending along the peripheral portion of pocket portion 390, and divided ball catching assisting portion 321*a*2 for the thumb also has a ridge portion 334*b*2 extending along the peripheral portion of pocket portion 390. Further, divided ball catching assisting portion 322*a*1 for the finger-stall has a ridge portion 344*b*1 extending along the peripheral portion of pocket portion 390, and divided ball catching assisting portion 322*a*2 for the finger-stall also has a ridge portion 344*b*2 extending along the peripheral portion of pocket portion 390. Therefore, when a ball fits in pocket portion 390, the ball is kept in pocket portion 390 as ridge portions 334*b*1, 334*b*2, 344*b*1 and 344*b*2 are arranged along the circumferential surface of the ball.

Further, the ball that has entered pocket portion 390 comes to be in contact at a larger number of points with divided ball catching assisting portions 321*a*1, 321*a*2 for the thumb and divided ball catching assisting portions 322*a*1 and 322*a*2 for the finger-stall, so that the ball can be kept firmly in pocket portion 390.

In mitt 300 in accordance with Embodiment 4 in FIG. 32, when a ball is caught by pocket portion 390, ridge portions 334*b* and 344*b* pinch the ball, and the ball is fixed within pocket portion 390. Particularly, when ball catching assisting portion 322 for the finger-stall is arranged at a portion on the ball catching surface skin where the inner-index-finger-stall or the inner-middle-finger-stall is arranged inside, the ball can instantaneously be pinched by ridge portions 344*b* and 334*b*.

Particularly, for a first-baseman's mitt that catches the ball mostly at the web portion 303, it is preferred to arrange ball catching assisting portion 322 for the finger-stall at a portion on the ball catching surface skin of ball catching assisting portion 322 for the finger-stall where the inner-index-finger-stall or the inner-middle-finger-stall is arranged inside.

In mitt 300 structured as described above, when the ball is caught by web portion 303, the ball tends to be caught by ridge portions 344*c* and 334*c*, and hence, the ball can be kept firmly in mitt 300. When ball catching assisting portion 321 for the thumb or ball catching assisting portion 322 for the finger-stall is adapted to include divided ball catching assisting portions 321*a*1 and 321*a*2 for the thumb or ball catching assisting portions 322*a*1 and 322*a*2 for the finger-stall, the ball comes to be in contact at a larger number of points with divided ball catching assisting portions 321*a*1, 321*a*2 for the thumb and divided ball catching assisting portions 322*a*1 and 322*a*2 for the finger-stall, so that the ball can be kept firmly in pocket portion 390. Further, as ridge portions 334*b*1, 334*b*2, 344*b*1 and 344*b*2 are arranged along the circumferential surface of the ball that fits in pocket portion 390, the ball can be firmly kept in pocket portion 390.

Mitt 300 in accordance with Embodiment 4 has the similar structure as Embodiment 1 described above, and therefore, function and effects similar to those of ball catching tool 1 in accordance with Embodiment 1 can be attained.

Embodiment 5

Referring to FIG. 36, Embodiment 5 of the present invention will be described. FIG. 36 is a front view of a mitt 400 in accordance with Embodiment 5. As can be seen from FIG. 36, mitt 400 is a catcher's mitt. Mitt 400 includes a thumb-stall 402 receiving the thumb, a finger-stall 404 receiving fingers other than the thumb, that is, index finger, middle finger, ring finger and little finger, and a web portion 403 arranged between finger-stall 404 and thumb-stall 402. Mitt 400 includes surface skin formed of a ball catching surface skin 410 and dorsal skin 409, and a pocket portion 490 formed at the central portion of ball catching surface skin 410.

Thumb-stall 402 and finger-stall 404 are formed elongate along the peripheral portion of mitt 400. The rim of thumb-stall 402 includes an outer edge portion 402*a* consisting of a side surface exposed outward and a tip end portion, and an inner edge portion 402*b*, which is a side surface adjacent to web portion 403.

The rim of finger-stall 404 includes an outer edge portion 404*a* consisting of a side surface exposed outward and a tip end portion, and an inner edge portion 404*b*, which is a side surface adjacent to web portion 403. The peripheral portion of mitt 400 includes tip end portion of web portion 403, outer edge portion 402*a* of thumb-stall 402, and outer edge portion 404*a* of finger-stall 404.

Ball catching assisting portion 422 for the finger-stall extends from that one of the side surfaces of finger-stall 404 which is adjacent to web portion 403, to the other side surface. Further, ball catching assisting portion 422 for the finger-stall includes an upper portion 442 and a peripheral surface 443 arranged around the upper surface 442.

Upper surface 442 includes a flat surface 442*a* arranged on the side of pocket portion 490 and an inclined surface 441 arranged on the side of outer edge portion 414*a*. Inclined surface 441 has its height increased from the side of outer edge portion 404*a* to the side of pocket portion 490. Peripheral surface 443 includes a peripheral surface 443*a* adjacent to inclined surface 441 and facing the peripheral portion of mitt 400, and a peripheral surface 443*b* vertical to ball catching surface skin 410. At the boundary between upper surface 442 and peripheral surface 443, a ridge portion 444*b* is formed.

Peripheral surface 443*a* and inclined surface 441 are arranged facing the peripheral portion of mitt 400. Flat surface 442*a* is arranged along pocket portion 490.

At the boundary between peripheral surfaces 443*a* and 443*b*, ridge portions 444*c* and 444*d* are arranged. Ridge portion 444*d* is arranged on the side of web portion 403, and ridge portions 444*c* and 444*d* are arranged opposite to each other. The height of ball catching assisting portion 422 for the finger-stall is the distance from the surface of finger-stall 404 to the upper surface 442. The height of ball catching assisting portion 422 is at least 6.15 mm and at most 26.6 mm. Except for the points described above, the structure is the same as Embodiment 4.

When catching a ball with mitt 400 in accordance with Embodiment 5, even when the user closes thumb-stall 402 and finger-stall 404 by only a small distance from when the ball touches the surface of pocket portion 490 until it goes out, the ball can be pinched between the surfaces of ball catching assisting portion 422 and thumb-stall 402. Specifically, the necessary distance of movement of thumb-stall 402 and finger-stall 404 from when the ball touches the surface of pocket portion 490 until it goes out is sometimes different from the distance of movement of thumb-stall 402 and finger-stall 404 moved by the user. Even in that case, in mitt 400 in accordance with Embodiment 5, the height of ball catching assisting portion 422 for the finger-stall compensates for the distance of closing thumb-stall 402 and finger-stall 404, and therefore, the ball is held within mitt 400. Here, the ball is caught by the ridge portion of ball catching assisting portion 422 for the finger-stall, and kept in pocket portion 490. Further, as flat surface 442*a* is formed at the upper surface 442 of ball catching assisting portion 422 for the finger-stall, the ball can be pinched between flat portion 442*a* of ball catching assisting portion 422 for the finger-stall and the surface of thumb-stall 402.

Mitt 400 structured as described above can easily grip the ball, as ball catching assisting portion 422 for the finger-stall compensates for the distance of closing thumb-stall 402 and finger-stall 404. Further, when a ball fits in pocket portion 490, the ball is caught by ridge portion 444*b*, and thus, the ball is kept in pocket portion 490.

Further, flat surface 442*a* is formed on ball catching assisting portion 422 for the finger-stall, and the ball is pinched between the flat surface 442*a* and the ball catching side surface of thumb-stall 402, whereby the ball can firmly be gripped.

FIG. 37 is a front view showing a first modification of mitt 400 shown in FIG. 36. As can be seen from FIG. 37, at the root portion of thumb-stall 402, a ball catching assisting portion 421 for the thumb is provided. Ball catching assisting portion 421 for the thumb is formed elongate from the side of a side surface of thumb-stall 402 on the side of web portion 403 to the other side surface. Ball catching assisting portion 421 for the thumb is arranged protruded from the root portion of thumb-stall 402 of the surface of ball catching surface skin 410, and includes an upper surface 432 and a peripheral surface 433 arranged on the outer peripheral portion of upper surface 432. Peripheral surface 433 includes a peripheral surface 433*a* arranged facing outer edge portion 402*a* of thumb-stall 402 and a peripheral surface 433*b* arranged vertical to ball catching surface skin 410.

Upper surface 432 includes an inclined surface 431 arranged on the side of outer edge portion 402*a* and a flat surface 432*a* connected to inclined surface 431 and arranged on the side of pocket portion 490.

Inclined surface 431 is arranged facing outer edge portion 402*a* of thumb-stall 402, and has its height increased from outer edge portion 402*a* toward pocket portion 490.

Further, at the boundary between upper surface 432 and peripheral surface 433*b* of ball catching assisting portion 432 for the thumb, a ridge portion 434*b* is formed. Ridge portion 434*b* extends along the peripheral portion of pocket portion 490.

At the boundary between peripheral surfaces 433*a* and 433*b*, ridge portions 434*c* and 434*d* are arranged. Ridge portions 434*c* and 434*d* are arranged opposite to each other, and ridge portion 434*d* is arranged on the side of web portion 403. Further, the height of ball catching assisting portion 432 for the thumb is set to at least 6.15 mm and at most 26.6 mm.

As inclined surface 431 is formed at ball catching assisting portion 421 for the thumb in mitt 400 shown in FIG. 37, ball catching assisting portion 421 for the thumb does not hinder entrance of the ball when the ball comes into mitt 400.

Further, ball catching assisting portion 421 for the thumb is formed to have the prescribed height as described above, and therefore, when the user catches a ball, it compensates for the distance of closing thumb-stall 402 and finger-stall 404. Therefore, similar to mitt 400 shown in FIG. 36, it is possible to reduce the so-called fumble. Further, when a ball fits in pocket portion 490, the ball is caught by ridge portion 434*b* of ball catching assisting portion 421 for the thumb, and hence, the ball can be kept in pocket portion 490.

FIG. 38 shows a second modification of mitt 400 shown in FIG. 36. As can be seen from FIG. 38, mitt 400 includes ball catching assisting portion 421 for the thumb arranged at the root portion of thumb-stall 402 and ball catching assisting portion 422 for the finger-stall arranged at the root of finger-stall 404.

The sum of heights of ball catching assisting portion 421 for the thumb and ball catching assisting portion 422 for the finger-stall is set to be at least 6.15 mm and at most 26.6 mm.

Ball catching assisting portion 421 for the thumb includes an upper surface 432 and a peripheral surface 433 arranged on the peripheral portion of upper surface 432. Peripheral surface 433 includes a peripheral surface 433*a* arranged facing outer edge portion 402*a* of thumb-stall 402 and a peripheral surface 433*b* arranged on the side of pocket portion 490 and vertical to ball catching surface skin 410. At the boundary between peripheral surface 433*b* and upper surface 432, a ridge portion 434*b* is formed. Ridge portion 434*b* is arranged along the peripheral portion of pocket portion 490.

Further, at the boundary between peripheral surfaces 433*a* and 433*b*, ridge portions 434*c* and 434*d* are formed. Ridge portions 434*c* and 434*d* are arranged approximately vertical to the ball receiving surface skin 410. Further, ridge portion 434*d* is arranged on the side of web portion 403.

Ball catching assisting portion 422 for the finger-stall includes an upper surface 442 and a peripheral surface 443 formed at the peripheral portion of upper surface 442. Peripheral surface 443 includes a peripheral surface 443*a* arranged facing outer edge portion 404*a* of finger-stall 404, and a peripheral surface 443*b* arranged on the side of pocket portion 490 and vertical to ball catching surface skin 410. At the boundary between upper surface 442 and peripheral surface 443*b*, a ridge portion 444*b* is formed. Ridge portion 444*b* extends along the peripheral portion of pocket portion 490. At the boundary between peripheral surfaces 443*a* and 443*b*, ridge portions 444*c* and 444*d* are formed, and ridge portions 444*c* and 444*d* are arranged approximately vertical to the surface of ball catching surface skin 410. Ridge portion 444*d* is arranged on the side of web portion 403.

As mitt 400 is structured as described above, when a ball fits in pocket portion 490, the ball is caught by ridge portion 434*b* of ball catching assisting portion 421 for the thumb and ridge portion 444*b* of ball catching assisting portion 422 for the finger-stall, and the ball is kept in pocket portion 490. Further, in mitt 400 shown in FIG. 38 also, the heights of ball catching assisting portions 421 and 422 for the thumb stall and the finger-stall compensate for the distance of closing thumb-stall 402 and finger-stall 404, and therefore, it is possible to catch the ball easily. Further, it is possible for the user to pinch the ball that entered pocket portion 90 by flat surface 432*a* formed at ball catching assisting portion 421 for the thumb and the flat surface 442*a* formed at ball catching assisting portion 422 for the finger-stall, and hence, to firmly keep the ball within mitt 400. Particularly, as ridge portions 434*d* and 444*d* are arranged on the side of web portion 403, when the ball comes to web portion 403, ridge portions 434*d* and 444*d* pinch the ball. Thus, the ball can instantaneously be held within web portion 403.

FIG. 39 is a front view of a third modification of mitt 400 shown in FIG. 36. As shown in FIG. 39, mitt 400 includes ball catching assisting portion 421 for the thumb arranged at the root portion of thumb-stall 402 and ball catching assisting portion 422 for the finger-stall. Ball catching assisting portion 421 for the thumb includes divided ball catching assisting portion 421*a*1 for the thumb and divided ball catching assisting portion 421*a*2 for the thumb. Divided ball catching assisting portions 421*a*1 and 421*a*2 for the thumb are arranged along the peripheral portion of pocket portion 490. At divided ball catching assisting portions 421*a*1 and 421*a*2 for the thumb, ridge portions 434*b*1 and 434*b*2 are formed, arranged along the peripheral portion of pocket portion 90. Further, ball catching assisting portion 422 for the finger-stall includes divided ball catching assisting portions 422*a*1 and 422*a*2 for the finger-stall.

Divided ball catching assisting portions 422*a*1 and 422*a*2 for the finger-stall are arranged along the peripheral portion of pocket portion 490. Further, divided ball catching assisting portion 422*a*1 for the finger-stall includes a ridge portion 444*b*1 extending along the peripheral portion of pocket portion 490, and divided ball catching assisting portion 422*a*2 for the finger-stall includes a ridge portion 444*b*2 extending along the peripheral portion of pocket portion 490. The sum of heights of divided ball catching assisting portions 421*a*1 and 421*a*2 for the thumb and divided ball catching assisting portions 422*a*1 and 422*a*2 for the finger-stall is set to at least 6.15 mm and at most 26.6 mm.

In mitt 400 shown in FIG. 39, the ball comes to be in contact at a larger number of points with divided ball catching assisting portions 421*a*1, 421 a2 for the thumb and divided ball catching assisting portions 422*a*1 and 422*a*2 for the finger-stall, so that the ball can be kept firmly in pocket portion 490.

Though embodiments applied to baseball catching tools for catching a baseball, specifically, baseball catching tool for catching a hardball and baseball catching tool for catching rubber ball have been described above, the ball catching assisting portions may be provided in the similar manner as the embodiments above, on softball catching tools for catching a softball, to attain similar effects.

Though the present invention has been described above, it is originally contemplated that structures of various embodiments are appropriately combined with each other. The scope of the present invention is not limited to the embodiments described above. The scope of the present invention is determined by each of the claims and embraces modifications within the meaning of, and equivalent to, the languages in the claims.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A ball catching tool for baseball or softball, comprising:

a surface skin formed by sewing together a ball catching surface skin and a dorsal skin;

a pocket portion at a central portion of said ball catching surface skin;

a thumb-stall receiving the thumb of a user;

a finger-stall receiving fingers of the user other than the thumb;

a web portion, disposed between the thumb-stall and the finger-stall;

an edge portion positioned on a side of an opening for the user to insert his/her hand; and a ball catching assisting portion arranged on at least one of said thumb-stall or its root portion and said finger-stall or its root portion; wherein said ball catching assisting portion includes a first ridge portion extending along a width direction of said thumb-stall or said finger-stall on which said ball catching assisting portion is provided, and a second ridge portion extending in a direction from the root portion to a tip end portion of said thumb-stall or said finger-stall on which said ball catching assisting portion is provided at a position apart from said pocket portion, and said ball catching assisting portion is not provided on said pocket portion.

2. The ball catching tool for baseball or softball according to claim 1, wherein said thumb-stall includes a first side surface positioned on a side of a direction in which said ball enters;

said finger-stall includes a second side surface positioned on the side of the direction in which said ball enters;

said edge portion includes a rim of said opening, said first side surface, and said second side surface; and said ball catching assisting portion has an inclined surface on a side of said edge portion, inclined such that height at the side of said edge portion is lower than at a side of said pocket portion.

3. The ball catching tool for baseball or softball according to claim 1, wherein said ball catching assisting portion includes an upper surface and a peripheral surface connected to said upper surface; and said upper surface and said peripheral surface are arranged protruded from said ball catching surface skin, and a lower surface connected to said peripheral surface is fixed on said ball catching surface skin.

4. The ball catching tool for baseball or softball according to claim 1, further comprising:

a bulged portion formed on said surface skin; wherein said bulged portion is formed on at least one root portion of said thumb-stall and said finger-stall except for said thumb-stall and said finger-stall on which said ball catching assisting portion is arranged.

5. The ball catching tool for baseball or softball according to claim 4, wherein the bulged portion comprises two or more adjacent segments; and wherein each adjacent segment is substantially perpendicular to each other adjacent segment.

6. The ball catching tool for baseball or softball according to claim 4, wherein the bulged portion is substantially L-shaped.

7. The ball catching tool for baseball or softball according to claim 4, wherein the bulged portion is substantially Z-shaped.

8. The ball catching tool for baseball or softball according to claim 1, further comprising:

a bulged portion formed on said surface skin; wherein said ball catching assisting portion is arranged on said thumb-stall or on its root portion; and said bulged portion is formed at least on one of a middle-finger-stall receiving the middle finger of the user or its root portion, a ring-finger-stall receiving the ring finger of the user or its root portion, and a little-finger-stall receiving the little finger of the user or its root portion.

9. The ball catching tool for baseball or softball according to claim 1, wherein said ball catching assisting portion is formed of a material having friction coefficient higher than a material forming a ball receiving surface of said ball catching tool for baseball or softball.

10. The ball catching tool for baseball or softball according to claim 1, wherein said ball catching assisting portion is divided into a plurality of divided ball catching assisting portions.

11. The ball catching tool for baseball or softball according to claim 1, wherein said finger-stall includes an index finger-stall receiving the index finger of the user, a middle-finger-stall receiving the middle finger of the user, a ring-finger -stall receiving the ring-finger of the user and a little-finger-stall receiving the little-finger of the user;

said ball catching tool comprising a tip end assisting portion protruded from a surface of a ball receiving surface proximate a tip end portion of at least one of said thumb-stall, said index-finger-stall, said middle-finger-stall, said ring-finger -stall and said little-finger-stall.

12. The ball catching tool for baseball or softball according to claim 1, comprising:

a surface skin formed by sewing together a ball catching surface skin and a dorsal skin; and a pocket portion at a central portion of said ball catching surface skin; wherein a flat surface is formed on an upper surface of said ball catching assisting portion on a side of said pocket portion.

13. A ball catching tool for baseball or softball, comprising:

a surface skin formed by sewing together a ball catching surface skin and a dorsal skin;

a pocket portion at a central portion of said ball catching surface skin;

a thumb-stall receiving the thumb of a user;

a finger-stall receiving fingers of the user other than the thumb;

a web portion, disposed between the thumb-stall and the finger-stall; and a ball catching assisting portion arranged on at least one of said thumb-stall or its root portion and said finger-stall or its root portion; wherein a part of a peripheral portion of said ball catching tool for baseball or softball is formed of an outer edge portion of said thumb-stall and an outer edge of said finger-stall; and said ball catching assisting portion includes an inclined surface formed with its height increasing from said outer edge portion of at least one of said thumb-stall and said finger-stall, on which said ball catching assisting portion is provided, to a side of said pocket portion, and said ball catching assisting portion is not provided on said pocket portion; and a ridge portion along said pocket portion.

14. The ball catching tool for baseball or softball according to claim 1, wherein the ball catching assisting portion is provided on a ball catching surface of said thumb stall or its root portion; and wherein the ball assisting portion is at least 6.15 mm and at most 26.6 mm in height.

15. The ball catching tool for baseball or softball according to claim 1, wherein said finger-stall includes an index-finger-stall receiving the index finger of the user, a middle-finger-stall receiving the middle finger of the user, a ring-finger -stall receiving the ring finger of the user, and a little-finger-stall receiving the little finger of the user, and the ball catching assisting portion is provided on a ball catching side surface of at least one of said middle-finger-stall or its root portion, said ring-finger-stall or its root portion, and said little-finger-stall or its root portion; and wherein the one or more ball assisting portions are at least 6.15 mm and at most 26.6 mm in height.

16. The ball catching tool for baseball or softball according to claim 1, wherein said finger-stall includes an index-finger-stall receiving the index finger of the user, a middle-finger-stall receiving the middle finger of the user, a ring-finger -stall receiving the ring finger of the user, and a little-finger-stall receiving the little finger of the user, a first ball catching assisting portion is provided on a ball catching side surface of said thumb-stall or its root portion, a second ball catching assisting portion is provided on a ball catching side surface of at least one of said middle-finger-stall or its root portion, said ring-finger -stall or its root portion, and said little-finger-stall or its root portion, and the sum of the heights of said first ball catching assisting portion and said second ball assisting portion is at least 6.15 mm and at most 26.6 mm.

17. The ball catching tool for baseball or softball according to claim 13, wherein the inclined surface comprises one or more beveled edges comprising a first end, a middle, and a second end; and wherein the one or more beveled edges are more beveled in the middle that at the first end and the second end.

18. The ball catching tool for baseball or softball according to claim 13, wherein the ball catching assisting portion forms a substantially triangular prism; and at least one edge of the triangular prism is beveled to form the inclined surface.

19. The ball catching tool for baseball or softball according to claim 13, wherein the ball catching assisting portion forms a substantially rectangular prism; and at least one edge of the rectangular prism is beveled to form the inclined surface.

20. A ball catching tool for baseball or softball, comprising:

a surface skin formed by sewing together a ball catching surface skin and a dorsal skin;

a pocket portion disposed on a central portion of said ball catching surface skin;

a thumb-stall for receiving the thumb of a user;

one or more finger-stalls for receiving fingers of the user other than the thumb;

a web portion, disposed between the thumb-stall and the one or more finger-stalls;

an opening for the user to insert his/her hand; and one or more ball catching assisting portions, each ball catching assisting portion arranged on the root portion or the tip portion of the thumb-stall or the one or more finger-stalls;

wherein the one or more ball catching assisting portions are substantially prismatic in shape; and wherein said ball catching assisting portion is not provided on said pocket portion.

* * * * *